US009234428B2

(12) United States Patent
Good et al.

(10) Patent No.: US 9,234,428 B2
(45) Date of Patent: Jan. 12, 2016

(54) TURBINE BUCKET INTERNAL CORE PROFILE

(75) Inventors: Randall Richard Good, Simpsonville, SC (US); Bradley Taylor Boyer, Greenville, SC (US); Xiaoyong Fu, Greer, SC (US); Aaron Ezekiel Smith, Simpsonville, SC (US); Jacob C. Perry, II, Taylors, SC (US)

(73) Assignee: General Electric Company, Schenectady, NY (US)

( * ) Notice: Subject to any disclaimer, the term of this patent is extended or adjusted under 35 U.S.C. 154(b) by 742 days.

(21) Appl. No.: 13/613,922

(22) Filed: Sep. 13, 2012

(65) Prior Publication Data

US 2014/0069110 A1 Mar. 13, 2014

(51) Int. Cl.
*F01D 5/14* (2006.01)
*F01D 5/18* (2006.01)

(52) U.S. Cl.
CPC . *F01D 5/14* (2013.01); *F01D 5/187* (2013.01)

(58) Field of Classification Search
CPC ..... B23P 15/02
See application file for complete search history.

(56) References Cited

U.S. PATENT DOCUMENTS

| | | | | |
|---|---|---|---|---|
| 5,296,308 | A * | 3/1994 | Caccavale et al. | 428/586 |
| 5,536,143 | A * | 7/1996 | Jacala et al. | 416/96 R |
| 5,980,209 | A | 11/1999 | Barry et al. | |
| 6,722,851 | B1 | 4/2004 | Brittingham et al. | |
| 6,761,535 | B1 | 7/2004 | McGrath et al. | |
| 6,966,756 | B2 | 11/2005 | McGrath et al. | |
| 8,740,570 | B2 * | 6/2014 | Stein et al. | 416/223 A |

OTHER PUBLICATIONS

U.S. Appl. No. 13/304,734, filed Nov. 28, 2011.

* cited by examiner

*Primary Examiner* — Richard Edgar
*Assistant Examiner* — Brian O Peters
(74) *Attorney, Agent, or Firm* — Dority & Manning, P.A.

(57) ABSTRACT

Turbine bucket nominal internal core profiles and core insert external profiles are provided. In one embodiment, a turbine bucket includes an airfoil, platform, shank and dovetail. The bucket has a nominal internal core profile substantially in accordance with Cartesian coordinate values of X, Y and Z set forth in Table 1 wherein the Z values are non-dimensional values from 0 to 1 convertible to Z distances in inches by multiplying the Z values by a height of the bucket in inches, and wherein X and Y are non-dimensional values which, when connected by smooth continuing arcs, define internal core profile sections at each distance Z along the bucket, the profile sections at the Z distances being joined smoothly with one another to form said bucket internal core profile.

15 Claims, 6 Drawing Sheets

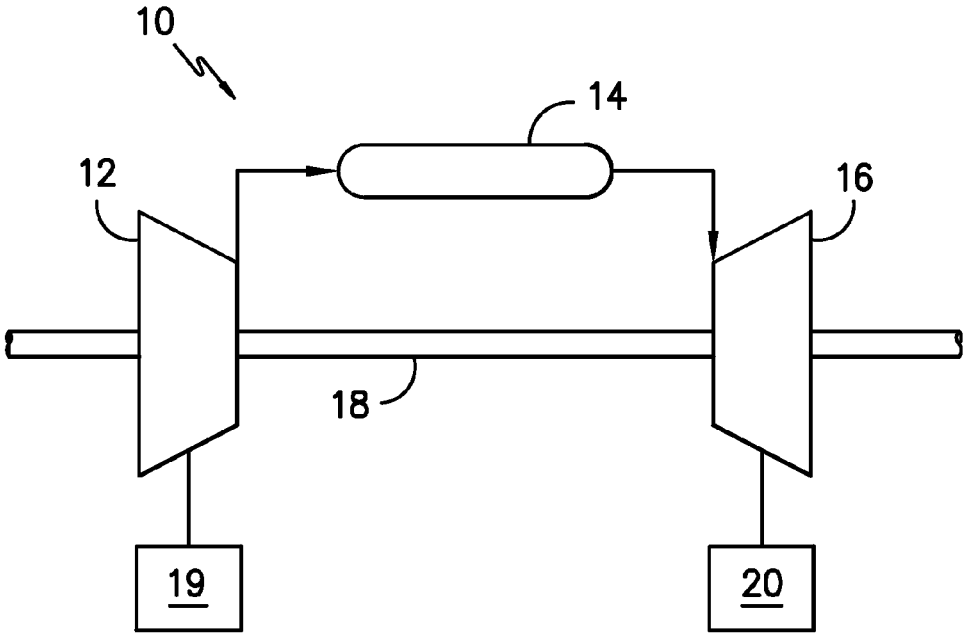
FIG. –1–
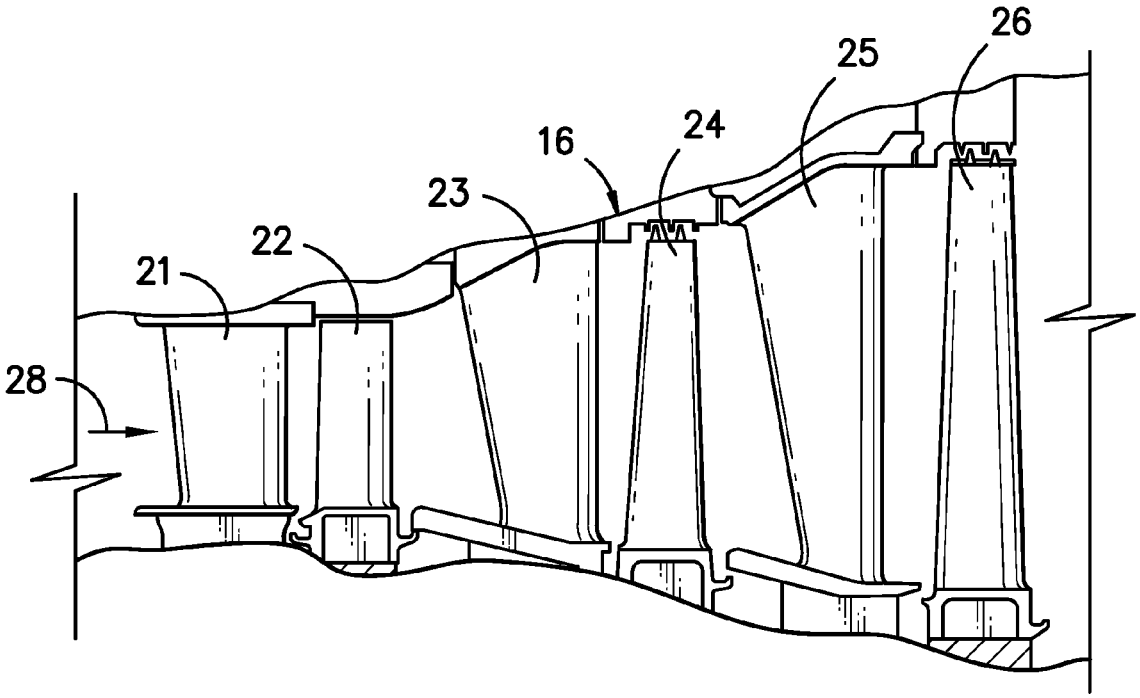
FIG. –2–

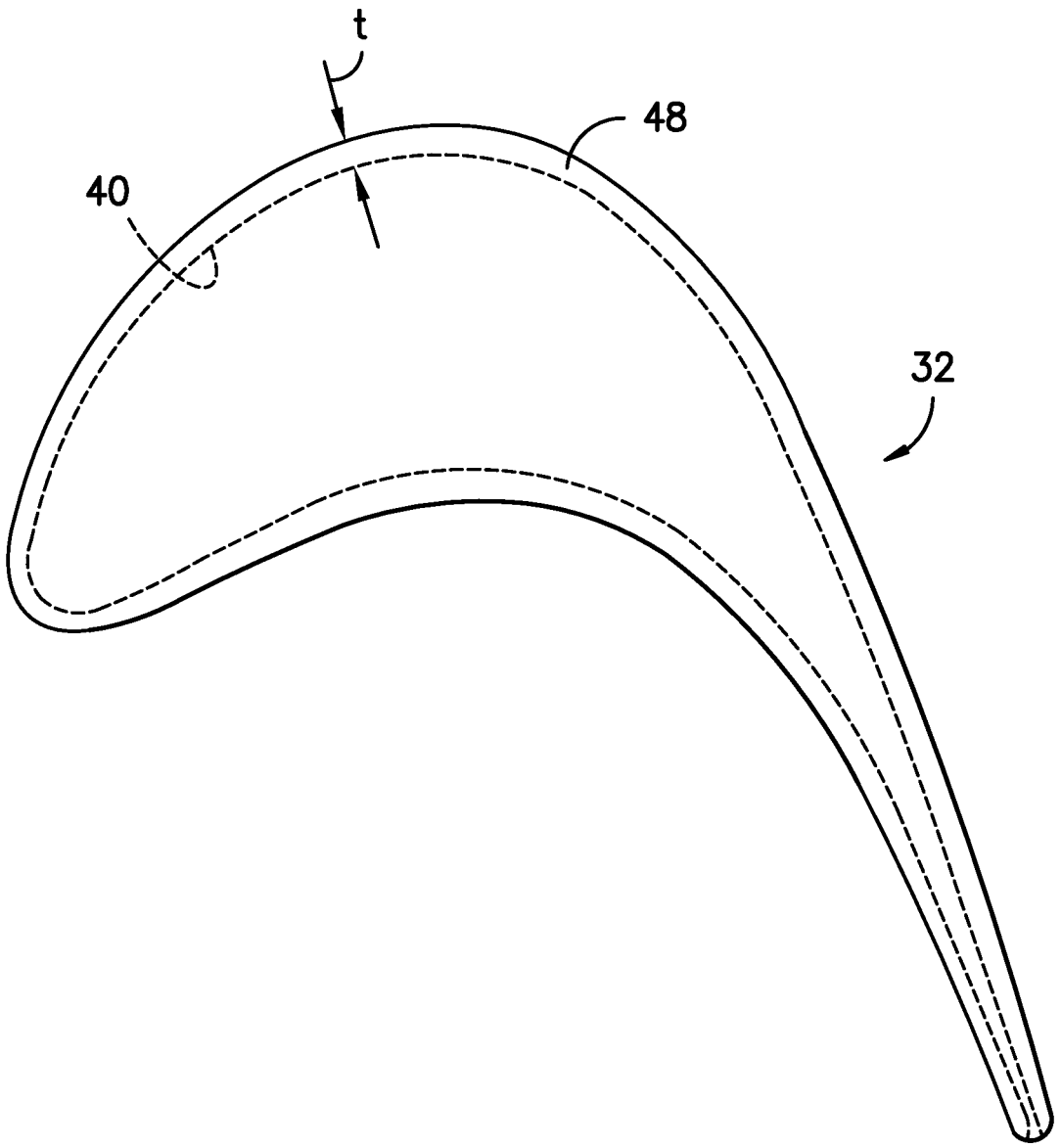
FIG. –9–

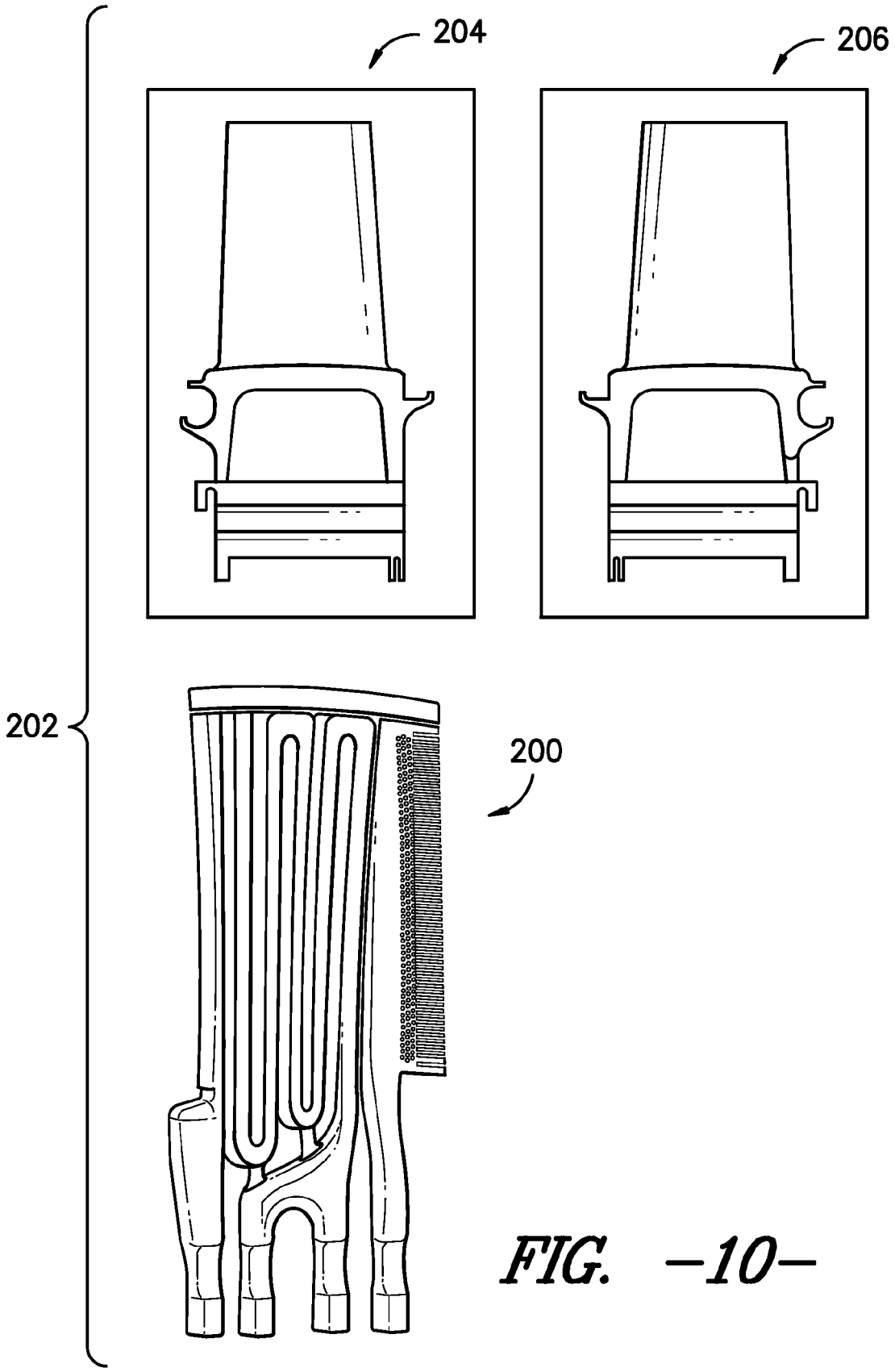
FIG. –10–

TURBINE BUCKET INTERNAL CORE PROFILE

FIELD OF THE INVENTION

The present disclosure relates in general to turbomachines, and more particularly to internal core profiles of buckets in turbomachines.

BACKGROUND OF THE INVENTION

Gas turbine systems are one example of turbomachines widely utilized in fields such as power generation. A conventional gas turbine system includes a compressor section, a combustor section, and a turbine section. During operation of the gas turbine system, various components in the system are subjected to high temperature flows, which can cause the components to fail. Since higher temperature flows generally result in increased performance, efficiency, and power output of the gas turbine system, the components that are subjected to high temperature flows should be cooled to allow the gas turbine system to operate at increased temperatures.

Many system requirements should be met for each stage of the turbine section, or hot gas path section, of a gas turbine system in order to meet design goals including overall improved efficiency and airfoil loading. Particularly, the buckets of the first stage of the turbine section should meet the operating requirements for that particular stage and also meet requirements for bucket cooling area and wall thickness. Internal cooling requirements should be optimized, necessitating a unique internal core profile to meet stage performance requirements enabling the turbine to operate in a safe, efficient and smooth manner.

Accordingly, improved buckets are desired in the art. In particular, improved internal core profiles for buckets would be advantageous.

BRIEF DESCRIPTION OF THE INVENTION

Aspects and advantages of the invention will be set forth in part in the following description, or may be obvious from the description, or may be learned through practice of the invention.

In accordance with the preferred embodiment of the present disclosure there is provided a unique internal core profile for a bucket of a gas turbine, preferably the first stage bucket, that enhances the performance of the gas turbine. It will be appreciated that the external airfoil shape of the bucket improves the interaction between various stages of the turbine, and affords improved aerodynamic efficiency and improved first stage airfoil aerodynamic and mechanical loading. The external airfoil profile for the preferred bucket is set forth in U.S. patent application Ser. No. 13/304,734, filed Nov. 28, 2011, entitled "Turbine Bucket Airfoil Profile", the disclosure of which is incorporated by reference. Concomitantly, the internal core shape is also significant for structural reasons as well as to optimize internal cooling with appropriate wall thickness. The bucket internal core profile is defined by a unique loci of points which achieves the necessary structural and cooling requirements whereby improved turbine performance is obtained. This unique loci of points define the internal nominal core profile and are identified by the X, Y and Z Cartesian coordinates of Table 1 which follows. The 3700 points for the coordinate values shown in Table 1 are for a cold, i.e., room temperature bucket at various cross-sections of the bucket along its length. The positive X, Y and Z directions are axial toward the exhaust end of the turbine, tangential in the direction of engine rotation looking aft and radially outwardly toward the bucket tip, respectively. The X and Y coordinates are joined smoothly at each Z location to form a smooth continuous internal core profile cross-section. The X, Y and Z coordinates are given in non-dimensionalized form, with the Z coordinates ranging from 0 to 1. By multiplying the airfoil height dimension, e.g., in inches, by the non-dimensional X, Y and Z values of Table 1, the internal core profile of the bucket is obtained. Each defined internal core profile section in the X, Y plane is joined smoothly with adjacent profile sections in the Z direction to form the complete internal bucket core profile.

The preferred first stage turbine bucket includes external convex and concave side wall surfaces with ribs extending internally between and formed integrally with the side walls defining the external side wall surfaces. The ribs are spaced from one another between leading and trailing edges of the bucket and define with internal wall surfaces of the bucket side walls internal cooling passages, preferably serpentine in configuration, along the length of the airfoil. The smooth continuing arcs extending between the X, Y coordinates to define each profile section at each distance Z extend along the internal wall surfaces of the cooling passages and between adjacent passages along each of the side walls to substantially conform to the adjacent external wall surfaces. Consequently, each internal core profile section has envelope portions which pass through the juncture between the ribs and each of the side walls as well as along the side walls of the cooling passages. These internal core profile sections are generally airfoil in shape.

It will be appreciated that as each bucket heats up in use, the internal core profile will change as a result of mechanical loading and temperature. Thus, the cold or room temperature profile is given by the X, Y and Z coordinates for manufacturing purposes. Because a manufactured internal bucket core profile may be different from the nominal profile given by the following table, a manufacturing tolerance of plus or minus 0.005 (non-dimensional) from the nominal profile in a direction normal to any surface location along the nominal profile defines a profile envelope for this internal bucket core profile. The profile is robust to this variation without impairment of the mechanical, cooling and aerodynamic functions of the bucket.

It will also be appreciated that the bucket can be scaled up or scaled down geometrically for introduction into similar turbine designs. Consequently, the X, Y and Z coordinates of the internal nominal core profile given below may be a function of the same constant or number. That is, the X, Y and Z coordinate values may be multiplied or divided by the same constant or number to provide a scaled up or scaled down version of the internal bucket core profile while retaining the core profile section shape. It should additionally be noted that the non-dimensional manufacturing tolerance may be scaled with the X, Y and Z coordinates.

In a preferred embodiment according to the present disclosure, there is provided a turbine bucket including an airfoil, platform, shank and dovetail, the bucket having an internal nominal core profile substantially in accordance with Cartesian coordinate values of X, Y and Z set forth in Table 1 wherein the Z values are non-dimensional values from 0 to 1 convertible to Z distances in inches by multiplying the Z values by a height of the bucket in inches, and wherein X and Y are non-dimensional values which, when connected by smooth continuing arcs, define internal core profile sections at each distance Z along the bucket, the profile sections at the Z distances being joined smoothly with one another to form the bucket internal core profile.

In accordance with another embodiment of the present disclosure, there is provided a core insert having a nominal external core insert profile substantially in accordance with Cartesian coordinate values of X, Y and Z set forth in Table 1 wherein the Z values are non-dimensional values from 0 to 1 convertible to Z distances in inches by multiplying the Z values by a height in inches, and wherein X and Y are non-dimensional values which, when connected by smooth continuing arcs, define external core insert profile sections at each distance Z along the core insert, the profile sections at the Z distances being joined smoothly with one another to form said external core insert profile.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic illustration of a gas turbine system;

FIG. 2 is a sectional side view of the turbine section of a gas turbine system according to one embodiment of the present disclosure;

FIG. 9 is a generalized cross-sectional view taken along a cut through the bucket airfoil to illustrate an internal core profile thereof; and FIG. 10 is a perspective view of one embodiment of various components of a mold for casting a bucket assembly of the present disclosure.

DETAILED DESCRIPTION OF THE INVENTION

Figure 4:
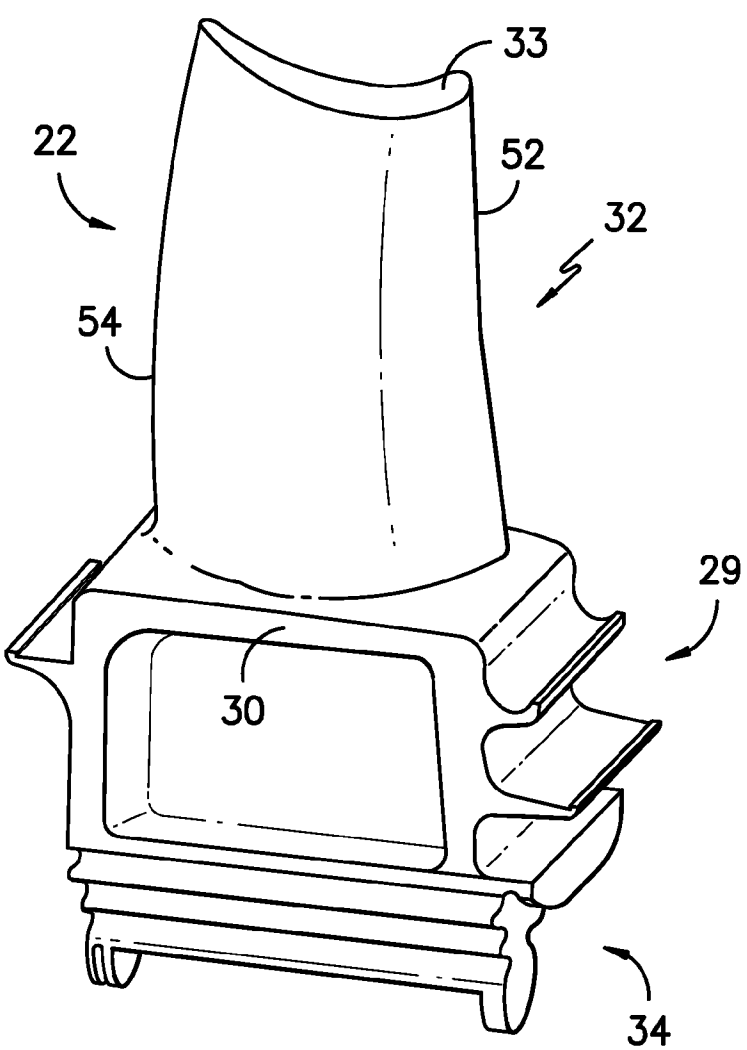
FIG. 4 is another perspective view of the bucket of FIG. 3, as viewed from a generally circumferential direction.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a turbomachine, which in the embodiment shown is a gas turbine system 10. The system 10 may include a compressor section 12, a combustor section 14, and a turbine section 16. The compressor section 12 and turbine section 16 may be coupled by a shaft 18. The shaft 18 may be a single shaft or a plurality of shaft segments coupled together to form shaft 18. An inlet section 19 may provide an air flow to the compressor section 12, and exhaust gases may be exhausted from the turbine section 16 through an exhaust section 20 and exhausted and/or utilized in the system 10 or other suitable system.

The turbine section 16 may include a plurality of turbine stages. For example, in one embodiment, the turbine section 16 may have three stages, as shown in FIG. 2. For example, a first stage of the turbine 16 may include a plurality of circumferentially spaced nozzles 21 and buckets 22. The nozzles 21 may be disposed and fixed circumferentially about the shaft 18. The buckets 22 may be disposed circumferentially about the shaft 18 and coupled to the shaft 18. A second stage of the turbine section 16 may include a plurality of circumferentially spaced nozzles 23 and buckets 24. The nozzles 23 may be disposed and fixed circumferentially about the shaft 18. The buckets 24 may be disposed circumferentially about the shaft 18 and coupled to the shaft 18. A third stage of the turbine section 16 may include a plurality of circumferentially spaced nozzles 25 and buckets 26. The nozzles 25 may be disposed and fixed circumferentially about the shaft 18. The buckets 26 may be disposed circumferentially about the shaft 18 and coupled to the shaft 18. The various stages of the turbine section 16 may be disposed in the turbine section 16 in the path of hot gas flow 28. It should be understood that the turbine section 16 is not limited to three stages, but rather that any number of stages are within the scope and spirit of the present disclosure.

Figure 3:
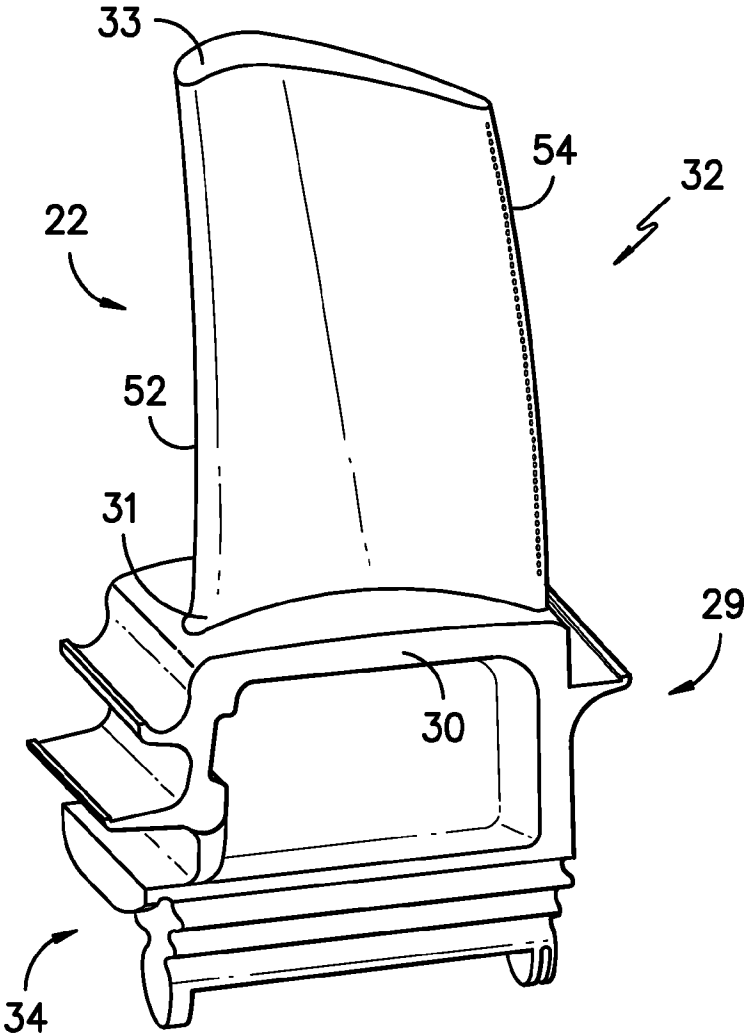
FIG. 3 is a perspective view of one embodiment of bucket of the present disclosure.
Figure 5:
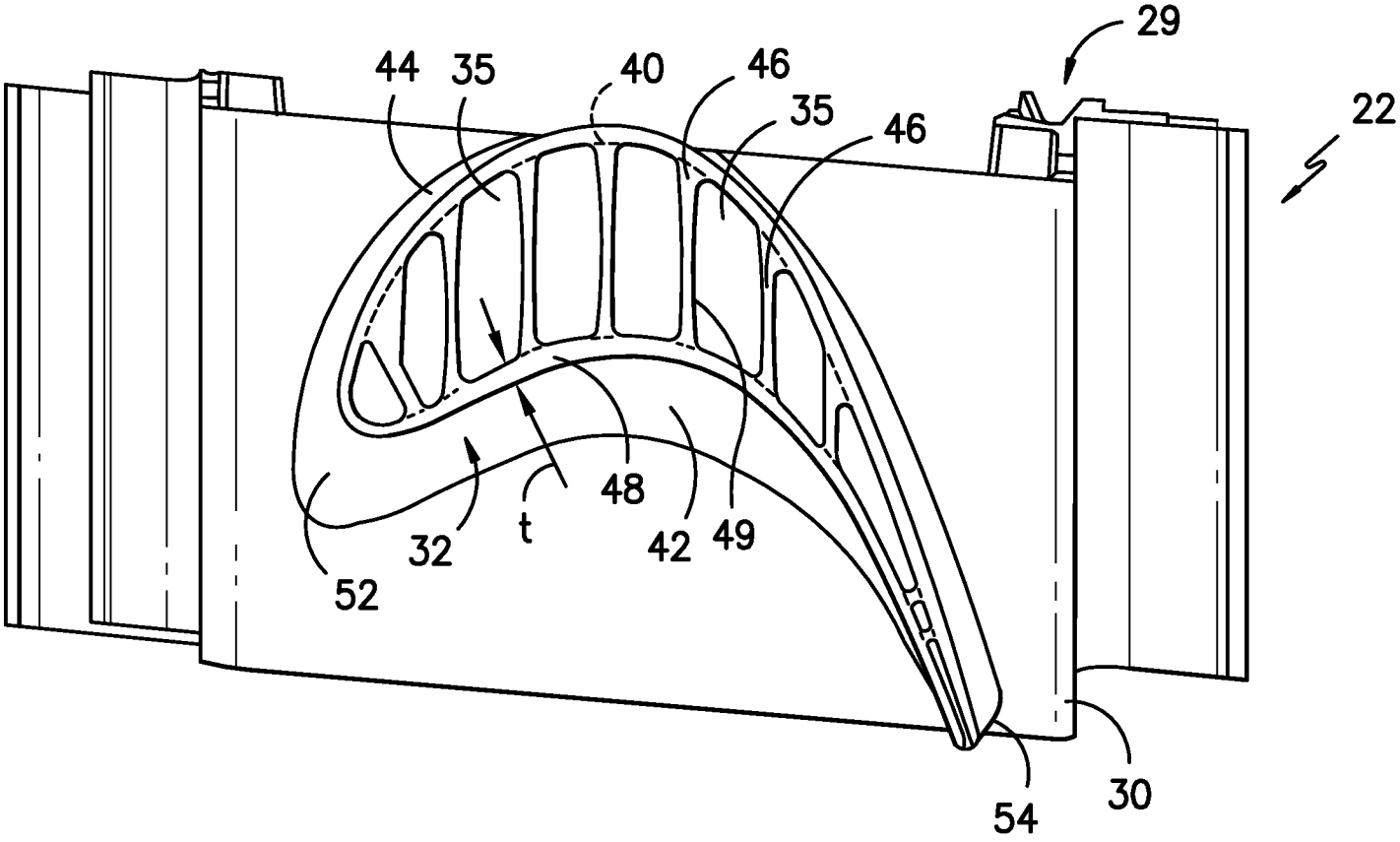
FIG. 5 is a top cross-sectional view of the bucket of FIG. 3, illustrating its external cross-sectional profile and, by the dashed lines, an internal core profile.

Referring to FIG. 3, it will be appreciated that the buckets, for example the buckets 22 of the first stage, are mounted on a rotor wheel, not shown, forming part of rotor and include platforms 30, shanks 29 and dovetails 34. It should be noted that while the present disclosure discusses various features and embodiments with respect to first stage buckets 22, the present disclosure is not limited to the use of the these features and embodiments with first stage buckets 22, and rather that use of these features and embodiments with any suitable buckets in any suitable stage is within the scope and spirit of the present disclosure. Each bucket 22 is provided with a substantially or near axial entry dovetail 34 for connection with a complementary-shaped mating dovetail, not shown, on the rotor wheel. An axial entry dovetail, however, may be provided. It will also be appreciated that each bucket 22 has an external bucket airfoil 32 as illustrated in FIGS. 3-5. Thus, each of the buckets 22 has a bucket airfoil profile at any cross-section from the airfoil root 31 to the bucket tip 33 in the shape of an airfoil 32. In this preferred embodiment of a first stage turbine bucket, there are seventy (70) bucket airfoils. Each bucket 22 includes a plurality of internal, generally serpentine-shaped, cooling passages 35 forming several air cooling circuits extending from the base of the dovetail to the tip of the bucket airfoil. These air cooling circuits exhaust from the airfoil 32 into the hot gas path at various exit locations on the external surfaces of the bucket, such as on the leading edge and/or trailing edge and/or other suitable locations.

More particularly, each bucket airfoil 32 includes convex and concave external wall surfaces, i.e., pressure and suction surfaces 42 and 44, respectively, which, with an internal core profile 40, 56, define an airfoil wall thickness "t." Each bucket 22 also includes a plurality of ribs 46 extending between or projecting from opposite side walls 48 of the bucket. Ribs 46 are spaced from one another between leading and trailing edges 52 and 54 of the bucket, respectively, and extend generally from the base of the dovetail to the bucket airfoil tip to define, with internal wall surface portions 49 of bucket side walls 48, the plurality of internal generally serpentine-shaped cooling passages 35. Certain of the ribs terminate short of the base of the dovetail and the tip of the airfoil.

To define the internal core shape of each bucket from the base of the dovetail to the tip of the bucket airfoil, there is provided a unique set or loci of points in space that meet the stage requirements, bucket cooling area and wall thickness and can be manufactured. This unique loci of points, which defines the internal bucket core profile 40, comprises a set of 3700 points. A Cartesian coordinate system of X, Y and Z values given in Table 1 below defines this internal core profile 40 of the bucket 22 at various locations along its length. The coordinate values for the X, Y and Z coordinates are set forth in Table 1 in non-dimensional form from 0 to 1. To convert the X, Y or Z value to a respective X, Y or Z coordinate value, e.g., in inches, the non-dimensional X, Y or Z value given in the Table is multiplied by the height of bucket in inches. For a preferred first-stage bucket, the bucket height from the base of the dovetail to the tip of the airfoil may in some embodiments be between 13.2 inches and 13.4 inches, such as 13.2888 inches. In other preferred embodiments, the bucket height from the base of the dovetail to the tip of the airfoil may in some embodiments be between 11.0 inches and 11.2 inches. The Cartesian coordinate system has orthogonally-related X, Y and Z axes and the X axis lies parallel to the turbine rotor centerline, i.e., the rotary axis and a positive X coordinate value is axial toward the aft, i.e., exhaust end of the turbine. The positive Y coordinate value extends tangentially in the direction of rotation of the rotor, looking aft, and the positive Z coordinate value is radially outwardly toward the bucket tip.

By defining X and Y coordinate values at selected locations in a Z direction normal to the X, Y plane, the internal core profile 40 of the bucket, e.g., representatively illustrated by the dashed lines in FIGS. 5 and 9, at each Z distance along the length of the bucket can be ascertained. By connecting the X and Y values with smooth continuing arcs, each internal core profile section 40 at each distance Z is fixed. The internal core profiles of the various internal locations between the distances Z are determined by smoothly connecting the adjacent profile sections 40 to one another to form the core profile. These values represent the internal core profiles at ambient, non-operating or non-hot conditions.

Figure 8:
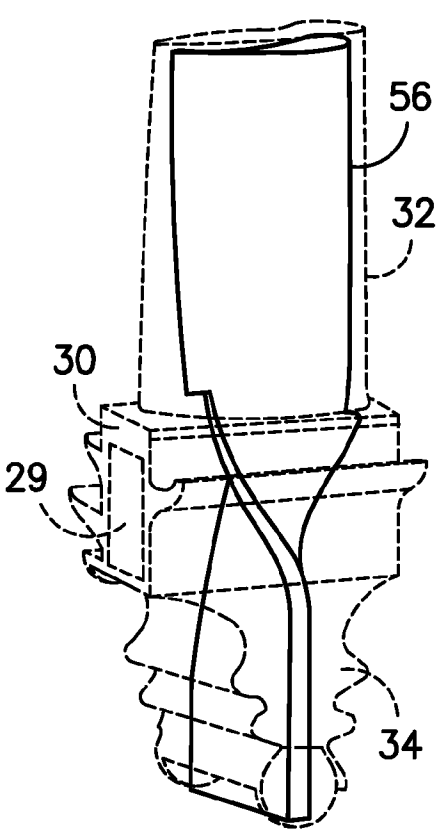
FIGS. 6-8 are respective external perspective views of the bucket, illustrated by the dashed lines, with internal core profiles illustrated by the full lines passing through the bucket.
Figure 7:
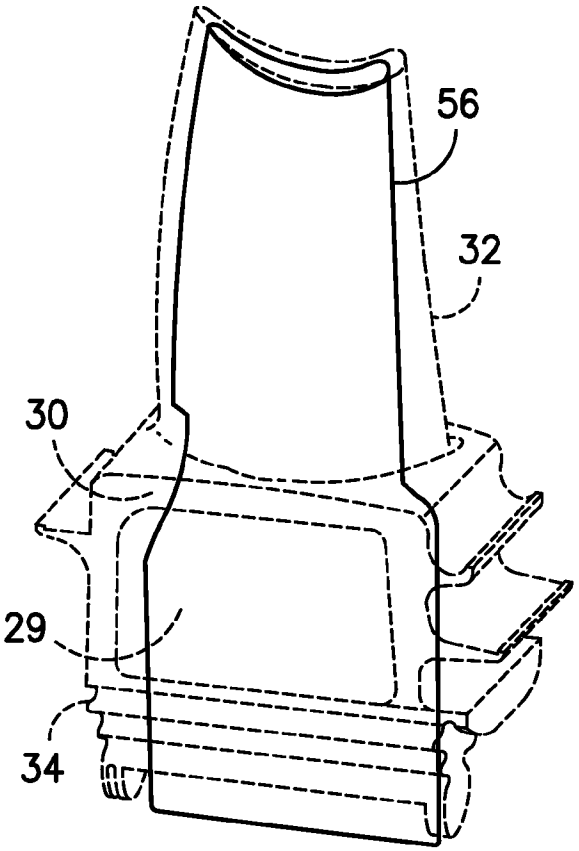
Figure 6:
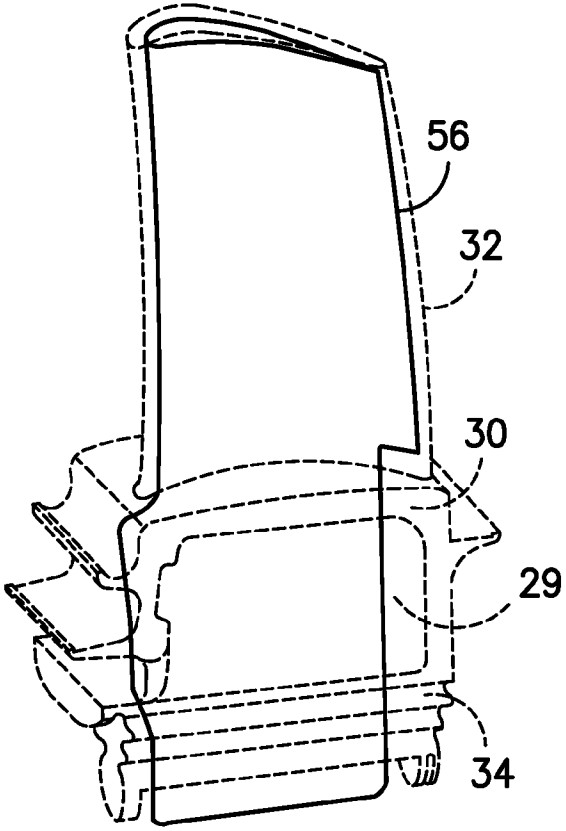

The smooth continuing arcs extending between the X, Y coordinates to define each profile section 40 at each distance Z extend along the internal wall surface portions 49 and between adjacent passages 35 along each of the side walls 48 from the base of the dovetail to the bucket airfoil tip. Thus, each internal core profile 40 has envelope portions which pass through the juncture between the ribs 46 and the side walls 48 as well as along the side walls of the cooling passages. The internal core profile 40 for the bucket 22 is illustrated at 56 in FIGS. 6-8 and extends through the airfoil 32, platform 30 and dovetail 34.

The Table 1 values are generated and shown to five decimal places for determining the internal core profile of the bucket. There are typical manufacturing tolerances as well as coatings which should be accounted for in the actual internal profile of the bucket. Accordingly, the values for the profile given in Table 1 are for a nominal internal bucket core profile. It will therefore be appreciated that +/− typical manufacturing tolerances, i.e., +/− values, including any coating thicknesses, are additive to the X and Y values given in Table 1 below. Accordingly, a manufacturing tolerance of plus or minus 0.005 (non-dimensional) in a direction normal to any surface location along the internal core profile defines an internal core profile envelope for this particular bucket design and turbine, i.e., a range of variation between measured points on the actual internal core profile at nominal cold or room temperature and the ideal position of those points as given in Table 1 below at the same temperature. The internal core profile is robust to this range of variation without impairment of mechanical and cooling functions.

The coordinate values given in Table 1 below provide the preferred nominal internal core profile envelope.

TABLE 1

| X | Y | Z |
|---|---|---|
| 0.19094 | −0.00299 | 0.00000 |
| 0.19117 | 0.00561 | 0.00000 |
| 0.19170 | −0.01158 | 0.00000 |
| 0.19192 | 0.01420 | 0.00000 |
| 0.19253 | −0.02017 | 0.00000 |
| 0.19310 | 0.02275 | 0.00000 |
| 0.19543 | −0.02823 | 0.00000 |
| 0.19688 | 0.03045 | 0.00000 |
| 0.20101 | −0.03472 | 0.00000 |
| 0.20318 | 0.03625 | 0.00000 |
| 0.20860 | −0.03868 | 0.00000 |
| 0.21118 | 0.03928 | 0.00000 |
| 0.21715 | −0.03959 | 0.00000 |
| 0.21978 | 0.03959 | 0.00000 |
| 0.22578 | −0.03959 | 0.00000 |
| 0.22840 | 0.03959 | 0.00000 |
| 0.23440 | −0.03959 | 0.00000 |
| 0.23703 | 0.03959 | 0.00000 |
| 0.24302 | −0.03959 | 0.00000 |
| 0.24565 | 0.03959 | 0.00000 |
| 0.25164 | −0.03959 | 0.00000 |
| 0.25427 | 0.03959 | 0.00000 |
| 0.26026 | −0.03959 | 0.00000 |
| 0.26289 | 0.03959 | 0.00000 |
| 0.26889 | −0.03959 | 0.00000 |
| 0.27151 | 0.03959 | 0.00000 |
| 0.27751 | −0.03959 | 0.00000 |
| 0.28014 | 0.03959 | 0.00000 |
| 0.28614 | −0.03959 | 0.00000 |
| 0.28876 | 0.03959 | 0.00000 |
| 0.29475 | −0.03959 | 0.00000 |
| 0.29739 | 0.03959 | 0.00000 |
| 0.30338 | −0.03959 | 0.00000 |
| 0.30600 | 0.03959 | 0.00000 |
| 0.31200 | −0.03959 | 0.00000 |
| 0.31463 | 0.03959 | 0.00000 |
| 0.32062 | −0.03959 | 0.00000 |
| 0.32325 | 0.03959 | 0.00000 |
| 0.32925 | −0.03959 | 0.00000 |
| 0.33187 | 0.03959 | 0.00000 |
| 0.33787 | −0.03959 | 0.00000 |
| 0.34050 | 0.03959 | 0.00000 |
| 0.34649 | −0.03959 | 0.00000 |
| 0.34911 | 0.03959 | 0.00000 |
| 0.35511 | −0.03959 | 0.00000 |
| 0.35774 | 0.03959 | 0.00000 |
| 0.36373 | −0.03959 | 0.00000 |
| 0.36636 | 0.03959 | 0.00000 |
| 0.37236 | −0.03959 | 0.00000 |
| 0.37498 | 0.03959 | 0.00000 |
| 0.38098 | −0.03959 | 0.00000 |
| 0.38361 | 0.03959 | 0.00000 |
| 0.38960 | −0.03959 | 0.00000 |
| 0.39223 | 0.03959 | 0.00000 |
| 0.39822 | −0.03959 | 0.00000 |
| 0.40085 | 0.03959 | 0.00000 |
| 0.40685 | −0.03959 | 0.00000 |
| 0.40947 | 0.03959 | 0.00000 |
| 0.41547 | −0.03959 | 0.00000 |
| 0.41810 | 0.03959 | 0.00000 |
| 0.42409 | −0.03959 | 0.00000 |
| 0.42672 | 0.03959 | 0.00000 |
| 0.43271 | −0.03959 | 0.00000 |
| 0.43534 | 0.03959 | 0.00000 |
| 0.44133 | −0.03959 | 0.00000 |
| 0.44396 | 0.03959 | 0.00000 |
| 0.44996 | −0.03959 | 0.00000 |

TABLE 1-continued

| X | Y | Z |
|---|---|---|
| 0.45258 | 0.03959 | 0.00000 |
| 0.45858 | −0.03959 | 0.00000 |
| 0.46121 | 0.03959 | 0.00000 |
| 0.46721 | −0.03959 | 0.00000 |
| 0.46983 | 0.03959 | 0.00000 |
| 0.47582 | −0.03959 | 0.00000 |
| 0.47846 | 0.03959 | 0.00000 |
| 0.48445 | −0.03959 | 0.00000 |
| 0.48707 | 0.03959 | 0.00000 |
| 0.49307 | −0.03959 | 0.00000 |
| 0.49570 | 0.03959 | 0.00000 |
| 0.50169 | −0.03959 | 0.00000 |
| 0.50432 | 0.03959 | 0.00000 |
| 0.51032 | −0.03959 | 0.00000 |
| 0.51294 | 0.03959 | 0.00000 |
| 0.51893 | −0.03959 | 0.00000 |
| 0.52157 | 0.03959 | 0.00000 |
| 0.52756 | −0.03959 | 0.00000 |
| 0.53018 | 0.03959 | 0.00000 |
| 0.53618 | −0.03959 | 0.00000 |
| 0.53882 | 0.03949 | 0.00000 |
| 0.54462 | −0.03814 | 0.00000 |
| 0.54704 | 0.03706 | 0.00000 |
| 0.55191 | −0.03364 | 0.00000 |
| 0.55374 | 0.03173 | 0.00000 |
| 0.55701 | −0.02676 | 0.00000 |
| 0.55804 | 0.02432 | 0.00000 |
| 0.55935 | −0.01849 | 0.00000 |
| 0.55958 | 0.01587 | 0.00000 |
| 0.56010 | −0.00990 | 0.00000 |
| 0.56034 | 0.00728 | 0.00000 |
| 0.56086 | −0.00131 | 0.00000 |
| 0.56086 | −0.00131 | 0.00000 |
| 0.19092 | −0.00278 | 0.02778 |
| 0.19115 | 0.00540 | 0.02778 |
| 0.19203 | −0.01090 | 0.02778 |
| 0.19287 | 0.01340 | 0.02778 |
| 0.19546 | −0.01829 | 0.02778 |
| 0.19707 | 0.02040 | 0.02778 |
| 0.20113 | −0.02416 | 0.02778 |
| 0.20336 | 0.02559 | 0.02778 |
| 0.20848 | −0.02768 | 0.02778 |
| 0.21106 | 0.02821 | 0.02778 |
| 0.21663 | −0.02841 | 0.02778 |
| 0.21926 | 0.02841 | 0.02778 |
| 0.22484 | −0.02841 | 0.02778 |
| 0.22746 | 0.02841 | 0.02778 |
| 0.23304 | −0.02841 | 0.02778 |
| 0.23566 | 0.02841 | 0.02778 |
| 0.24124 | −0.02841 | 0.02778 |
| 0.24387 | 0.02841 | 0.02778 |
| 0.24944 | −0.02841 | 0.02778 |
| 0.25207 | 0.02841 | 0.02778 |
| 0.25764 | −0.02841 | 0.02778 |
| 0.26027 | 0.02841 | 0.02778 |
| 0.26584 | −0.02841 | 0.02778 |
| 0.26847 | 0.02841 | 0.02778 |
| 0.27404 | −0.02841 | 0.02778 |
| 0.27667 | 0.02841 | 0.02778 |
| 0.28225 | −0.02841 | 0.02778 |
| 0.28487 | 0.02841 | 0.02778 |
| 0.29045 | −0.02841 | 0.02778 |
| 0.29307 | 0.02841 | 0.02778 |
| 0.29865 | −0.02841 | 0.02778 |
| 0.30128 | 0.02841 | 0.02778 |
| 0.30685 | −0.02841 | 0.02778 |
| 0.30948 | 0.02841 | 0.02778 |
| 0.31505 | −0.02841 | 0.02778 |
| 0.31768 | 0.02841 | 0.02778 |
| 0.32325 | −0.02841 | 0.02778 |
| 0.32588 | 0.02841 | 0.02778 |
| 0.33145 | −0.02841 | 0.02778 |
| 0.33408 | 0.02841 | 0.02778 |
| 0.33965 | −0.02841 | 0.02778 |
| 0.34228 | 0.02841 | 0.02778 |
| 0.34786 | −0.02841 | 0.02778 |
| 0.35048 | 0.02841 | 0.02778 |
| 0.35606 | −0.02841 | 0.02778 |

TABLE 1-continued

| X | Y | Z |
|---|---|---|
| 0.35869 | 0.02841 | 0.02778 |
| 0.36426 | −0.02841 | 0.02778 |
| 0.36689 | 0.02841 | 0.02778 |
| 0.37246 | −0.02841 | 0.02778 |
| 0.37509 | 0.02841 | 0.02778 |
| 0.38067 | −0.02841 | 0.02778 |
| 0.38329 | 0.02841 | 0.02778 |
| 0.38886 | −0.02841 | 0.02778 |
| 0.39150 | 0.02841 | 0.02778 |
| 0.39706 | −0.02841 | 0.02778 |
| 0.39969 | 0.02841 | 0.02778 |
| 0.40527 | −0.02841 | 0.02778 |
| 0.40789 | 0.02841 | 0.02778 |
| 0.41347 | −0.02841 | 0.02778 |
| 0.41609 | 0.02841 | 0.02778 |
| 0.42167 | −0.02841 | 0.02778 |
| 0.42430 | 0.02841 | 0.02778 |
| 0.42987 | −0.02841 | 0.02778 |
| 0.43250 | 0.02841 | 0.02778 |
| 0.43808 | −0.02841 | 0.02778 |
| 0.44070 | 0.02841 | 0.02778 |
| 0.44628 | −0.02841 | 0.02778 |
| 0.44890 | 0.02841 | 0.02778 |
| 0.45447 | −0.02841 | 0.02778 |
| 0.45711 | 0.02841 | 0.02778 |
| 0.46268 | −0.02841 | 0.02778 |
| 0.46530 | 0.02841 | 0.02778 |
| 0.47088 | −0.02841 | 0.02778 |
| 0.47350 | 0.02841 | 0.02778 |
| 0.47908 | −0.02841 | 0.02778 |
| 0.48171 | 0.02841 | 0.02778 |
| 0.48728 | −0.02841 | 0.02778 |
| 0.48991 | 0.02841 | 0.02778 |
| 0.49548 | −0.02841 | 0.02778 |
| 0.49811 | 0.02841 | 0.02778 |
| 0.50369 | −0.02841 | 0.02778 |
| 0.50631 | 0.02841 | 0.02778 |
| 0.51189 | −0.02841 | 0.02778 |
| 0.51452 | 0.02841 | 0.02778 |
| 0.52008 | −0.02841 | 0.02778 |
| 0.52272 | 0.02841 | 0.02778 |
| 0.52829 | −0.02841 | 0.02778 |
| 0.53092 | 0.02841 | 0.02778 |
| 0.53649 | −0.02841 | 0.02778 |
| 0.53913 | 0.02836 | 0.02778 |
| 0.54456 | −0.02726 | 0.02778 |
| 0.54700 | 0.02626 | 0.02778 |
| 0.55167 | −0.02327 | 0.02778 |
| 0.55360 | 0.02147 | 0.02778 |
| 0.55698 | −0.01707 | 0.02778 |
| 0.55821 | 0.01473 | 0.02778 |
| 0.55996 | −0.00947 | 0.02778 |
| 0.56037 | 0.00687 | 0.02778 |
| 0.56086 | −0.00131 | 0.02778 |
| 0.56086 | −0.00131 | 0.02778 |
| 0.19092 | −0.00269 | 0.05556 |
| 0.19133 | 0.00531 | 0.05556 |
| 0.19307 | −0.01037 | 0.05556 |
| 0.19437 | 0.01267 | 0.05556 |
| 0.19776 | −0.01681 | 0.05556 |
| 0.19977 | 0.01853 | 0.05556 |
| 0.20440 | −0.02123 | 0.05556 |
| 0.20687 | 0.02214 | 0.05556 |
| 0.21216 | −0.02306 | 0.05556 |
| 0.21479 | 0.02309 | 0.05556 |
| 0.22019 | −0.02309 | 0.05556 |
| 0.22281 | 0.02309 | 0.05556 |
| 0.22820 | −0.02309 | 0.05556 |
| 0.23083 | 0.02309 | 0.05556 |
| 0.23622 | −0.02309 | 0.05556 |
| 0.23885 | 0.02309 | 0.05556 |
| 0.24424 | −0.02309 | 0.05556 |
| 0.24686 | 0.02309 | 0.05556 |
| 0.25225 | −0.02309 | 0.05556 |
| 0.25488 | 0.02309 | 0.05556 |
| 0.26027 | −0.02309 | 0.05556 |
| 0.26290 | 0.02309 | 0.05556 |
| 0.26829 | −0.02309 | 0.05556 |

TABLE 1-continued

| X | Y | Z |
|---|---|---|
| 0.27091 | 0.02309 | 0.05556 |
| 0.27630 | −0.02309 | 0.05556 |
| 0.27893 | 0.02309 | 0.05556 |
| 0.28432 | −0.02309 | 0.05556 |
| 0.28695 | 0.02309 | 0.05556 |
| 0.29234 | −0.02309 | 0.05556 |
| 0.29496 | 0.02309 | 0.05556 |
| 0.30036 | −0.02309 | 0.05556 |
| 0.30298 | 0.02309 | 0.05556 |
| 0.30837 | −0.02309 | 0.05556 |
| 0.31100 | 0.02309 | 0.05556 |
| 0.31639 | −0.02309 | 0.05556 |
| 0.31901 | 0.02309 | 0.05556 |
| 0.32441 | −0.02309 | 0.05556 |
| 0.32703 | 0.02309 | 0.05556 |
| 0.33242 | −0.02309 | 0.05556 |
| 0.33505 | 0.02309 | 0.05556 |
| 0.34044 | −0.02309 | 0.05556 |
| 0.34306 | 0.02309 | 0.05556 |
| 0.34846 | −0.02309 | 0.05556 |
| 0.35109 | 0.02309 | 0.05556 |
| 0.35647 | −0.02309 | 0.05556 |
| 0.35910 | 0.02309 | 0.05556 |
| 0.36449 | −0.02309 | 0.05556 |
| 0.36712 | 0.02309 | 0.05556 |
| 0.37251 | −0.02309 | 0.05556 |
| 0.37514 | 0.02309 | 0.05556 |
| 0.38052 | −0.02309 | 0.05556 |
| 0.38315 | 0.02309 | 0.05556 |
| 0.38855 | −0.02309 | 0.05556 |
| 0.39117 | 0.02309 | 0.05556 |
| 0.39656 | −0.02309 | 0.05556 |
| 0.39919 | 0.02309 | 0.05556 |
| 0.40457 | −0.02309 | 0.05556 |
| 0.40720 | 0.02309 | 0.05556 |
| 0.41260 | −0.02309 | 0.05556 |
| 0.41522 | 0.02309 | 0.05556 |
| 0.42061 | −0.02309 | 0.05556 |
| 0.42324 | 0.02309 | 0.05556 |
| 0.42862 | −0.02309 | 0.05556 |
| 0.43126 | 0.02309 | 0.05556 |
| 0.43665 | −0.02309 | 0.05556 |
| 0.43927 | 0.02309 | 0.05556 |
| 0.44466 | −0.02309 | 0.05556 |
| 0.44729 | 0.02309 | 0.05556 |
| 0.45268 | −0.02309 | 0.05556 |
| 0.45531 | 0.02309 | 0.05556 |
| 0.46070 | −0.02309 | 0.05556 |
| 0.46332 | 0.02309 | 0.05556 |
| 0.46871 | −0.02309 | 0.05556 |
| 0.47134 | 0.02309 | 0.05556 |
| 0.47673 | −0.02309 | 0.05556 |
| 0.47936 | 0.02309 | 0.05556 |
| 0.48475 | −0.02309 | 0.05556 |
| 0.48737 | 0.02309 | 0.05556 |
| 0.49276 | −0.02309 | 0.05556 |
| 0.49539 | 0.02309 | 0.05556 |
| 0.50078 | −0.02309 | 0.05556 |
| 0.50341 | 0.02309 | 0.05556 |
| 0.50880 | −0.02309 | 0.05556 |
| 0.51142 | 0.02309 | 0.05556 |
| 0.51682 | −0.02309 | 0.05556 |
| 0.51944 | 0.02309 | 0.05556 |
| 0.52483 | −0.02309 | 0.05556 |
| 0.52746 | 0.02309 | 0.05556 |
| 0.53285 | −0.02309 | 0.05556 |
| 0.53547 | 0.02309 | 0.05556 |
| 0.54086 | −0.02294 | 0.05556 |
| 0.54347 | 0.02249 | 0.05556 |
| 0.54849 | −0.02064 | 0.05556 |
| 0.55078 | 0.01931 | 0.05556 |
| 0.55484 | −0.01584 | 0.05556 |
| 0.55653 | 0.01379 | 0.05556 |
| 0.55913 | −0.00912 | 0.05556 |
| 0.56000 | 0.00662 | 0.05556 |
| 0.56086 | −0.00131 | 0.05556 |
| 0.56086 | −0.00131 | 0.05556 |
| 0.19058 | 0.00198 | 0.08333 |

TABLE 1-continued

| X | Y | Z |
|---|---|---|
| 0.19058 | 0.00198 | 0.08333 |
| 0.19094 | −0.00604 | 0.08333 |
| 0.19151 | 0.01015 | 0.08333 |
| 0.19277 | −0.01417 | 0.08333 |
| 0.19458 | 0.01772 | 0.08333 |
| 0.19709 | −0.02110 | 0.08333 |
| 0.20000 | 0.02383 | 0.08333 |
| 0.20355 | −0.02610 | 0.08333 |
| 0.20725 | 0.02756 | 0.08333 |
| 0.21140 | −0.02833 | 0.08333 |
| 0.21538 | 0.02841 | 0.08333 |
| 0.21962 | −0.02841 | 0.08333 |
| 0.22359 | 0.02841 | 0.08333 |
| 0.22783 | −0.02841 | 0.08333 |
| 0.23180 | 0.02841 | 0.08333 |
| 0.23604 | −0.02841 | 0.08333 |
| 0.24001 | 0.02841 | 0.08333 |
| 0.24425 | −0.02841 | 0.08333 |
| 0.24822 | 0.02841 | 0.08333 |
| 0.25247 | −0.02841 | 0.08333 |
| 0.25643 | 0.02841 | 0.08333 |
| 0.26068 | −0.02841 | 0.08333 |
| 0.26464 | 0.02841 | 0.08333 |
| 0.26889 | −0.02841 | 0.08333 |
| 0.27285 | 0.02841 | 0.08333 |
| 0.27710 | −0.02841 | 0.08333 |
| 0.28107 | 0.02841 | 0.08333 |
| 0.28531 | −0.02841 | 0.08333 |
| 0.28928 | 0.02841 | 0.08333 |
| 0.29353 | −0.02841 | 0.08333 |
| 0.29749 | 0.02841 | 0.08333 |
| 0.30174 | −0.02841 | 0.08333 |
| 0.30570 | 0.02841 | 0.08333 |
| 0.30995 | −0.02841 | 0.08333 |
| 0.31391 | 0.02841 | 0.08333 |
| 0.31816 | −0.02841 | 0.08333 |
| 0.32213 | 0.02841 | 0.08333 |
| 0.32637 | −0.02841 | 0.08333 |
| 0.33034 | 0.02841 | 0.08333 |
| 0.33458 | −0.02841 | 0.08333 |
| 0.33855 | 0.02841 | 0.08333 |
| 0.34279 | −0.02841 | 0.08333 |
| 0.34676 | 0.02841 | 0.08333 |
| 0.35100 | −0.02841 | 0.08333 |
| 0.35497 | 0.02841 | 0.08333 |
| 0.35921 | −0.02841 | 0.08333 |
| 0.36319 | 0.02841 | 0.08333 |
| 0.36743 | −0.02841 | 0.08333 |
| 0.37140 | 0.02841 | 0.08333 |
| 0.37564 | −0.02841 | 0.08333 |
| 0.37961 | 0.02841 | 0.08333 |
| 0.38385 | −0.02841 | 0.08333 |
| 0.38782 | 0.02841 | 0.08333 |
| 0.39206 | −0.02841 | 0.08333 |
| 0.39603 | 0.02841 | 0.08333 |
| 0.40027 | −0.02841 | 0.08333 |
| 0.40424 | 0.02841 | 0.08333 |
| 0.40849 | −0.02841 | 0.08333 |
| 0.41245 | 0.02841 | 0.08333 |
| 0.41670 | −0.02841 | 0.08333 |
| 0.42066 | 0.02841 | 0.08333 |
| 0.42491 | −0.02841 | 0.08333 |
| 0.42887 | 0.02841 | 0.08333 |
| 0.43312 | −0.02841 | 0.08333 |
| 0.43709 | 0.02841 | 0.08333 |
| 0.44133 | −0.02841 | 0.08333 |
| 0.44530 | 0.02841 | 0.08333 |
| 0.44954 | −0.02841 | 0.08333 |
| 0.45351 | 0.02841 | 0.08333 |
| 0.45775 | −0.02841 | 0.08333 |
| 0.46172 | 0.02841 | 0.08333 |
| 0.46596 | −0.02841 | 0.08333 |
| 0.46993 | 0.02841 | 0.08333 |
| 0.47417 | −0.02841 | 0.08333 |
| 0.47815 | 0.02841 | 0.08333 |
| 0.48238 | −0.02841 | 0.08333 |
| 0.48636 | 0.02841 | 0.08333 |
| 0.49060 | −0.02841 | 0.08333 |

TABLE 1-continued

| X | Y | Z |
|---|---|---|
| 0.49457 | 0.02841 | 0.08333 |
| 0.49881 | −0.02841 | 0.08333 |
| 0.50278 | 0.02841 | 0.08333 |
| 0.50702 | −0.02841 | 0.08333 |
| 0.51099 | 0.02841 | 0.08333 |
| 0.51523 | −0.02841 | 0.08333 |
| 0.51920 | 0.02841 | 0.08333 |
| 0.52345 | −0.02841 | 0.08333 |
| 0.52741 | 0.02841 | 0.08333 |
| 0.53166 | −0.02841 | 0.08333 |
| 0.53562 | 0.02841 | 0.08333 |
| 0.53987 | −0.02829 | 0.08333 |
| 0.54377 | 0.02750 | 0.08333 |
| 0.54767 | −0.02592 | 0.08333 |
| 0.55102 | 0.02377 | 0.08333 |
| 0.55412 | −0.02091 | 0.08333 |
| 0.55654 | 0.01776 | 0.08333 |
| 0.55852 | −0.01403 | 0.08333 |
| 0.55978 | 0.01026 | 0.08333 |
| 0.56044 | −0.00607 | 0.08333 |
| 0.56079 | 0.00211 | 0.08333 |
| 0.18680 | 0.00194 | 0.11111 |
| 0.18680 | 0.00194 | 0.11111 |
| 0.18722 | −0.00674 | 0.11111 |
| 0.18756 | 0.01062 | 0.11111 |
| 0.18798 | −0.01543 | 0.11111 |
| 0.18832 | 0.01929 | 0.11111 |
| 0.18924 | −0.02401 | 0.11111 |
| 0.19072 | 0.02762 | 0.11111 |
| 0.19334 | −0.03162 | 0.11111 |
| 0.19610 | 0.03440 | 0.11111 |
| 0.20006 | −0.03707 | 0.11111 |
| 0.20368 | 0.03857 | 0.11111 |
| 0.20837 | −0.03950 | 0.11111 |
| 0.21228 | 0.03959 | 0.11111 |
| 0.21710 | −0.03959 | 0.11111 |
| 0.22098 | 0.03959 | 0.11111 |
| 0.22581 | −0.03959 | 0.11111 |
| 0.22970 | 0.03959 | 0.11111 |
| 0.23452 | −0.03959 | 0.11111 |
| 0.23840 | 0.03959 | 0.11111 |
| 0.24323 | −0.03959 | 0.11111 |
| 0.24712 | 0.03959 | 0.11111 |
| 0.25193 | −0.03959 | 0.11111 |
| 0.25582 | 0.03959 | 0.11111 |
| 0.26065 | −0.03959 | 0.11111 |
| 0.26454 | 0.03959 | 0.11111 |
| 0.26935 | −0.03959 | 0.11111 |
| 0.27325 | 0.03959 | 0.11111 |
| 0.27807 | −0.03959 | 0.11111 |
| 0.28195 | 0.03959 | 0.11111 |
| 0.28678 | −0.03959 | 0.11111 |
| 0.29067 | 0.03959 | 0.11111 |
| 0.29549 | −0.03959 | 0.11111 |
| 0.29937 | 0.03959 | 0.11111 |
| 0.30420 | −0.03959 | 0.11111 |
| 0.30809 | 0.03959 | 0.11111 |
| 0.31291 | −0.03959 | 0.11111 |
| 0.31679 | 0.03959 | 0.11111 |
| 0.32162 | −0.03959 | 0.11111 |
| 0.32551 | 0.03959 | 0.11111 |
| 0.33033 | −0.03959 | 0.11111 |
| 0.33421 | 0.03959 | 0.11111 |
| 0.33904 | −0.03959 | 0.11111 |
| 0.34293 | 0.03959 | 0.11111 |
| 0.34775 | −0.03959 | 0.11111 |
| 0.35163 | 0.03959 | 0.11111 |
| 0.35646 | −0.03959 | 0.11111 |
| 0.36035 | 0.03959 | 0.11111 |
| 0.36517 | −0.03959 | 0.11111 |
| 0.36906 | 0.03959 | 0.11111 |
| 0.37388 | −0.03959 | 0.11111 |
| 0.37777 | 0.03959 | 0.11111 |
| 0.38259 | −0.03959 | 0.11111 |
| 0.38648 | 0.03959 | 0.11111 |
| 0.39130 | −0.03959 | 0.11111 |
| 0.39519 | 0.03959 | 0.11111 |
| 0.40001 | −0.03959 | 0.11111 |

TABLE 1-continued

| X | Y | Z |
|---|---|---|
| 0.40390 | 0.03959 | 0.11111 |
| 0.40872 | −0.03959 | 0.11111 |
| 0.41261 | 0.03959 | 0.11111 |
| 0.41743 | −0.03959 | 0.11111 |
| 0.42132 | 0.03959 | 0.11111 |
| 0.42614 | −0.03959 | 0.11111 |
| 0.43003 | 0.03959 | 0.11111 |
| 0.43485 | −0.03959 | 0.11111 |
| 0.43874 | 0.03959 | 0.11111 |
| 0.44356 | −0.03959 | 0.11111 |
| 0.44745 | 0.03959 | 0.11111 |
| 0.45227 | −0.03959 | 0.11111 |
| 0.45616 | 0.03959 | 0.11111 |
| 0.46098 | −0.03959 | 0.11111 |
| 0.46487 | 0.03959 | 0.11111 |
| 0.46969 | −0.03959 | 0.11111 |
| 0.47358 | 0.03959 | 0.11111 |
| 0.47840 | −0.03959 | 0.11111 |
| 0.48229 | 0.03959 | 0.11111 |
| 0.48711 | −0.03959 | 0.11111 |
| 0.49100 | 0.03959 | 0.11111 |
| 0.49582 | −0.03959 | 0.11111 |
| 0.49971 | 0.03959 | 0.11111 |
| 0.50453 | −0.03959 | 0.11111 |
| 0.50842 | 0.03959 | 0.11111 |
| 0.51324 | −0.03959 | 0.11111 |
| 0.51713 | 0.03959 | 0.11111 |
| 0.52195 | −0.03959 | 0.11111 |
| 0.52584 | 0.03959 | 0.11111 |
| 0.53066 | −0.03959 | 0.11111 |
| 0.53455 | 0.03959 | 0.11111 |
| 0.53937 | −0.03943 | 0.11111 |
| 0.54319 | 0.03863 | 0.11111 |
| 0.54759 | −0.03676 | 0.11111 |
| 0.55082 | 0.03457 | 0.11111 |
| 0.55420 | −0.03118 | 0.11111 |
| 0.55639 | 0.02795 | 0.11111 |
| 0.55830 | −0.02355 | 0.11111 |
| 0.55919 | 0.01976 | 0.11111 |
| 0.55966 | −0.01495 | 0.11111 |
| 0.56000 | 0.01108 | 0.11111 |
| 0.56042 | −0.00628 | 0.11111 |
| 0.56076 | 0.00241 | 0.11111 |
| 0.18218 | 0.00194 | 0.13889 |
| 0.18218 | 0.00194 | 0.13889 |
| 0.18261 | −0.00690 | 0.13889 |
| 0.18295 | 0.01078 | 0.13889 |
| 0.18338 | −0.01574 | 0.13889 |
| 0.18372 | 0.01961 | 0.13889 |
| 0.18441 | −0.02427 | 0.13889 |
| 0.18565 | 0.02786 | 0.13889 |
| 0.18822 | −0.03223 | 0.13889 |
| 0.19093 | 0.03524 | 0.13889 |
| 0.19511 | −0.03833 | 0.13889 |
| 0.19873 | 0.04000 | 0.13889 |
| 0.20351 | −0.04118 | 0.13889 |
| 0.20718 | 0.04139 | 0.13889 |
| 0.21216 | −0.04139 | 0.13889 |
| 0.21605 | 0.04139 | 0.13889 |
| 0.22104 | −0.04139 | 0.13889 |
| 0.22492 | 0.04139 | 0.13889 |
| 0.22990 | −0.04139 | 0.13889 |
| 0.23379 | 0.04139 | 0.13889 |
| 0.23877 | −0.04139 | 0.13889 |
| 0.24266 | 0.04139 | 0.13889 |
| 0.24764 | −0.04139 | 0.13889 |
| 0.25153 | 0.04139 | 0.13889 |
| 0.25651 | −0.04139 | 0.13889 |
| 0.26039 | 0.04139 | 0.13889 |
| 0.26537 | −0.04139 | 0.13889 |
| 0.26926 | 0.04139 | 0.13889 |
| 0.27425 | −0.04139 | 0.13889 |
| 0.27813 | 0.04139 | 0.13889 |
| 0.28311 | −0.04139 | 0.13889 |
| 0.28700 | 0.04139 | 0.13889 |
| 0.29198 | −0.04139 | 0.13889 |
| 0.29587 | 0.04139 | 0.13889 |
| 0.30085 | −0.04139 | 0.13889 |

TABLE 1-continued

| X | Y | Z |
|---|---|---|
| 0.30474 | 0.04139 | 0.13889 |
| 0.30972 | −0.04139 | 0.13889 |
| 0.31360 | 0.04139 | 0.13889 |
| 0.31858 | −0.04139 | 0.13889 |
| 0.32247 | 0.04139 | 0.13889 |
| 0.32746 | −0.04139 | 0.13889 |
| 0.33134 | 0.04139 | 0.13889 |
| 0.33632 | −0.04139 | 0.13889 |
| 0.34021 | 0.04139 | 0.13889 |
| 0.34519 | −0.04139 | 0.13889 |
| 0.34908 | 0.04139 | 0.13889 |
| 0.35406 | −0.04139 | 0.13889 |
| 0.35795 | 0.04139 | 0.13889 |
| 0.36293 | −0.04139 | 0.13889 |
| 0.36681 | 0.04139 | 0.13889 |
| 0.37179 | −0.04139 | 0.13889 |
| 0.37568 | 0.04139 | 0.13889 |
| 0.38067 | −0.04139 | 0.13889 |
| 0.38455 | 0.04139 | 0.13889 |
| 0.38953 | −0.04139 | 0.13889 |
| 0.39342 | 0.04139 | 0.13889 |
| 0.39840 | −0.04139 | 0.13889 |
| 0.40229 | 0.04139 | 0.13889 |
| 0.40727 | −0.04139 | 0.13889 |
| 0.41116 | 0.04139 | 0.13889 |
| 0.41613 | −0.04139 | 0.13889 |
| 0.42002 | 0.04139 | 0.13889 |
| 0.42500 | −0.04139 | 0.13889 |
| 0.42890 | 0.04139 | 0.13889 |
| 0.43387 | −0.04139 | 0.13889 |
| 0.43776 | 0.04139 | 0.13889 |
| 0.44274 | −0.04139 | 0.13889 |
| 0.44662 | 0.04139 | 0.13889 |
| 0.45161 | −0.04139 | 0.13889 |
| 0.45550 | 0.04139 | 0.13889 |
| 0.46048 | −0.04139 | 0.13889 |
| 0.46436 | 0.04139 | 0.13889 |
| 0.46934 | −0.04139 | 0.13889 |
| 0.47323 | 0.04139 | 0.13889 |
| 0.47821 | −0.04139 | 0.13889 |
| 0.48210 | 0.04139 | 0.13889 |
| 0.48708 | −0.04139 | 0.13889 |
| 0.49097 | 0.04139 | 0.13889 |
| 0.49595 | −0.04139 | 0.13889 |
| 0.49983 | 0.04139 | 0.13889 |
| 0.50482 | −0.04139 | 0.13889 |
| 0.50871 | 0.04139 | 0.13889 |
| 0.51369 | −0.04139 | 0.13889 |
| 0.51757 | 0.04139 | 0.13889 |
| 0.52255 | −0.04139 | 0.13889 |
| 0.52644 | 0.04139 | 0.13889 |
| 0.53142 | −0.04139 | 0.13889 |
| 0.53531 | 0.04139 | 0.13889 |
| 0.54005 | −0.04113 | 0.13889 |
| 0.54375 | 0.04024 | 0.13889 |
| 0.54836 | −0.03811 | 0.13889 |
| 0.55163 | 0.03571 | 0.13889 |
| 0.55510 | −0.03185 | 0.13889 |
| 0.55710 | 0.02841 | 0.13889 |
| 0.55868 | −0.02378 | 0.13889 |
| 0.55921 | 0.02015 | 0.13889 |
| 0.55964 | −0.01519 | 0.13889 |
| 0.55998 | 0.01132 | 0.13889 |
| 0.56041 | −0.00636 | 0.13889 |
| 0.56075 | 0.00248 | 0.13889 |
| 0.17748 | 0.00062 | 0.16667 |
| 0.17810 | −0.00830 | 0.16667 |
| 0.17823 | 0.00955 | 0.16667 |
| 0.17889 | −0.01722 | 0.16667 |
| 0.17901 | 0.01847 | 0.16667 |
| 0.18028 | −0.02602 | 0.16667 |
| 0.18087 | 0.02719 | 0.16667 |
| 0.18473 | −0.03371 | 0.16667 |
| 0.18586 | 0.03454 | 0.16667 |
| 0.19182 | −0.03909 | 0.16667 |
| 0.19328 | 0.03945 | 0.16667 |
| 0.20042 | −0.04137 | 0.16667 |
| 0.20200 | 0.04119 | 0.16667 |

TABLE 1-continued

| X | Y | Z |
|---|---|---|
| 0.20208 | 0.04119 | 0.16667 |
| 0.20939 | −0.04140 | 0.16667 |
| 0.21103 | 0.04124 | 0.16667 |
| 0.21834 | −0.04138 | 0.16667 |
| 0.21998 | 0.04128 | 0.16667 |
| 0.22729 | −0.04136 | 0.16667 |
| 0.22894 | 0.04133 | 0.16667 |
| 0.23624 | −0.04134 | 0.16667 |
| 0.23789 | 0.04137 | 0.16667 |
| 0.24520 | −0.04133 | 0.16667 |
| 0.24684 | 0.04141 | 0.16667 |
| 0.25415 | −0.04131 | 0.16667 |
| 0.25579 | 0.04145 | 0.16667 |
| 0.26310 | −0.04129 | 0.16667 |
| 0.26475 | 0.04149 | 0.16667 |
| 0.27206 | −0.04128 | 0.16667 |
| 0.27370 | 0.04152 | 0.16667 |
| 0.28100 | −0.04127 | 0.16667 |
| 0.28265 | 0.04155 | 0.16667 |
| 0.28996 | −0.04125 | 0.16667 |
| 0.29161 | 0.04158 | 0.16667 |
| 0.29891 | −0.04124 | 0.16667 |
| 0.30055 | 0.04161 | 0.16667 |
| 0.30786 | −0.04123 | 0.16667 |
| 0.30951 | 0.04163 | 0.16667 |
| 0.31682 | −0.04122 | 0.16667 |
| 0.31846 | 0.04164 | 0.16667 |
| 0.32577 | −0.04122 | 0.16667 |
| 0.32741 | 0.04166 | 0.16667 |
| 0.33472 | −0.04122 | 0.16667 |
| 0.33637 | 0.04166 | 0.16667 |
| 0.34367 | −0.04122 | 0.16667 |
| 0.34532 | 0.04166 | 0.16667 |
| 0.35263 | −0.04122 | 0.16667 |
| 0.35427 | 0.04164 | 0.16667 |
| 0.36158 | −0.04122 | 0.16667 |
| 0.36322 | 0.04162 | 0.16667 |
| 0.37053 | −0.04122 | 0.16667 |
| 0.37217 | 0.04159 | 0.16667 |
| 0.37948 | −0.04123 | 0.16667 |
| 0.38113 | 0.04155 | 0.16667 |
| 0.38843 | −0.04124 | 0.16667 |
| 0.39008 | 0.04152 | 0.16667 |
| 0.39739 | −0.04125 | 0.16667 |
| 0.39903 | 0.04148 | 0.16667 |
| 0.40634 | −0.04126 | 0.16667 |
| 0.40798 | 0.04144 | 0.16667 |
| 0.41529 | −0.04128 | 0.16667 |
| 0.41694 | 0.04140 | 0.16667 |
| 0.42424 | −0.04129 | 0.16667 |
| 0.42588 | 0.04135 | 0.16667 |
| 0.43319 | −0.04131 | 0.16667 |
| 0.43484 | 0.04131 | 0.16667 |
| 0.44215 | −0.04133 | 0.16667 |
| 0.44379 | 0.04126 | 0.16667 |
| 0.45110 | −0.04136 | 0.16667 |
| 0.45274 | 0.04121 | 0.16667 |
| 0.46005 | −0.04138 | 0.16667 |
| 0.46170 | 0.04116 | 0.16667 |
| 0.46900 | −0.04141 | 0.16667 |
| 0.47065 | 0.04111 | 0.16667 |
| 0.47796 | −0.04144 | 0.16667 |
| 0.47960 | 0.04106 | 0.16667 |
| 0.48691 | −0.04147 | 0.16667 |
| 0.48855 | 0.04100 | 0.16667 |
| 0.49586 | −0.04150 | 0.16667 |
| 0.49750 | 0.04095 | 0.16667 |
| 0.50482 | −0.04154 | 0.16667 |
| 0.50646 | 0.04089 | 0.16667 |
| 0.51376 | −0.04157 | 0.16667 |
| 0.51541 | 0.04084 | 0.16667 |
| 0.52272 | −0.04161 | 0.16667 |
| 0.52436 | 0.04079 | 0.16667 |
| 0.53167 | −0.04164 | 0.16667 |
| 0.53331 | 0.04073 | 0.16667 |
| 0.54062 | −0.04131 | 0.16667 |
| 0.54219 | 0.03997 | 0.16667 |
| 0.54888 | −0.03804 | 0.16667 |

TABLE 1-continued

| X | Y | Z |
|---|---|---|
| 0.55019 | 0.03608 | 0.16667 |
| 0.55521 | −0.03184 | 0.16667 |
| 0.55606 | 0.02941 | 0.16667 |
| 0.55864 | −0.02366 | 0.16667 |
| 0.55891 | 0.02098 | 0.16667 |
| 0.55957 | −0.01472 | 0.16667 |
| 0.55971 | 0.01209 | 0.16667 |
| 0.56037 | −0.00574 | 0.16667 |
| 0.56049 | 0.00320 | 0.16667 |
| 0.17295 | −0.00348 | 0.19444 |
| 0.17336 | 0.00546 | 0.19444 |
| 0.17373 | −0.01240 | 0.19444 |
| 0.17413 | 0.01439 | 0.19444 |
| 0.17451 | −0.02133 | 0.19444 |
| 0.17569 | 0.02318 | 0.19444 |
| 0.17672 | −0.02993 | 0.19444 |
| 0.18029 | 0.03080 | 0.19444 |
| 0.18224 | −0.03691 | 0.19444 |
| 0.18741 | 0.03615 | 0.19444 |
| 0.19009 | −0.04108 | 0.19444 |
| 0.19566 | 0.03841 | 0.19444 |
| 0.19601 | 0.03843 | 0.19444 |
| 0.19899 | −0.04191 | 0.19444 |
| 0.20460 | 0.03899 | 0.19444 |
| 0.20793 | −0.04165 | 0.19444 |
| 0.21354 | 0.03957 | 0.19444 |
| 0.21690 | −0.04141 | 0.19444 |
| 0.22248 | 0.04015 | 0.19444 |
| 0.22585 | −0.04119 | 0.19444 |
| 0.23142 | 0.04072 | 0.19444 |
| 0.23481 | −0.04096 | 0.19444 |
| 0.24036 | 0.04127 | 0.19444 |
| 0.24378 | −0.04074 | 0.19444 |
| 0.24930 | 0.04179 | 0.19444 |
| 0.25273 | −0.04053 | 0.19444 |
| 0.25825 | 0.04227 | 0.19444 |
| 0.26169 | −0.04032 | 0.19444 |
| 0.26719 | 0.04272 | 0.19444 |
| 0.27065 | −0.04012 | 0.19444 |
| 0.27614 | 0.04315 | 0.19444 |
| 0.27961 | −0.03994 | 0.19444 |
| 0.28510 | 0.04355 | 0.19444 |
| 0.28857 | −0.03978 | 0.19444 |
| 0.29404 | 0.04392 | 0.19444 |
| 0.29753 | −0.03963 | 0.19444 |
| 0.30299 | 0.04426 | 0.19444 |
| 0.30649 | −0.03951 | 0.19444 |
| 0.31195 | 0.04454 | 0.19444 |
| 0.31545 | −0.03942 | 0.19444 |
| 0.32090 | 0.04476 | 0.19444 |
| 0.32442 | −0.03936 | 0.19444 |
| 0.32985 | 0.04489 | 0.19444 |
| 0.33338 | −0.03931 | 0.19444 |
| 0.33880 | 0.04493 | 0.19444 |
| 0.34233 | −0.03929 | 0.19444 |
| 0.34776 | 0.04485 | 0.19444 |
| 0.35130 | −0.03929 | 0.19444 |
| 0.35671 | 0.04465 | 0.19444 |
| 0.36026 | −0.03931 | 0.19444 |
| 0.36567 | 0.04435 | 0.19444 |
| 0.36922 | −0.03936 | 0.19444 |
| 0.37462 | 0.04397 | 0.19444 |
| 0.37818 | −0.03942 | 0.19444 |
| 0.38358 | 0.04355 | 0.19444 |
| 0.38714 | −0.03951 | 0.19444 |
| 0.39253 | 0.04308 | 0.19444 |
| 0.39610 | −0.03963 | 0.19444 |
| 0.40148 | 0.04258 | 0.19444 |
| 0.40506 | −0.03977 | 0.19444 |
| 0.41043 | 0.04207 | 0.19444 |
| 0.41401 | −0.03994 | 0.19444 |
| 0.41937 | 0.04152 | 0.19444 |
| 0.42297 | −0.04014 | 0.19444 |
| 0.42832 | 0.04094 | 0.19444 |
| 0.43193 | −0.04037 | 0.19444 |
| 0.43726 | 0.04033 | 0.19444 |
| 0.44088 | −0.04064 | 0.19444 |
| 0.44620 | 0.03970 | 0.19444 |

TABLE 1-continued

| X | Y | Z |
|---|---|---|
| 0.44983 | −0.04094 | 0.19444 |
| 0.45514 | 0.03906 | 0.19444 |
| 0.45878 | −0.04125 | 0.19444 |
| 0.46408 | 0.03839 | 0.19444 |
| 0.46774 | −0.04159 | 0.19444 |
| 0.47301 | 0.03772 | 0.19444 |
| 0.47669 | −0.04195 | 0.19444 |
| 0.48195 | 0.03704 | 0.19444 |
| 0.48564 | −0.04233 | 0.19444 |
| 0.49089 | 0.03635 | 0.19444 |
| 0.49459 | −0.04272 | 0.19444 |
| 0.49983 | 0.03565 | 0.19444 |
| 0.50354 | −0.04314 | 0.19444 |
| 0.50876 | 0.03494 | 0.19444 |
| 0.51249 | −0.04358 | 0.19444 |
| 0.51770 | 0.03421 | 0.19444 |
| 0.52144 | −0.04403 | 0.19444 |
| 0.52663 | 0.03347 | 0.19444 |
| 0.53039 | −0.04450 | 0.19444 |
| 0.53556 | 0.03273 | 0.19444 |
| 0.53936 | −0.04456 | 0.19444 |
| 0.54413 | 0.03048 | 0.19444 |
| 0.54770 | −0.04148 | 0.19444 |
| 0.55128 | 0.02529 | 0.19444 |
| 0.55398 | −0.03520 | 0.19444 |
| 0.55596 | 0.01780 | 0.19444 |
| 0.55697 | −0.02683 | 0.19444 |
| 0.55754 | 0.00905 | 0.19444 |
| 0.55794 | −0.01783 | 0.19444 |
| 0.55834 | 0.00011 | 0.19444 |
| 0.55886 | −0.00884 | 0.19444 |
| 0.16841 | −0.00132 | 0.22222 |
| 0.16865 | −0.01020 | 0.22222 |
| 0.16918 | 0.00755 | 0.22222 |
| 0.16941 | −0.01908 | 0.22222 |
| 0.17027 | −0.02794 | 0.22222 |
| 0.17070 | 0.01631 | 0.22222 |
| 0.17374 | −0.03602 | 0.22222 |
| 0.17517 | 0.02394 | 0.22222 |
| 0.18042 | −0.04179 | 0.22222 |
| 0.18212 | 0.02940 | 0.22222 |
| 0.18896 | −0.04411 | 0.22222 |
| 0.19063 | 0.03181 | 0.22222 |
| 0.19785 | −0.04353 | 0.22222 |
| 0.19948 | 0.03291 | 0.22222 |
| 0.19948 | 0.03291 | 0.22222 |
| 0.20672 | −0.04277 | 0.22222 |
| 0.20822 | 0.03459 | 0.22222 |
| 0.21560 | −0.04203 | 0.22222 |
| 0.21696 | 0.03626 | 0.22222 |
| 0.22447 | −0.04131 | 0.22222 |
| 0.22576 | 0.03753 | 0.22222 |
| 0.23321 | −0.03969 | 0.22222 |
| 0.23465 | 0.03790 | 0.22222 |
| 0.24186 | −0.03750 | 0.22222 |
| 0.24357 | 0.03812 | 0.22222 |
| 0.25059 | −0.03583 | 0.22222 |
| 0.25242 | 0.03898 | 0.22222 |
| 0.25947 | −0.03520 | 0.22222 |
| 0.26120 | 0.04045 | 0.22222 |
| 0.26835 | −0.03465 | 0.22222 |
| 0.27000 | 0.04182 | 0.22222 |
| 0.27724 | −0.03413 | 0.22222 |
| 0.27881 | 0.04309 | 0.22222 |
| 0.28614 | −0.03366 | 0.22222 |
| 0.28765 | 0.04424 | 0.22222 |
| 0.29503 | −0.03322 | 0.22222 |
| 0.29649 | 0.04526 | 0.22222 |
| 0.30392 | −0.03289 | 0.22222 |
| 0.30538 | 0.04620 | 0.22222 |
| 0.31281 | −0.03284 | 0.22222 |
| 0.31428 | 0.04714 | 0.22222 |
| 0.32170 | −0.03304 | 0.22222 |
| 0.32318 | 0.04801 | 0.22222 |
| 0.33059 | −0.03340 | 0.22222 |
| 0.33208 | 0.04877 | 0.22222 |
| 0.33948 | −0.03389 | 0.22222 |
| 0.34097 | 0.04937 | 0.22222 |

TABLE 1-continued

| X | Y | Z |
|---|---|---|
| 0.34837 | −0.03444 | 0.22222 |
| 0.34986 | 0.04976 | 0.22222 |
| 0.35726 | −0.03499 | 0.22222 |
| 0.35873 | 0.04987 | 0.22222 |
| 0.36617 | −0.03547 | 0.22222 |
| 0.36759 | 0.04967 | 0.22222 |
| 0.37508 | −0.03583 | 0.22222 |
| 0.37643 | 0.04911 | 0.22222 |
| 0.38398 | −0.03607 | 0.22222 |
| 0.38525 | 0.04812 | 0.22222 |
| 0.39287 | −0.03634 | 0.22222 |
| 0.39405 | 0.04684 | 0.22222 |
| 0.40177 | −0.03668 | 0.22222 |
| 0.40284 | 0.04544 | 0.22222 |
| 0.41065 | −0.03711 | 0.22222 |
| 0.41162 | 0.04397 | 0.22222 |
| 0.41954 | −0.03761 | 0.22222 |
| 0.42039 | 0.04241 | 0.22222 |
| 0.42843 | −0.03821 | 0.22222 |
| 0.42914 | 0.04077 | 0.22222 |
| 0.43730 | −0.03890 | 0.22222 |
| 0.43788 | 0.03905 | 0.22222 |
| 0.44617 | −0.03969 | 0.22222 |
| 0.44660 | 0.03724 | 0.22222 |
| 0.45504 | −0.04055 | 0.22222 |
| 0.45530 | 0.03536 | 0.22222 |
| 0.46389 | −0.04147 | 0.22222 |
| 0.46399 | 0.03343 | 0.22222 |
| 0.47268 | 0.03146 | 0.22222 |
| 0.47274 | −0.04246 | 0.22222 |
| 0.48136 | 0.02948 | 0.22222 |
| 0.48159 | −0.04353 | 0.22222 |
| 0.49003 | 0.02746 | 0.22222 |
| 0.49042 | −0.04464 | 0.22222 |
| 0.49869 | 0.02540 | 0.22222 |
| 0.49925 | −0.04581 | 0.22222 |
| 0.50734 | 0.02330 | 0.22222 |
| 0.50807 | −0.04703 | 0.22222 |
| 0.51598 | 0.02114 | 0.22222 |
| 0.51688 | −0.04831 | 0.22222 |
| 0.52461 | 0.01893 | 0.22222 |
| 0.52569 | −0.04964 | 0.22222 |
| 0.53322 | 0.01668 | 0.22222 |
| 0.53453 | −0.05088 | 0.22222 |
| 0.54148 | 0.01350 | 0.22222 |
| 0.54322 | −0.04920 | 0.22222 |
| 0.54830 | 0.00789 | 0.22222 |
| 0.54997 | −0.04353 | 0.22222 |
| 0.55250 | 0.00014 | 0.22222 |
| 0.55289 | −0.03519 | 0.22222 |
| 0.55371 | −0.00860 | 0.22222 |
| 0.55411 | −0.02627 | 0.22222 |
| 0.55450 | −0.01739 | 0.22222 |
| 0.16387 | −0.01500 | 0.25000 |
| 0.16391 | −0.00614 | 0.25000 |
| 0.16461 | −0.02385 | 0.25000 |
| 0.16467 | 0.00272 | 0.25000 |
| 0.16537 | −0.03271 | 0.25000 |
| 0.16750 | 0.01108 | 0.25000 |
| 0.16858 | −0.04088 | 0.25000 |
| 0.17328 | 0.01776 | 0.25000 |
| 0.17533 | −0.04651 | 0.25000 |
| 0.18118 | 0.02169 | 0.25000 |
| 0.18395 | −0.04825 | 0.25000 |
| 0.19002 | 0.02242 | 0.25000 |
| 0.19279 | −0.04731 | 0.25000 |
| 0.19878 | 0.02368 | 0.25000 |
| 0.20160 | −0.04616 | 0.25000 |
| 0.20720 | 0.02652 | 0.25000 |
| 0.21038 | −0.04480 | 0.25000 |
| 0.21038 | −0.04480 | 0.25000 |
| 0.21550 | 0.02966 | 0.25000 |
| 0.21914 | −0.04334 | 0.25000 |
| 0.22386 | 0.03265 | 0.25000 |
| 0.22792 | −0.04197 | 0.25000 |
| 0.23260 | 0.03414 | 0.25000 |
| 0.23621 | −0.03882 | 0.25000 |
| 0.24138 | 0.03553 | 0.25000 |

TABLE 1-continued

| X | Y | Z |
|---|---|---|
| 0.24456 | −0.03592 | 0.25000 |
| 0.24984 | 0.03825 | 0.25000 |
| 0.25336 | −0.03474 | 0.25000 |
| 0.25830 | 0.04095 | 0.25000 |
| 0.26218 | −0.03360 | 0.25000 |
| 0.26682 | 0.04347 | 0.25000 |
| 0.27099 | −0.03249 | 0.25000 |
| 0.27539 | 0.04582 | 0.25000 |
| 0.27981 | −0.03145 | 0.25000 |
| 0.28399 | 0.04804 | 0.25000 |
| 0.28863 | −0.03048 | 0.25000 |
| 0.29263 | 0.05012 | 0.25000 |
| 0.29748 | −0.02963 | 0.25000 |
| 0.30131 | 0.05197 | 0.25000 |
| 0.30633 | −0.02887 | 0.25000 |
| 0.31006 | 0.05351 | 0.25000 |
| 0.31519 | −0.02825 | 0.25000 |
| 0.31886 | 0.05473 | 0.25000 |
| 0.32407 | −0.02776 | 0.25000 |
| 0.32773 | 0.05562 | 0.25000 |
| 0.33293 | −0.02751 | 0.25000 |
| 0.33664 | 0.05621 | 0.25000 |
| 0.34179 | −0.02752 | 0.25000 |
| 0.34555 | 0.05652 | 0.25000 |
| 0.35065 | −0.02777 | 0.25000 |
| 0.35444 | 0.05653 | 0.25000 |
| 0.35951 | −0.02820 | 0.25000 |
| 0.36332 | 0.05621 | 0.25000 |
| 0.36836 | −0.02882 | 0.25000 |
| 0.37217 | 0.05558 | 0.25000 |
| 0.37721 | −0.02957 | 0.25000 |
| 0.38098 | 0.05460 | 0.25000 |
| 0.38607 | −0.03043 | 0.25000 |
| 0.38974 | 0.05329 | 0.25000 |
| 0.39492 | −0.03137 | 0.25000 |
| 0.39843 | 0.05161 | 0.25000 |
| 0.40377 | −0.03236 | 0.25000 |
| 0.40706 | 0.04957 | 0.25000 |
| 0.41262 | −0.03337 | 0.25000 |
| 0.41559 | 0.04715 | 0.25000 |
| 0.42146 | −0.03437 | 0.25000 |
| 0.42403 | 0.04435 | 0.25000 |
| 0.43027 | −0.03548 | 0.25000 |
| 0.43237 | 0.04132 | 0.25000 |
| 0.43907 | −0.03678 | 0.25000 |
| 0.44066 | 0.03812 | 0.25000 |
| 0.44784 | −0.03826 | 0.25000 |
| 0.44889 | 0.03476 | 0.25000 |
| 0.45657 | −0.03988 | 0.25000 |
| 0.45705 | 0.03125 | 0.25000 |
| 0.46517 | 0.02763 | 0.25000 |
| 0.46527 | −0.04165 | 0.25000 |
| 0.47325 | 0.02394 | 0.25000 |
| 0.47395 | −0.04353 | 0.25000 |
| 0.48130 | 0.02018 | 0.25000 |
| 0.48259 | −0.04553 | 0.25000 |
| 0.48932 | 0.01637 | 0.25000 |
| 0.49121 | −0.04766 | 0.25000 |
| 0.49731 | 0.01249 | 0.25000 |
| 0.49979 | −0.04994 | 0.25000 |
| 0.50525 | 0.00852 | 0.25000 |
| 0.50835 | −0.05232 | 0.25000 |
| 0.51314 | 0.00444 | 0.25000 |
| 0.51688 | −0.05482 | 0.25000 |
| 0.52097 | 0.00024 | 0.25000 |
| 0.52539 | −0.05740 | 0.25000 |
| 0.52876 | −0.00405 | 0.25000 |
| 0.53409 | −0.05922 | 0.25000 |
| 0.53641 | −0.00851 | 0.25000 |
| 0.54234 | −0.05622 | 0.25000 |
| 0.54300 | −0.01437 | 0.25000 |
| 0.54661 | −0.04861 | 0.25000 |
| 0.54685 | −0.02226 | 0.25000 |
| 0.54787 | −0.03105 | 0.25000 |
| 0.54812 | −0.03985 | 0.25000 |
| 0.15910 | −0.01874 | 0.27778 |
| 0.15943 | −0.02772 | 0.27778 |
| 0.15983 | −0.00976 | 0.27778 |

TABLE 1-continued

| X | Y | Z |
|---|---|---|
| 0.16016 | −0.03671 | 0.27778 |
| 0.16104 | −0.00086 | 0.27778 |
| 0.16246 | −0.04532 | 0.27778 |
| 0.16549 | 0.00690 | 0.27778 |
| 0.16892 | −0.05141 | 0.27778 |
| 0.17278 | 0.01207 | 0.27778 |
| 0.17765 | −0.05317 | 0.27778 |
| 0.17765 | −0.05317 | 0.27778 |
| 0.18157 | 0.01363 | 0.27778 |
| 0.18664 | −0.05244 | 0.27778 |
| 0.19053 | 0.01269 | 0.27778 |
| 0.19559 | −0.05143 | 0.27778 |
| 0.19951 | 0.01339 | 0.27778 |
| 0.20449 | −0.05006 | 0.27778 |
| 0.20793 | 0.01640 | 0.27778 |
| 0.21331 | −0.04827 | 0.27778 |
| 0.21566 | 0.02103 | 0.27778 |
| 0.22204 | −0.04607 | 0.27778 |
| 0.22335 | 0.02574 | 0.27778 |
| 0.23076 | −0.04380 | 0.27778 |
| 0.23145 | 0.02955 | 0.27778 |
| 0.23886 | −0.03996 | 0.27778 |
| 0.24007 | 0.03224 | 0.27778 |
| 0.24697 | −0.03626 | 0.27778 |
| 0.24823 | 0.03605 | 0.27778 |
| 0.25580 | −0.03441 | 0.27778 |
| 0.25619 | 0.04030 | 0.27778 |
| 0.26429 | 0.04426 | 0.27778 |
| 0.26464 | −0.03260 | 0.27778 |
| 0.27252 | 0.04795 | 0.27778 |
| 0.27349 | −0.03085 | 0.27778 |
| 0.28088 | 0.05140 | 0.27778 |
| 0.28236 | −0.02917 | 0.27778 |
| 0.28930 | 0.05467 | 0.27778 |
| 0.29124 | −0.02760 | 0.27778 |
| 0.29779 | 0.05774 | 0.27778 |
| 0.30015 | −0.02619 | 0.27778 |
| 0.30637 | 0.06054 | 0.27778 |
| 0.30909 | −0.02495 | 0.27778 |
| 0.31505 | 0.06302 | 0.27778 |
| 0.31807 | −0.02391 | 0.27778 |
| 0.32385 | 0.06509 | 0.27778 |
| 0.32707 | −0.02308 | 0.27778 |
| 0.33275 | 0.06668 | 0.27778 |
| 0.33607 | −0.02246 | 0.27778 |
| 0.34166 | 0.06766 | 0.27778 |
| 0.34507 | −0.02203 | 0.27778 |
| 0.35057 | 0.06794 | 0.27778 |
| 0.35406 | −0.02180 | 0.27778 |
| 0.35949 | 0.06748 | 0.27778 |
| 0.36304 | −0.02176 | 0.27778 |
| 0.36842 | 0.06630 | 0.27778 |
| 0.37200 | −0.02190 | 0.27778 |
| 0.37729 | 0.06446 | 0.27778 |
| 0.38097 | −0.02224 | 0.27778 |
| 0.38595 | 0.06207 | 0.27778 |
| 0.38993 | −0.02278 | 0.27778 |
| 0.39447 | 0.05921 | 0.27778 |
| 0.39884 | −0.02376 | 0.27778 |
| 0.40305 | 0.05633 | 0.27778 |
| 0.40764 | −0.02549 | 0.27778 |
| 0.41163 | 0.05344 | 0.27778 |
| 0.41635 | −0.02773 | 0.27778 |
| 0.42011 | 0.05038 | 0.27778 |
| 0.42504 | −0.03019 | 0.27778 |
| 0.42841 | 0.04696 | 0.27778 |
| 0.43376 | −0.03260 | 0.27778 |
| 0.43644 | 0.04301 | 0.27778 |
| 0.44253 | −0.03474 | 0.27778 |
| 0.44416 | 0.03842 | 0.27778 |
| 0.45118 | −0.03705 | 0.27778 |
| 0.45173 | 0.03351 | 0.27778 |
| 0.45916 | 0.02838 | 0.27778 |
| 0.45976 | −0.03961 | 0.27778 |
| 0.46647 | 0.02310 | 0.27778 |
| 0.46828 | −0.04240 | 0.27778 |
| 0.47367 | 0.01770 | 0.27778 |
| 0.47675 | −0.04539 | 0.27778 |

TABLE 1-continued

| X | Y | Z |
|---|---|---|
| 0.48081 | 0.01222 | 0.27778 |
| 0.48518 | −0.04860 | 0.27778 |
| 0.48788 | 0.00666 | 0.27778 |
| 0.49354 | −0.05204 | 0.27778 |
| 0.49489 | 0.00102 | 0.27778 |
| 0.50181 | −0.00473 | 0.27778 |
| 0.50181 | −0.05570 | 0.27778 |
| 0.50862 | −0.01062 | 0.27778 |
| 0.51001 | −0.05953 | 0.27778 |
| 0.51531 | −0.01665 | 0.27778 |
| 0.51813 | −0.06352 | 0.27778 |
| 0.52189 | −0.02281 | 0.27778 |
| 0.52619 | −0.06760 | 0.27778 |
| 0.52837 | −0.02910 | 0.27778 |
| 0.53491 | −0.06766 | 0.27778 |
| 0.53493 | −0.03536 | 0.27778 |
| 0.53977 | −0.04297 | 0.27778 |
| 0.53994 | −0.06071 | 0.27778 |
| 0.54100 | −0.05192 | 0.27778 |
| 0.15457 | −0.02969 | 0.30556 |
| 0.15475 | −0.03896 | 0.30556 |
| 0.15531 | −0.02042 | 0.30556 |
| 0.15605 | −0.01116 | 0.30556 |
| 0.15617 | −0.04810 | 0.30556 |
| 0.15785 | −0.00209 | 0.30556 |
| 0.16199 | −0.05513 | 0.30556 |
| 0.16351 | 0.00517 | 0.30556 |
| 0.17085 | −0.05751 | 0.30556 |
| 0.17187 | 0.00898 | 0.30556 |
| 0.18017 | −0.05725 | 0.30556 |
| 0.18107 | 0.00849 | 0.30556 |
| 0.18947 | −0.05672 | 0.30556 |
| 0.19009 | 0.00626 | 0.30556 |
| 0.19870 | −0.05580 | 0.30556 |
| 0.19930 | 0.00549 | 0.30556 |
| 0.20784 | −0.05438 | 0.30556 |
| 0.20842 | 0.00717 | 0.30556 |
| 0.21633 | 0.01196 | 0.30556 |
| 0.21688 | −0.05234 | 0.30556 |
| 0.22338 | 0.01802 | 0.30556 |
| 0.22578 | −0.04958 | 0.30556 |
| 0.22578 | −0.04958 | 0.30556 |
| 0.23046 | 0.02404 | 0.30556 |
| 0.23452 | −0.04638 | 0.30556 |
| 0.23860 | 0.02842 | 0.30556 |
| 0.24231 | −0.04144 | 0.30556 |
| 0.24684 | 0.03273 | 0.30556 |
| 0.25035 | −0.03712 | 0.30556 |
| 0.25429 | 0.03836 | 0.30556 |
| 0.25926 | −0.03452 | 0.30556 |
| 0.26191 | 0.04370 | 0.30556 |
| 0.26820 | −0.03200 | 0.30556 |
| 0.26973 | 0.04873 | 0.30556 |
| 0.27714 | −0.02954 | 0.30556 |
| 0.27775 | 0.05342 | 0.30556 |
| 0.28595 | 0.05783 | 0.30556 |
| 0.28611 | −0.02717 | 0.30556 |
| 0.29428 | 0.06202 | 0.30556 |
| 0.29511 | −0.02498 | 0.30556 |
| 0.30275 | 0.06597 | 0.30556 |
| 0.30415 | −0.02299 | 0.30556 |
| 0.31134 | 0.06960 | 0.30556 |
| 0.31325 | −0.02126 | 0.30556 |
| 0.32006 | 0.07284 | 0.30556 |
| 0.32241 | −0.01978 | 0.30556 |
| 0.32893 | 0.07558 | 0.30556 |
| 0.33163 | −0.01860 | 0.30556 |
| 0.33800 | 0.07773 | 0.30556 |
| 0.34093 | −0.01773 | 0.30556 |
| 0.34725 | 0.07911 | 0.30556 |
| 0.35026 | −0.01716 | 0.30556 |
| 0.35656 | 0.07952 | 0.30556 |
| 0.35960 | −0.01687 | 0.30556 |
| 0.36577 | 0.07883 | 0.30556 |
| 0.36891 | −0.01687 | 0.30556 |
| 0.37493 | 0.07711 | 0.30556 |
| 0.37820 | −0.01714 | 0.30556 |
| 0.38391 | 0.07448 | 0.30556 |

TABLE 1-continued

| X | Y | Z |
|---|---|---|
| 0.38745 | −0.01768 | 0.30556 |
| 0.39254 | 0.07116 | 0.30556 |
| 0.39669 | −0.01850 | 0.30556 |
| 0.40089 | 0.06727 | 0.30556 |
| 0.40591 | −0.01964 | 0.30556 |
| 0.40901 | 0.06295 | 0.30556 |
| 0.41509 | −0.02111 | 0.30556 |
| 0.41692 | 0.05823 | 0.30556 |
| 0.42424 | −0.02294 | 0.30556 |
| 0.42465 | 0.05316 | 0.30556 |
| 0.43281 | 0.04865 | 0.30556 |
| 0.43282 | −0.02626 | 0.30556 |
| 0.44091 | −0.03090 | 0.30556 |
| 0.44124 | 0.04473 | 0.30556 |
| 0.44875 | 0.03938 | 0.30556 |
| 0.44960 | −0.03429 | 0.30556 |
| 0.45565 | 0.03317 | 0.30556 |
| 0.45827 | −0.03769 | 0.30556 |
| 0.46234 | 0.02677 | 0.30556 |
| 0.46675 | −0.04142 | 0.30556 |
| 0.46885 | 0.02017 | 0.30556 |
| 0.47508 | −0.04545 | 0.30556 |
| 0.47520 | 0.01343 | 0.30556 |
| 0.48144 | 0.00659 | 0.30556 |
| 0.48326 | −0.04979 | 0.30556 |
| 0.48761 | −0.00033 | 0.30556 |
| 0.49126 | −0.05443 | 0.30556 |
| 0.49368 | −0.00735 | 0.30556 |
| 0.49913 | −0.05936 | 0.30556 |
| 0.49965 | −0.01448 | 0.30556 |
| 0.50549 | −0.02173 | 0.30556 |
| 0.50686 | −0.06454 | 0.30556 |
| 0.51117 | −0.02912 | 0.30556 |
| 0.51448 | −0.06992 | 0.30556 |
| 0.51669 | −0.03665 | 0.30556 |
| 0.52199 | −0.07553 | 0.30556 |
| 0.52204 | −0.04429 | 0.30556 |
| 0.52727 | −0.05202 | 0.30556 |
| 0.53078 | −0.07658 | 0.30556 |
| 0.53272 | −0.05950 | 0.30556 |
| 0.53460 | −0.06848 | 0.30556 |
| 0.21667 | −0.02841 | 0.33333 |
| 0.21754 | −0.02028 | 0.33333 |
| 0.21837 | −0.01215 | 0.33333 |
| 0.21915 | −0.00401 | 0.33333 |
| 0.22000 | −0.03552 | 0.33333 |
| 0.22014 | 0.00411 | 0.33333 |
| 0.22338 | 0.01154 | 0.33333 |
| 0.22448 | −0.04237 | 0.33333 |
| 0.22879 | 0.01768 | 0.33333 |
| 0.22932 | −0.04888 | 0.33333 |
| 0.23437 | 0.02366 | 0.33333 |
| 0.23715 | −0.04949 | 0.33333 |
| 0.23715 | −0.04949 | 0.33333 |
| 0.24109 | 0.02818 | 0.33333 |
| 0.24379 | −0.04489 | 0.33333 |
| 0.24817 | 0.03231 | 0.33333 |
| 0.24988 | −0.03960 | 0.33333 |
| 0.25419 | 0.03784 | 0.33333 |
| 0.25752 | −0.03660 | 0.33333 |
| 0.26031 | 0.04323 | 0.33333 |
| 0.26522 | −0.03379 | 0.33333 |
| 0.26662 | 0.04839 | 0.33333 |
| 0.27297 | −0.03108 | 0.33333 |
| 0.27313 | 0.05330 | 0.33333 |
| 0.27984 | 0.05797 | 0.33333 |
| 0.28073 | −0.02841 | 0.33333 |
| 0.28670 | 0.06241 | 0.33333 |
| 0.28853 | −0.02583 | 0.33333 |
| 0.29368 | 0.06665 | 0.33333 |
| 0.29636 | −0.02341 | 0.33333 |
| 0.30076 | 0.07068 | 0.33333 |
| 0.30424 | −0.02118 | 0.33333 |
| 0.30794 | 0.07448 | 0.33333 |
| 0.31215 | −0.01918 | 0.33333 |
| 0.31527 | 0.07799 | 0.33333 |
| 0.32010 | −0.01744 | 0.33333 |
| 0.32274 | 0.08120 | 0.33333 |

TABLE 1-continued

| X | Y | Z |
|---|---|---|
| 0.32811 | −0.01597 | 0.33333 |
| 0.33039 | 0.08403 | 0.33333 |
| 0.33616 | −0.01478 | 0.33333 |
| 0.33826 | 0.08639 | 0.33333 |
| 0.34425 | −0.01385 | 0.33333 |
| 0.34629 | 0.08813 | 0.33333 |
| 0.35240 | −0.01321 | 0.33333 |
| 0.35439 | 0.08909 | 0.33333 |
| 0.36059 | −0.01283 | 0.33333 |
| 0.36258 | 0.08914 | 0.33333 |
| 0.36878 | −0.01272 | 0.33333 |
| 0.37078 | 0.08821 | 0.33333 |
| 0.37697 | −0.01288 | 0.33333 |
| 0.37876 | 0.08637 | 0.33333 |
| 0.38514 | −0.01328 | 0.33333 |
| 0.38652 | 0.08375 | 0.33333 |
| 0.39326 | −0.01396 | 0.33333 |
| 0.39408 | 0.08052 | 0.33333 |
| 0.40134 | −0.01491 | 0.33333 |
| 0.40141 | 0.07682 | 0.33333 |
| 0.40849 | 0.07275 | 0.33333 |
| 0.40938 | −0.01614 | 0.33333 |
| 0.41536 | 0.06836 | 0.33333 |
| 0.41738 | −0.01770 | 0.33333 |
| 0.42203 | 0.06365 | 0.33333 |
| 0.42534 | −0.01958 | 0.33333 |
| 0.42850 | 0.05864 | 0.33333 |
| 0.43322 | −0.02185 | 0.33333 |
| 0.43495 | 0.05358 | 0.33333 |
| 0.44002 | −0.02623 | 0.33333 |
| 0.44237 | 0.05005 | 0.33333 |
| 0.44681 | −0.03083 | 0.33333 |
| 0.44886 | 0.04529 | 0.33333 |
| 0.45429 | −0.03413 | 0.33333 |
| 0.45447 | 0.03934 | 0.33333 |
| 0.45990 | 0.03322 | 0.33333 |
| 0.46161 | −0.03778 | 0.33333 |
| 0.46514 | 0.02696 | 0.33333 |
| 0.46875 | −0.04175 | 0.33333 |
| 0.47023 | 0.02056 | 0.33333 |
| 0.47518 | 0.01405 | 0.33333 |
| 0.47571 | −0.04603 | 0.33333 |
| 0.48002 | 0.00746 | 0.33333 |
| 0.48250 | −0.05060 | 0.33333 |
| 0.48477 | 0.00080 | 0.33333 |
| 0.48909 | −0.05544 | 0.33333 |
| 0.48944 | −0.00592 | 0.33333 |
| 0.49403 | −0.01269 | 0.33333 |
| 0.49550 | −0.06051 | 0.33333 |
| 0.49853 | −0.01952 | 0.33333 |
| 0.50175 | −0.06579 | 0.33333 |
| 0.50290 | −0.02641 | 0.33333 |
| 0.50717 | −0.03338 | 0.33333 |
| 0.50786 | −0.07122 | 0.33333 |
| 0.51130 | −0.04042 | 0.33333 |
| 0.51384 | −0.07679 | 0.33333 |
| 0.51531 | −0.04754 | 0.33333 |
| 0.51918 | −0.05475 | 0.33333 |
| 0.51967 | −0.08252 | 0.33333 |
| 0.52294 | −0.06201 | 0.33333 |
| 0.52663 | −0.06932 | 0.33333 |
| 0.52713 | −0.08392 | 0.33333 |
| 0.53002 | −0.07675 | 0.33333 |
| 0.22368 | −0.02716 | 0.36111 |
| 0.22411 | −0.01890 | 0.36111 |
| 0.22456 | −0.01063 | 0.36111 |
| 0.22500 | −0.00237 | 0.36111 |
| 0.22544 | 0.00588 | 0.36111 |
| 0.22578 | −0.03482 | 0.36111 |
| 0.22722 | 0.01389 | 0.36111 |
| 0.22988 | −0.04201 | 0.36111 |
| 0.23214 | 0.02052 | 0.36111 |
| 0.23398 | −0.04919 | 0.36111 |
| 0.23398 | −0.04919 | 0.36111 |
| 0.23742 | 0.02689 | 0.36111 |
| 0.24118 | −0.05049 | 0.36111 |
| 0.24333 | 0.03264 | 0.36111 |
| 0.24776 | −0.04550 | 0.36111 |

TABLE 1-continued

| X | Y | Z |
|---|---|---|
| 0.24964 | 0.03800 | 0.36111 |
| 0.25485 | −0.04134 | 0.36111 |
| 0.25552 | 0.04386 | 0.36111 |
| 0.26153 | 0.04952 | 0.36111 |
| 0.26242 | −0.03796 | 0.36111 |
| 0.26774 | 0.05493 | 0.36111 |
| 0.27005 | −0.03480 | 0.36111 |
| 0.27413 | 0.06010 | 0.36111 |
| 0.27775 | −0.03176 | 0.36111 |
| 0.28070 | 0.06503 | 0.36111 |
| 0.28547 | −0.02881 | 0.36111 |
| 0.28745 | 0.06974 | 0.36111 |
| 0.29323 | −0.02598 | 0.36111 |
| 0.29436 | 0.07424 | 0.36111 |
| 0.30107 | −0.02334 | 0.36111 |
| 0.30143 | 0.07853 | 0.36111 |
| 0.30867 | 0.08259 | 0.36111 |
| 0.30899 | −0.02093 | 0.36111 |
| 0.31606 | 0.08634 | 0.36111 |
| 0.31700 | −0.01878 | 0.36111 |
| 0.32358 | 0.08976 | 0.36111 |
| 0.32511 | −0.01694 | 0.36111 |
| 0.33126 | 0.09276 | 0.36111 |
| 0.33325 | −0.01542 | 0.36111 |
| 0.33915 | 0.09526 | 0.36111 |
| 0.34142 | −0.01421 | 0.36111 |
| 0.34727 | 0.09713 | 0.36111 |
| 0.34960 | −0.01331 | 0.36111 |
| 0.35547 | 0.09819 | 0.36111 |
| 0.35782 | −0.01271 | 0.36111 |
| 0.36369 | 0.09828 | 0.36111 |
| 0.36606 | −0.01241 | 0.36111 |
| 0.37193 | 0.09734 | 0.36111 |
| 0.37434 | −0.01241 | 0.36111 |
| 0.38004 | 0.09546 | 0.36111 |
| 0.38262 | −0.01272 | 0.36111 |
| 0.38788 | 0.09277 | 0.36111 |
| 0.39090 | −0.01333 | 0.36111 |
| 0.39549 | 0.08947 | 0.36111 |
| 0.39913 | −0.01425 | 0.36111 |
| 0.40289 | 0.08568 | 0.36111 |
| 0.40729 | −0.01549 | 0.36111 |
| 0.41006 | 0.08150 | 0.36111 |
| 0.41539 | −0.01708 | 0.36111 |
| 0.41699 | 0.07698 | 0.36111 |
| 0.42342 | −0.01903 | 0.36111 |
| 0.42367 | 0.07214 | 0.36111 |
| 0.43011 | 0.06694 | 0.36111 |
| 0.43137 | −0.02136 | 0.36111 |
| 0.43638 | 0.06151 | 0.36111 |
| 0.43903 | −0.02441 | 0.36111 |
| 0.44314 | 0.05671 | 0.36111 |
| 0.44620 | −0.02856 | 0.36111 |
| 0.44915 | 0.05111 | 0.36111 |
| 0.45362 | −0.03227 | 0.36111 |
| 0.45457 | 0.04486 | 0.36111 |
| 0.45978 | 0.03842 | 0.36111 |
| 0.46091 | −0.03617 | 0.36111 |
| 0.46479 | 0.03184 | 0.36111 |
| 0.46798 | −0.04046 | 0.36111 |
| 0.46963 | 0.02513 | 0.36111 |
| 0.47432 | 0.01832 | 0.36111 |
| 0.47482 | −0.04510 | 0.36111 |
| 0.47888 | 0.01142 | 0.36111 |
| 0.48141 | −0.05010 | 0.36111 |
| 0.48335 | 0.00445 | 0.36111 |
| 0.48771 | −0.00258 | 0.36111 |
| 0.48775 | −0.05542 | 0.36111 |
| 0.49199 | −0.00966 | 0.36111 |
| 0.49385 | −0.06098 | 0.36111 |
| 0.49618 | −0.01678 | 0.36111 |
| 0.49977 | −0.06673 | 0.36111 |
| 0.50026 | −0.02397 | 0.36111 |
| 0.50424 | −0.03121 | 0.36111 |
| 0.50555 | −0.07264 | 0.36111 |
| 0.50810 | −0.03851 | 0.36111 |
| 0.51121 | −0.07868 | 0.36111 |
| 0.51183 | −0.04589 | 0.36111 |

TABLE 1-continued

| X | Y | Z |
|---|---|---|
| 0.51544 | −0.05332 | 0.36111 |
| 0.51672 | −0.08488 | 0.36111 |
| 0.51893 | −0.06083 | 0.36111 |
| 0.52230 | −0.06840 | 0.36111 |
| 0.52329 | −0.08930 | 0.36111 |
| 0.52561 | −0.07601 | 0.36111 |
| 0.52836 | −0.08377 | 0.36111 |
| 0.19842 | −0.04400 | 0.38889 |
| 0.19945 | −0.03516 | 0.38889 |
| 0.20061 | −0.05250 | 0.38889 |
| 0.20186 | −0.02659 | 0.38889 |
| 0.20516 | −0.01827 | 0.38889 |
| 0.20667 | −0.05890 | 0.38889 |
| 0.20911 | −0.01027 | 0.38889 |
| 0.21358 | −0.00252 | 0.38889 |
| 0.21504 | −0.06156 | 0.38889 |
| 0.21504 | −0.06156 | 0.38889 |
| 0.21841 | 0.00499 | 0.38889 |
| 0.22350 | 0.01232 | 0.38889 |
| 0.22374 | −0.05978 | 0.38889 |
| 0.22875 | 0.01953 | 0.38889 |
| 0.23195 | −0.05624 | 0.38889 |
| 0.23418 | 0.02662 | 0.38889 |
| 0.23983 | −0.05200 | 0.38889 |
| 0.23983 | 0.03355 | 0.38889 |
| 0.24568 | 0.04028 | 0.38889 |
| 0.24761 | −0.04759 | 0.38889 |
| 0.25175 | 0.04681 | 0.38889 |
| 0.25547 | −0.04337 | 0.38889 |
| 0.25807 | 0.05310 | 0.38889 |
| 0.26350 | −0.03951 | 0.38889 |
| 0.26465 | 0.05916 | 0.38889 |
| 0.27146 | 0.06493 | 0.38889 |
| 0.27165 | −0.03592 | 0.38889 |
| 0.27850 | 0.07042 | 0.38889 |
| 0.27987 | −0.03247 | 0.38889 |
| 0.28572 | 0.07564 | 0.38889 |
| 0.28814 | −0.02917 | 0.38889 |
| 0.29314 | 0.08062 | 0.38889 |
| 0.29651 | −0.02606 | 0.38889 |
| 0.30074 | 0.08531 | 0.38889 |
| 0.30494 | −0.02322 | 0.38889 |
| 0.30850 | 0.08968 | 0.38889 |
| 0.31347 | −0.02069 | 0.38889 |
| 0.31643 | 0.09370 | 0.38889 |
| 0.32212 | −0.01854 | 0.38889 |
| 0.32455 | 0.09731 | 0.38889 |
| 0.33087 | −0.01676 | 0.38889 |
| 0.33288 | 0.10045 | 0.38889 |
| 0.33966 | −0.01534 | 0.38889 |
| 0.34147 | 0.10299 | 0.38889 |
| 0.34850 | −0.01428 | 0.38889 |
| 0.35020 | 0.10471 | 0.38889 |
| 0.35738 | −0.01358 | 0.38889 |
| 0.35907 | 0.10542 | 0.38889 |
| 0.36629 | −0.01322 | 0.38889 |
| 0.36803 | 0.10495 | 0.38889 |
| 0.37517 | −0.01321 | 0.38889 |
| 0.37679 | 0.10337 | 0.38889 |
| 0.38402 | −0.01356 | 0.38889 |
| 0.38532 | 0.10081 | 0.38889 |
| 0.39280 | −0.01427 | 0.38889 |
| 0.39364 | 0.09748 | 0.38889 |
| 0.40153 | −0.01537 | 0.38889 |
| 0.40166 | 0.09361 | 0.38889 |
| 0.40942 | 0.08932 | 0.38889 |
| 0.41020 | −0.01686 | 0.38889 |
| 0.41694 | 0.08464 | 0.38889 |
| 0.41880 | −0.01878 | 0.38889 |
| 0.42420 | 0.07953 | 0.38889 |
| 0.42735 | −0.02115 | 0.38889 |
| 0.43118 | 0.07397 | 0.38889 |
| 0.43583 | −0.02397 | 0.38889 |
| 0.43781 | 0.06797 | 0.38889 |
| 0.44407 | 0.06165 | 0.38889 |
| 0.44414 | −0.02720 | 0.38889 |
| 0.45000 | 0.05506 | 0.38889 |
| 0.45222 | −0.03086 | 0.38889 |

TABLE 1-continued

| X | Y | Z |
|---|---|---|
| 0.45563 | 0.04824 | 0.38889 |
| 0.46008 | −0.03495 | 0.38889 |
| 0.46103 | 0.04122 | 0.38889 |
| 0.46622 | 0.03404 | 0.38889 |
| 0.46768 | −0.03948 | 0.38889 |
| 0.47124 | 0.02673 | 0.38889 |
| 0.47499 | −0.04454 | 0.38889 |
| 0.47612 | 0.01929 | 0.38889 |
| 0.48088 | 0.01178 | 0.38889 |
| 0.48201 | −0.05013 | 0.38889 |
| 0.48551 | 0.00419 | 0.38889 |
| 0.48867 | −0.05612 | 0.38889 |
| 0.49004 | −0.00345 | 0.38889 |
| 0.49446 | −0.01114 | 0.38889 |
| 0.49506 | −0.06238 | 0.38889 |
| 0.49877 | −0.01890 | 0.38889 |
| 0.50125 | −0.06883 | 0.38889 |
| 0.50296 | −0.02671 | 0.38889 |
| 0.50701 | −0.03459 | 0.38889 |
| 0.50729 | −0.07542 | 0.38889 |
| 0.51093 | −0.04253 | 0.38889 |
| 0.51321 | −0.08213 | 0.38889 |
| 0.51473 | −0.05055 | 0.38889 |
| 0.51838 | −0.05863 | 0.38889 |
| 0.51894 | −0.08901 | 0.38889 |
| 0.52191 | −0.06678 | 0.38889 |
| 0.52535 | −0.07497 | 0.38889 |
| 0.52675 | −0.09099 | 0.38889 |
| 0.52873 | −0.08319 | 0.38889 |
| 0.19908 | −0.04645 | 0.41667 |
| 0.19908 | −0.04645 | 0.41667 |
| 0.19953 | −0.03736 | 0.41667 |
| 0.20139 | −0.02848 | 0.41667 |
| 0.20213 | −0.05484 | 0.41667 |
| 0.20416 | −0.01980 | 0.41667 |
| 0.20760 | −0.01143 | 0.41667 |
| 0.20886 | −0.06079 | 0.41667 |
| 0.21158 | −0.00331 | 0.41667 |
| 0.21602 | 0.00459 | 0.41667 |
| 0.21766 | −0.06205 | 0.41667 |
| 0.22082 | 0.01231 | 0.41667 |
| 0.22589 | 0.01984 | 0.41667 |
| 0.22628 | −0.05938 | 0.41667 |
| 0.23122 | 0.02719 | 0.41667 |
| 0.23440 | −0.05530 | 0.41667 |
| 0.23679 | 0.03435 | 0.41667 |
| 0.24225 | −0.05073 | 0.41667 |
| 0.24261 | 0.04132 | 0.41667 |
| 0.24868 | 0.04810 | 0.41667 |
| 0.25007 | −0.04612 | 0.41667 |
| 0.25497 | 0.05464 | 0.41667 |
| 0.25802 | −0.04175 | 0.41667 |
| 0.26150 | 0.06095 | 0.41667 |
| 0.26615 | −0.03774 | 0.41667 |
| 0.26827 | 0.06700 | 0.41667 |
| 0.27440 | −0.03398 | 0.41667 |
| 0.27528 | 0.07278 | 0.41667 |
| 0.28249 | 0.07828 | 0.41667 |
| 0.28274 | −0.03040 | 0.41667 |
| 0.28991 | 0.08346 | 0.41667 |
| 0.29117 | −0.02704 | 0.41667 |
| 0.29750 | 0.08832 | 0.41667 |
| 0.29969 | −0.02394 | 0.41667 |
| 0.30529 | 0.09285 | 0.41667 |
| 0.30831 | −0.02116 | 0.41667 |
| 0.31329 | 0.09701 | 0.41667 |
| 0.31704 | −0.01876 | 0.41667 |
| 0.32153 | 0.10081 | 0.41667 |
| 0.32588 | −0.01677 | 0.41667 |
| 0.33000 | 0.10414 | 0.41667 |
| 0.33480 | −0.01515 | 0.41667 |
| 0.33865 | 0.10689 | 0.41667 |
| 0.34377 | −0.01390 | 0.41667 |
| 0.34750 | 0.10884 | 0.41667 |
| 0.35279 | −0.01301 | 0.41667 |
| 0.35656 | 0.10984 | 0.41667 |
| 0.36183 | −0.01248 | 0.41667 |
| 0.36562 | 0.10967 | 0.41667 |

TABLE 1-continued

| X | Y | Z |
|---|---|---|
| 0.37089 | −0.01230 | 0.41667 |
| 0.37451 | 0.10835 | 0.41667 |
| 0.37991 | −0.01249 | 0.41667 |
| 0.38325 | 0.10600 | 0.41667 |
| 0.38888 | −0.01305 | 0.41667 |
| 0.39177 | 0.10282 | 0.41667 |
| 0.39778 | −0.01399 | 0.41667 |
| 0.39998 | 0.09905 | 0.41667 |
| 0.40661 | −0.01535 | 0.41667 |
| 0.40795 | 0.09481 | 0.41667 |
| 0.41539 | −0.01716 | 0.41667 |
| 0.41567 | 0.09014 | 0.41667 |
| 0.42315 | 0.08502 | 0.41667 |
| 0.42409 | −0.01943 | 0.41667 |
| 0.43032 | 0.07943 | 0.41667 |
| 0.43271 | −0.02218 | 0.41667 |
| 0.43705 | 0.07342 | 0.41667 |
| 0.44123 | −0.02535 | 0.41667 |
| 0.44337 | 0.06702 | 0.41667 |
| 0.44936 | 0.06028 | 0.41667 |
| 0.44955 | −0.02892 | 0.41667 |
| 0.45504 | 0.05327 | 0.41667 |
| 0.45764 | −0.03291 | 0.41667 |
| 0.46049 | 0.04603 | 0.41667 |
| 0.46548 | −0.03735 | 0.41667 |
| 0.46572 | 0.03863 | 0.41667 |
| 0.47076 | 0.03112 | 0.41667 |
| 0.47304 | −0.04232 | 0.41667 |
| 0.47565 | 0.02351 | 0.41667 |
| 0.48024 | −0.04792 | 0.41667 |
| 0.48042 | 0.01581 | 0.41667 |
| 0.48507 | 0.00805 | 0.41667 |
| 0.48702 | −0.05404 | 0.41667 |
| 0.48962 | 0.00022 | 0.41667 |
| 0.49344 | −0.06047 | 0.41667 |
| 0.49407 | −0.00767 | 0.41667 |
| 0.49840 | −0.01561 | 0.41667 |
| 0.49963 | −0.06712 | 0.41667 |
| 0.50261 | −0.02360 | 0.41667 |
| 0.50567 | −0.07391 | 0.41667 |
| 0.50669 | −0.03167 | 0.41667 |
| 0.51063 | −0.03979 | 0.41667 |
| 0.51162 | −0.08080 | 0.41667 |
| 0.51443 | −0.04798 | 0.41667 |
| 0.51741 | −0.08782 | 0.41667 |
| 0.51810 | −0.05624 | 0.41667 |
| 0.52165 | −0.06454 | 0.41667 |
| 0.52376 | −0.09406 | 0.41667 |
| 0.52510 | −0.07290 | 0.41667 |
| 0.52847 | −0.08129 | 0.41667 |
| 0.53076 | −0.08990 | 0.41667 |
| 0.19994 | −0.04742 | 0.44444 |
| 0.19999 | −0.03817 | 0.44444 |
| 0.20143 | −0.02907 | 0.44444 |
| 0.20331 | −0.05584 | 0.44444 |
| 0.20377 | −0.02011 | 0.44444 |
| 0.20680 | −0.01136 | 0.44444 |
| 0.21040 | −0.00282 | 0.44444 |
| 0.21040 | −0.06153 | 0.44444 |
| 0.21448 | 0.00544 | 0.44444 |
| 0.21899 | 0.01343 | 0.44444 |
| 0.21943 | −0.06196 | 0.44444 |
| 0.22387 | 0.02117 | 0.44444 |
| 0.22803 | −0.05873 | 0.44444 |
| 0.22910 | 0.02867 | 0.44444 |
| 0.23463 | 0.03598 | 0.44444 |
| 0.23613 | −0.05430 | 0.44444 |
| 0.24044 | 0.04310 | 0.44444 |
| 0.24402 | −0.04948 | 0.44444 |
| 0.24649 | 0.05005 | 0.44444 |
| 0.25190 | −0.04465 | 0.44444 |
| 0.25275 | 0.05678 | 0.44444 |
| 0.25922 | 0.06329 | 0.44444 |
| 0.25991 | −0.04009 | 0.44444 |
| 0.26589 | 0.06956 | 0.44444 |
| 0.26811 | −0.03587 | 0.44444 |
| 0.27277 | 0.07557 | 0.44444 |
| 0.27646 | −0.03193 | 0.44444 |

TABLE 1-continued

| X | Y | Z |
|---|---|---|
| 0.27990 | 0.08131 | 0.44444 |
| 0.28491 | −0.02823 | 0.44444 |
| 0.28731 | 0.08672 | 0.44444 |
| 0.29347 | −0.02483 | 0.44444 |
| 0.29502 | 0.09179 | 0.44444 |
| 0.30216 | −0.02175 | 0.44444 |
| 0.30299 | 0.09648 | 0.44444 |
| 0.31098 | −0.01903 | 0.44444 |
| 0.31116 | 0.10077 | 0.44444 |
| 0.31952 | 0.10464 | 0.44444 |
| 0.31991 | −0.01674 | 0.44444 |
| 0.32812 | 0.10803 | 0.44444 |
| 0.32892 | −0.01486 | 0.44444 |
| 0.33693 | 0.11085 | 0.44444 |
| 0.33801 | −0.01337 | 0.44444 |
| 0.34591 | 0.11289 | 0.44444 |
| 0.34717 | −0.01226 | 0.44444 |
| 0.35504 | 0.11401 | 0.44444 |
| 0.35635 | −0.01151 | 0.44444 |
| 0.36431 | 0.11404 | 0.44444 |
| 0.36550 | −0.01114 | 0.44444 |
| 0.37342 | 0.11294 | 0.44444 |
| 0.37462 | −0.01112 | 0.44444 |
| 0.38234 | 0.11079 | 0.44444 |
| 0.38374 | −0.01147 | 0.44444 |
| 0.39106 | 0.10773 | 0.44444 |
| 0.39283 | −0.01221 | 0.44444 |
| 0.39949 | 0.10400 | 0.44444 |
| 0.40189 | −0.01337 | 0.44444 |
| 0.40759 | 0.09975 | 0.44444 |
| 0.41094 | −0.01501 | 0.44444 |
| 0.41543 | 0.09500 | 0.44444 |
| 0.41994 | −0.01714 | 0.44444 |
| 0.42297 | 0.08976 | 0.44444 |
| 0.42877 | −0.01977 | 0.44444 |
| 0.43021 | 0.08402 | 0.44444 |
| 0.43701 | 0.07783 | 0.44444 |
| 0.43743 | −0.02285 | 0.44444 |
| 0.44337 | 0.07126 | 0.44444 |
| 0.44591 | −0.02633 | 0.44444 |
| 0.44933 | 0.06436 | 0.44444 |
| 0.45423 | −0.03022 | 0.44444 |
| 0.45499 | 0.05719 | 0.44444 |
| 0.46039 | 0.04981 | 0.44444 |
| 0.46236 | −0.03458 | 0.44444 |
| 0.46558 | 0.04224 | 0.44444 |
| 0.47022 | −0.03945 | 0.44444 |
| 0.47059 | 0.03454 | 0.44444 |
| 0.47545 | 0.02675 | 0.44444 |
| 0.47761 | −0.04485 | 0.44444 |
| 0.48019 | 0.01889 | 0.44444 |
| 0.48447 | −0.05082 | 0.44444 |
| 0.48481 | 0.01096 | 0.44444 |
| 0.48933 | 0.00297 | 0.44444 |
| 0.49092 | −0.05726 | 0.44444 |
| 0.49376 | −0.00507 | 0.44444 |
| 0.49710 | −0.06399 | 0.44444 |
| 0.49809 | −0.01318 | 0.44444 |
| 0.50230 | −0.02133 | 0.44444 |
| 0.50311 | −0.07090 | 0.44444 |
| 0.50639 | −0.02955 | 0.44444 |
| 0.50901 | −0.07792 | 0.44444 |
| 0.51033 | −0.03784 | 0.44444 |
| 0.51414 | −0.04617 | 0.44444 |
| 0.51480 | −0.08503 | 0.44444 |
| 0.51781 | −0.05457 | 0.44444 |
| 0.52040 | −0.09230 | 0.44444 |
| 0.52136 | −0.06303 | 0.44444 |
| 0.52480 | −0.07153 | 0.44444 |
| 0.52795 | −0.09604 | 0.44444 |
| 0.52816 | −0.08007 | 0.44444 |
| 0.53148 | −0.08862 | 0.44444 |
| 0.53148 | −0.08862 | 0.44444 |
| 0.20071 | −0.03751 | 0.47222 |
| 0.20087 | −0.04685 | 0.47222 |
| 0.20087 | −0.04685 | 0.47222 |
| 0.20186 | −0.02829 | 0.47222 |
| 0.20386 | −0.01915 | 0.47222 |

TABLE 1-continued

| X | Y | Z |
|---|---|---|
| 0.20412 | −0.05545 | 0.47222 |
| 0.20653 | −0.01019 | 0.47222 |
| 0.20976 | −0.00141 | 0.47222 |
| 0.21128 | −0.06116 | 0.47222 |
| 0.21355 | 0.00710 | 0.47222 |
| 0.21785 | 0.01533 | 0.47222 |
| 0.22040 | −0.06136 | 0.47222 |
| 0.22264 | 0.02326 | 0.47222 |
| 0.22788 | 0.03092 | 0.47222 |
| 0.22900 | −0.05789 | 0.47222 |
| 0.23347 | 0.03838 | 0.47222 |
| 0.23709 | −0.05328 | 0.47222 |
| 0.23934 | 0.04563 | 0.47222 |
| 0.24497 | −0.04829 | 0.47222 |
| 0.24540 | 0.05271 | 0.47222 |
| 0.25167 | 0.05962 | 0.47222 |
| 0.25281 | −0.04328 | 0.47222 |
| 0.25813 | 0.06636 | 0.47222 |
| 0.26081 | −0.03851 | 0.47222 |
| 0.26477 | 0.07290 | 0.47222 |
| 0.26898 | −0.03407 | 0.47222 |
| 0.27163 | 0.07922 | 0.47222 |
| 0.27732 | −0.02994 | 0.47222 |
| 0.27875 | 0.08521 | 0.47222 |
| 0.28580 | −0.02613 | 0.47222 |
| 0.28621 | 0.09084 | 0.47222 |
| 0.29395 | 0.09597 | 0.47222 |
| 0.29442 | −0.02268 | 0.47222 |
| 0.30193 | 0.10063 | 0.47222 |
| 0.30320 | −0.01961 | 0.47222 |
| 0.31013 | 0.10483 | 0.47222 |
| 0.31211 | −0.01694 | 0.47222 |
| 0.31853 | 0.10863 | 0.47222 |
| 0.32113 | −0.01469 | 0.47222 |
| 0.32717 | 0.11194 | 0.47222 |
| 0.33023 | −0.01286 | 0.47222 |
| 0.33610 | 0.11468 | 0.47222 |
| 0.33941 | −0.01143 | 0.47222 |
| 0.34519 | 0.11667 | 0.47222 |
| 0.34865 | −0.01038 | 0.47222 |
| 0.35440 | 0.11780 | 0.47222 |
| 0.35793 | −0.00970 | 0.47222 |
| 0.36371 | 0.11796 | 0.47222 |
| 0.36721 | −0.00941 | 0.47222 |
| 0.37301 | 0.11709 | 0.47222 |
| 0.37651 | −0.00949 | 0.47222 |
| 0.38207 | 0.11520 | 0.47222 |
| 0.38579 | −0.00994 | 0.47222 |
| 0.39092 | 0.11237 | 0.47222 |
| 0.39499 | −0.01080 | 0.47222 |
| 0.39952 | 0.10871 | 0.47222 |
| 0.40409 | −0.01209 | 0.47222 |
| 0.40773 | 0.10440 | 0.47222 |
| 0.41310 | −0.01385 | 0.47222 |
| 0.41558 | 0.09950 | 0.47222 |
| 0.42200 | −0.01611 | 0.47222 |
| 0.42308 | 0.09406 | 0.47222 |
| 0.43023 | 0.08808 | 0.47222 |
| 0.43080 | −0.01891 | 0.47222 |
| 0.43698 | 0.08167 | 0.47222 |
| 0.43948 | −0.02219 | 0.47222 |
| 0.44328 | 0.07490 | 0.47222 |
| 0.44802 | −0.02590 | 0.47222 |
| 0.44921 | 0.06783 | 0.47222 |
| 0.45481 | 0.06050 | 0.47222 |
| 0.45632 | −0.03002 | 0.47222 |
| 0.46017 | 0.05297 | 0.47222 |
| 0.46436 | −0.03458 | 0.47222 |
| 0.46531 | 0.04526 | 0.47222 |
| 0.47026 | 0.03742 | 0.47222 |
| 0.47209 | −0.03965 | 0.47222 |
| 0.47505 | 0.02948 | 0.47222 |
| 0.47944 | −0.04535 | 0.47222 |
| 0.47972 | 0.02146 | 0.47222 |
| 0.48426 | 0.01338 | 0.47222 |
| 0.48633 | −0.05171 | 0.47222 |
| 0.48873 | 0.00525 | 0.47222 |
| 0.49275 | −0.05849 | 0.47222 |

TABLE 1-continued

| X | Y | Z |
|---|---|---|
| 0.49310 | −0.00293 | 0.47222 |
| 0.49740 | −0.01115 | 0.47222 |
| 0.49888 | −0.06551 | 0.47222 |
| 0.50160 | −0.01943 | 0.47222 |
| 0.50482 | −0.07268 | 0.47222 |
| 0.50568 | −0.02776 | 0.47222 |
| 0.50962 | −0.03615 | 0.47222 |
| 0.51065 | −0.07995 | 0.47222 |
| 0.51343 | −0.04460 | 0.47222 |
| 0.51636 | −0.08732 | 0.47222 |
| 0.51711 | −0.05311 | 0.47222 |
| 0.52066 | −0.06168 | 0.47222 |
| 0.52185 | −0.09488 | 0.47222 |
| 0.52408 | −0.07028 | 0.47222 |
| 0.52743 | −0.07893 | 0.47222 |
| 0.52998 | −0.09609 | 0.47222 |
| 0.53073 | −0.08760 | 0.47222 |
| 0.20187 | −0.04195 | 0.50000 |
| 0.20209 | −0.03261 | 0.50000 |
| 0.20336 | −0.02335 | 0.50000 |
| 0.20377 | −0.05107 | 0.50000 |
| 0.20538 | −0.01418 | 0.50000 |
| 0.20801 | −0.00517 | 0.50000 |
| 0.20977 | −0.05806 | 0.50000 |
| 0.21122 | 0.00365 | 0.50000 |
| 0.21499 | 0.01219 | 0.50000 |
| 0.21868 | −0.06018 | 0.50000 |
| 0.21868 | −0.06018 | 0.50000 |
| 0.21933 | 0.02041 | 0.50000 |
| 0.22423 | 0.02829 | 0.50000 |
| 0.22757 | −0.05733 | 0.50000 |
| 0.22960 | 0.03592 | 0.50000 |
| 0.23533 | 0.04332 | 0.50000 |
| 0.23583 | −0.05288 | 0.50000 |
| 0.24126 | 0.05054 | 0.50000 |
| 0.24376 | −0.04785 | 0.50000 |
| 0.24735 | 0.05760 | 0.50000 |
| 0.25159 | −0.04268 | 0.50000 |
| 0.25360 | 0.06452 | 0.50000 |
| 0.25948 | −0.03762 | 0.50000 |
| 0.25999 | 0.07129 | 0.50000 |
| 0.26655 | 0.07790 | 0.50000 |
| 0.26755 | −0.03284 | 0.50000 |
| 0.27334 | 0.08428 | 0.50000 |
| 0.27581 | −0.02840 | 0.50000 |
| 0.28047 | 0.09034 | 0.50000 |
| 0.28426 | −0.02434 | 0.50000 |
| 0.28801 | 0.09598 | 0.50000 |
| 0.29289 | −0.02068 | 0.50000 |
| 0.29588 | 0.10106 | 0.50000 |
| 0.30168 | −0.01744 | 0.50000 |
| 0.30404 | 0.10560 | 0.50000 |
| 0.31062 | −0.01464 | 0.50000 |
| 0.31244 | 0.10968 | 0.50000 |
| 0.31968 | −0.01227 | 0.50000 |
| 0.32107 | 0.11330 | 0.50000 |
| 0.32884 | −0.01032 | 0.50000 |
| 0.32995 | 0.11638 | 0.50000 |
| 0.33808 | −0.00878 | 0.50000 |
| 0.33898 | 0.11878 | 0.50000 |
| 0.34738 | −0.00765 | 0.50000 |
| 0.34815 | 0.12043 | 0.50000 |
| 0.35671 | −0.00692 | 0.50000 |
| 0.35747 | 0.12127 | 0.50000 |
| 0.36608 | −0.00658 | 0.50000 |
| 0.36688 | 0.12121 | 0.50000 |
| 0.37542 | −0.00664 | 0.50000 |
| 0.37616 | 0.12020 | 0.50000 |
| 0.38470 | −0.00710 | 0.50000 |
| 0.38528 | 0.11819 | 0.50000 |
| 0.39393 | −0.00795 | 0.50000 |
| 0.39421 | 0.11519 | 0.50000 |
| 0.40275 | 0.11133 | 0.50000 |
| 0.40308 | −0.00924 | 0.50000 |
| 0.41089 | 0.10671 | 0.50000 |
| 0.41216 | −0.01102 | 0.50000 |
| 0.41864 | 0.10137 | 0.50000 |
| 0.42115 | −0.01334 | 0.50000 |

TABLE 1-continued

| X | Y | Z |
|---|---|---|
| 0.42592 | 0.09548 | 0.50000 |
| 0.43007 | −0.01624 | 0.50000 |
| 0.43276 | 0.08914 | 0.50000 |
| 0.43884 | −0.01966 | 0.50000 |
| 0.43920 | 0.08242 | 0.50000 |
| 0.44529 | 0.07536 | 0.50000 |
| 0.44738 | −0.02352 | 0.50000 |
| 0.45108 | 0.06799 | 0.50000 |
| 0.45570 | −0.02779 | 0.50000 |
| 0.45659 | 0.06040 | 0.50000 |
| 0.46182 | 0.05265 | 0.50000 |
| 0.46377 | −0.03252 | 0.50000 |
| 0.46683 | 0.04477 | 0.50000 |
| 0.47155 | −0.03777 | 0.50000 |
| 0.47165 | 0.03678 | 0.50000 |
| 0.47630 | 0.02869 | 0.50000 |
| 0.47897 | −0.04361 | 0.50000 |
| 0.48083 | 0.02051 | 0.50000 |
| 0.48524 | 0.01229 | 0.50000 |
| 0.48580 | −0.05000 | 0.50000 |
| 0.48959 | 0.00402 | 0.50000 |
| 0.49213 | −0.05681 | 0.50000 |
| 0.49387 | −0.00429 | 0.50000 |
| 0.49810 | −0.01263 | 0.50000 |
| 0.49813 | −0.06390 | 0.50000 |
| 0.50225 | −0.02100 | 0.50000 |
| 0.50394 | −0.07117 | 0.50000 |
| 0.50628 | −0.02943 | 0.50000 |
| 0.50960 | −0.07853 | 0.50000 |
| 0.51017 | −0.03791 | 0.50000 |
| 0.51391 | −0.04645 | 0.50000 |
| 0.51517 | −0.08600 | 0.50000 |
| 0.51754 | −0.05505 | 0.50000 |
| 0.52055 | −0.09361 | 0.50000 |
| 0.52103 | −0.06372 | 0.50000 |
| 0.52441 | −0.07241 | 0.50000 |
| 0.52771 | −0.08115 | 0.50000 |
| 0.52804 | −0.09762 | 0.50000 |
| 0.53097 | −0.08991 | 0.50000 |
| 0.20366 | −0.03221 | 0.52778 |
| 0.20385 | −0.04158 | 0.52778 |
| 0.20468 | −0.02294 | 0.52778 |
| 0.20648 | −0.01374 | 0.52778 |
| 0.20693 | −0.05033 | 0.52778 |
| 0.20891 | −0.00468 | 0.52778 |
| 0.21192 | 0.00420 | 0.52778 |
| 0.21417 | −0.05603 | 0.52778 |
| 0.21549 | 0.01285 | 0.52778 |
| 0.21964 | 0.02118 | 0.52778 |
| 0.22343 | −0.05615 | 0.52778 |
| 0.22438 | 0.02914 | 0.52778 |
| 0.22965 | 0.03681 | 0.52778 |
| 0.23214 | −0.05271 | 0.52778 |
| 0.23531 | 0.04425 | 0.52778 |
| 0.24029 | −0.04804 | 0.52778 |
| 0.24123 | 0.05150 | 0.52778 |
| 0.24730 | 0.05861 | 0.52778 |
| 0.24816 | −0.04290 | 0.52778 |
| 0.25352 | 0.06560 | 0.52778 |
| 0.25594 | −0.03763 | 0.52778 |
| 0.25988 | 0.07246 | 0.52778 |
| 0.26379 | −0.03249 | 0.52778 |
| 0.26637 | 0.07917 | 0.52778 |
| 0.27182 | −0.02762 | 0.52778 |
| 0.27303 | 0.08568 | 0.52778 |
| 0.27996 | 0.09187 | 0.52778 |
| 0.28005 | −0.02310 | 0.52778 |
| 0.28723 | 0.09763 | 0.52778 |
| 0.28851 | −0.01900 | 0.52778 |
| 0.29492 | 0.10287 | 0.52778 |
| 0.29716 | −0.01536 | 0.52778 |
| 0.30301 | 0.10761 | 0.52778 |
| 0.30593 | −0.01220 | 0.52778 |
| 0.31143 | 0.11185 | 0.52778 |
| 0.31483 | −0.00950 | 0.52778 |
| 0.32004 | 0.11556 | 0.52778 |
| 0.32384 | −0.00722 | 0.52778 |
| 0.32885 | 0.11872 | 0.52778 |

TABLE 1-continued

| X | Y | Z |
|---|---|---|
| 0.33296 | −0.00535 | 0.52778 |
| 0.33789 | 0.12122 | 0.52778 |
| 0.34221 | −0.00391 | 0.52778 |
| 0.34717 | 0.12300 | 0.52778 |
| 0.35154 | −0.00289 | 0.52778 |
| 0.35653 | 0.12396 | 0.52778 |
| 0.36092 | −0.00231 | 0.52778 |
| 0.36590 | 0.12406 | 0.52778 |
| 0.37030 | −0.00216 | 0.52778 |
| 0.37529 | 0.12324 | 0.52778 |
| 0.37970 | −0.00245 | 0.52778 |
| 0.38455 | 0.12143 | 0.52778 |
| 0.38905 | −0.00316 | 0.52778 |
| 0.39347 | 0.11865 | 0.52778 |
| 0.39830 | −0.00433 | 0.52778 |
| 0.40208 | 0.11494 | 0.52778 |
| 0.40743 | −0.00598 | 0.52778 |
| 0.41033 | 0.11034 | 0.52778 |
| 0.41644 | −0.00816 | 0.52778 |
| 0.41807 | 0.10502 | 0.52778 |
| 0.42529 | 0.09908 | 0.52778 |
| 0.42533 | −0.01091 | 0.52778 |
| 0.43209 | 0.09262 | 0.52778 |
| 0.43407 | −0.01425 | 0.52778 |
| 0.43852 | 0.08573 | 0.52778 |
| 0.44266 | −0.01813 | 0.52778 |
| 0.44459 | 0.07855 | 0.52778 |
| 0.45033 | 0.07113 | 0.52778 |
| 0.45100 | −0.02242 | 0.52778 |
| 0.45580 | 0.06350 | 0.52778 |
| 0.45908 | −0.02711 | 0.52778 |
| 0.46100 | 0.05568 | 0.52778 |
| 0.46599 | 0.04770 | 0.52778 |
| 0.46687 | −0.03224 | 0.52778 |
| 0.47078 | 0.03960 | 0.52778 |
| 0.47434 | −0.03784 | 0.52778 |
| 0.47539 | 0.03139 | 0.52778 |
| 0.47986 | 0.02312 | 0.52778 |
| 0.48142 | −0.04403 | 0.52778 |
| 0.48420 | 0.01478 | 0.52778 |
| 0.48804 | −0.05083 | 0.52778 |
| 0.48847 | 0.00640 | 0.52778 |
| 0.49270 | −0.00200 | 0.52778 |
| 0.49417 | −0.05802 | 0.52778 |
| 0.49689 | −0.01042 | 0.52778 |
| 0.50000 | −0.06544 | 0.52778 |
| 0.50102 | −0.01887 | 0.52778 |
| 0.50506 | −0.02737 | 0.52778 |
| 0.50565 | −0.07299 | 0.52778 |
| 0.50897 | −0.03592 | 0.52778 |
| 0.51117 | −0.08064 | 0.52778 |
| 0.51274 | −0.04453 | 0.52778 |
| 0.51637 | −0.05319 | 0.52778 |
| 0.51659 | −0.08838 | 0.52778 |
| 0.51987 | −0.06191 | 0.52778 |
| 0.52179 | −0.09627 | 0.52778 |
| 0.52179 | −0.09627 | 0.52778 |
| 0.52325 | −0.07068 | 0.52778 |
| 0.52653 | −0.07948 | 0.52778 |
| 0.52975 | −0.08831 | 0.52778 |
| 0.52990 | −0.09707 | 0.52778 |
| 0.20566 | −0.02961 | 0.55556 |
| 0.20605 | −0.03902 | 0.55556 |
| 0.20664 | −0.02030 | 0.55556 |
| 0.20846 | −0.01106 | 0.55556 |
| 0.20994 | −0.04745 | 0.55556 |
| 0.21094 | −0.00197 | 0.55556 |
| 0.21397 | 0.00694 | 0.55556 |
| 0.21758 | 0.01564 | 0.55556 |
| 0.21789 | −0.05211 | 0.55556 |
| 0.22175 | 0.02403 | 0.55556 |
| 0.22651 | 0.03204 | 0.55556 |
| 0.22725 | −0.05136 | 0.55556 |
| 0.23181 | 0.03973 | 0.55556 |
| 0.23602 | −0.04768 | 0.55556 |
| 0.23751 | 0.04718 | 0.55556 |
| 0.24348 | 0.05443 | 0.55556 |
| 0.24418 | −0.04289 | 0.55556 |

TABLE 1-continued

| X | Y | Z |
|---|---|---|
| 0.24959 | 0.06153 | 0.55556 |
| 0.25205 | −0.03764 | 0.55556 |
| 0.25585 | 0.06850 | 0.55556 |
| 0.25984 | −0.03224 | 0.55556 |
| 0.26224 | 0.07534 | 0.55556 |
| 0.26769 | −0.02696 | 0.55556 |
| 0.26878 | 0.08205 | 0.55556 |
| 0.27549 | 0.08857 | 0.55556 |
| 0.27570 | −0.02194 | 0.55556 |
| 0.28249 | 0.09482 | 0.55556 |
| 0.28394 | −0.01731 | 0.55556 |
| 0.28986 | 0.10067 | 0.55556 |
| 0.29243 | −0.01314 | 0.55556 |
| 0.29765 | 0.10600 | 0.55556 |
| 0.30113 | −0.00947 | 0.55556 |
| 0.30575 | 0.11073 | 0.55556 |
| 0.30996 | −0.00633 | 0.55556 |
| 0.31413 | 0.11490 | 0.55556 |
| 0.31893 | −0.00366 | 0.55556 |
| 0.32279 | 0.11855 | 0.55556 |
| 0.32801 | −0.00141 | 0.55556 |
| 0.33171 | 0.12163 | 0.55556 |
| 0.33721 | 0.00038 | 0.55556 |
| 0.34076 | 0.12398 | 0.55556 |
| 0.34653 | 0.00173 | 0.55556 |
| 0.34993 | 0.12555 | 0.55556 |
| 0.35594 | 0.00260 | 0.55556 |
| 0.35921 | 0.12631 | 0.55556 |
| 0.36532 | 0.00300 | 0.55556 |
| 0.36863 | 0.12618 | 0.55556 |
| 0.37467 | 0.00291 | 0.55556 |
| 0.37800 | 0.12511 | 0.55556 |
| 0.38399 | 0.00236 | 0.55556 |
| 0.38714 | 0.12307 | 0.55556 |
| 0.39328 | 0.00134 | 0.55556 |
| 0.39605 | 0.12002 | 0.55556 |
| 0.40254 | −0.00020 | 0.55556 |
| 0.40462 | 0.11604 | 0.55556 |
| 0.41176 | −0.00230 | 0.55556 |
| 0.41270 | 0.11124 | 0.55556 |
| 0.42030 | 0.10569 | 0.55556 |
| 0.42078 | −0.00498 | 0.55556 |
| 0.42743 | 0.09948 | 0.55556 |
| 0.42953 | −0.00823 | 0.55556 |
| 0.43404 | 0.09282 | 0.55556 |
| 0.43801 | −0.01206 | 0.55556 |
| 0.44024 | 0.08580 | 0.55556 |
| 0.44612 | 0.07851 | 0.55556 |
| 0.44626 | −0.01637 | 0.55556 |
| 0.45171 | 0.07098 | 0.55556 |
| 0.45430 | −0.02112 | 0.55556 |
| 0.45704 | 0.06323 | 0.55556 |
| 0.46213 | 0.05532 | 0.55556 |
| 0.46215 | −0.02628 | 0.55556 |
| 0.46699 | 0.04727 | 0.55556 |
| 0.46972 | −0.03187 | 0.55556 |
| 0.47166 | 0.03910 | 0.55556 |
| 0.47615 | 0.03085 | 0.55556 |
| 0.47688 | −0.03786 | 0.55556 |
| 0.48049 | 0.02251 | 0.55556 |
| 0.48356 | −0.04432 | 0.55556 |
| 0.48472 | 0.01411 | 0.55556 |
| 0.48889 | 0.00567 | 0.55556 |
| 0.48972 | −0.05128 | 0.55556 |
| 0.49302 | −0.00278 | 0.55556 |
| 0.49549 | −0.05861 | 0.55556 |
| 0.49713 | −0.01124 | 0.55556 |
| 0.50103 | −0.06618 | 0.55556 |
| 0.50120 | −0.01972 | 0.55556 |
| 0.50518 | −0.02823 | 0.55556 |
| 0.50641 | −0.07387 | 0.55556 |
| 0.50903 | −0.03681 | 0.55556 |
| 0.51169 | −0.08163 | 0.55556 |
| 0.51275 | −0.04544 | 0.55556 |
| 0.51633 | −0.05412 | 0.55556 |
| 0.51686 | −0.08945 | 0.55556 |
| 0.51978 | −0.06286 | 0.55556 |
| 0.52184 | −0.09741 | 0.55556 |

TABLE 1-continued

| X | Y | Z |
|---|---|---|
| 0.52184 | −0.09741 | 0.55556 |
| 0.52310 | −0.07166 | 0.55556 |
| 0.52633 | −0.08050 | 0.55556 |
| 0.52951 | −0.08935 | 0.55556 |
| 0.52988 | −0.09817 | 0.55556 |
| 0.20763 | −0.02725 | 0.58333 |
| 0.20846 | −0.03659 | 0.58333 |
| 0.20848 | −0.01795 | 0.58333 |
| 0.21027 | −0.00874 | 0.58333 |
| 0.21273 | 0.00031 | 0.58333 |
| 0.21338 | −0.04444 | 0.58333 |
| 0.21572 | 0.00913 | 0.58333 |
| 0.21926 | 0.01771 | 0.58333 |
| 0.22204 | −0.04770 | 0.58333 |
| 0.22335 | 0.02604 | 0.58333 |
| 0.22805 | 0.03411 | 0.58333 |
| 0.23135 | −0.04614 | 0.58333 |
| 0.23332 | 0.04190 | 0.58333 |
| 0.23901 | 0.04938 | 0.58333 |
| 0.24001 | −0.04225 | 0.58333 |
| 0.24497 | 0.05663 | 0.58333 |
| 0.24809 | −0.03737 | 0.58333 |
| 0.25111 | 0.06373 | 0.58333 |
| 0.25589 | −0.03204 | 0.58333 |
| 0.25742 | 0.07069 | 0.58333 |
| 0.26361 | −0.02656 | 0.58333 |
| 0.26388 | 0.07752 | 0.58333 |
| 0.27047 | 0.08419 | 0.58333 |
| 0.27137 | −0.02115 | 0.58333 |
| 0.27722 | 0.09068 | 0.58333 |
| 0.27932 | −0.01602 | 0.58333 |
| 0.28421 | 0.09688 | 0.58333 |
| 0.28754 | −0.01133 | 0.58333 |
| 0.29151 | 0.10270 | 0.58333 |
| 0.29598 | −0.00718 | 0.58333 |
| 0.29921 | 0.10802 | 0.58333 |
| 0.30462 | −0.00357 | 0.58333 |
| 0.30735 | 0.11283 | 0.58333 |
| 0.31346 | −0.00050 | 0.58333 |
| 0.31582 | 0.11707 | 0.58333 |
| 0.32247 | 0.00211 | 0.58333 |
| 0.32451 | 0.12071 | 0.58333 |
| 0.33164 | 0.00428 | 0.58333 |
| 0.33342 | 0.12373 | 0.58333 |
| 0.34090 | 0.00599 | 0.58333 |
| 0.34261 | 0.12604 | 0.58333 |
| 0.35020 | 0.00720 | 0.58333 |
| 0.35197 | 0.12751 | 0.58333 |
| 0.35952 | 0.00790 | 0.58333 |
| 0.36137 | 0.12810 | 0.58333 |
| 0.36886 | 0.00810 | 0.58333 |
| 0.37080 | 0.12776 | 0.58333 |
| 0.37822 | 0.00778 | 0.58333 |
| 0.38021 | 0.12642 | 0.58333 |
| 0.38760 | 0.00695 | 0.58333 |
| 0.38934 | 0.12411 | 0.58333 |
| 0.39693 | 0.00560 | 0.58333 |
| 0.39814 | 0.12082 | 0.58333 |
| 0.40610 | 0.00371 | 0.58333 |
| 0.40663 | 0.11659 | 0.58333 |
| 0.41466 | 0.11155 | 0.58333 |
| 0.41512 | 0.00125 | 0.58333 |
| 0.42215 | 0.10581 | 0.58333 |
| 0.42395 | −0.00182 | 0.58333 |
| 0.42917 | 0.09943 | 0.58333 |
| 0.43260 | −0.00555 | 0.58333 |
| 0.43570 | 0.09257 | 0.58333 |
| 0.44100 | −0.00988 | 0.58333 |
| 0.44179 | 0.08540 | 0.58333 |
| 0.44754 | 0.07801 | 0.58333 |
| 0.44907 | −0.01469 | 0.58333 |
| 0.45300 | 0.07040 | 0.58333 |
| 0.45686 | −0.01987 | 0.58333 |
| 0.45819 | 0.06260 | 0.58333 |
| 0.46314 | 0.05465 | 0.58333 |
| 0.46439 | −0.02540 | 0.58333 |
| 0.46789 | 0.04654 | 0.58333 |
| 0.47165 | −0.03132 | 0.58333 |

TABLE 1-continued

| X | Y | Z |
|---|---|---|
| 0.47246 | 0.03831 | 0.58333 |
| 0.47685 | 0.02998 | 0.58333 |
| 0.47858 | −0.03768 | 0.58333 |
| 0.48111 | 0.02157 | 0.58333 |
| 0.48509 | −0.04456 | 0.58333 |
| 0.48526 | 0.01310 | 0.58333 |
| 0.48934 | 0.00461 | 0.58333 |
| 0.49105 | −0.05187 | 0.58333 |
| 0.49340 | −0.00391 | 0.58333 |
| 0.49658 | −0.05946 | 0.58333 |
| 0.49745 | −0.01242 | 0.58333 |
| 0.50146 | −0.02095 | 0.58333 |
| 0.50188 | −0.06721 | 0.58333 |
| 0.50539 | −0.02952 | 0.58333 |
| 0.50705 | −0.07506 | 0.58333 |
| 0.50920 | −0.03814 | 0.58333 |
| 0.51214 | −0.08296 | 0.58333 |
| 0.51286 | −0.04682 | 0.58333 |
| 0.51640 | −0.05555 | 0.58333 |
| 0.51713 | −0.09093 | 0.58333 |
| 0.51980 | −0.06433 | 0.58333 |
| 0.52193 | −0.09902 | 0.58333 |
| 0.52193 | −0.09902 | 0.58333 |
| 0.52307 | −0.07316 | 0.58333 |
| 0.52626 | −0.08202 | 0.58333 |
| 0.52939 | −0.09090 | 0.58333 |
| 0.52992 | −0.09976 | 0.58333 |
| 0.20976 | −0.02029 | 0.61111 |
| 0.20990 | −0.02969 | 0.61111 |
| 0.21100 | −0.01102 | 0.61111 |
| 0.21307 | −0.00186 | 0.61111 |
| 0.21358 | −0.03821 | 0.61111 |
| 0.21581 | 0.00711 | 0.61111 |
| 0.21906 | 0.01584 | 0.61111 |
| 0.22175 | −0.04255 | 0.61111 |
| 0.22285 | 0.02433 | 0.61111 |
| 0.22720 | 0.03255 | 0.61111 |
| 0.23118 | −0.04198 | 0.61111 |
| 0.23214 | 0.04050 | 0.61111 |
| 0.23760 | 0.04817 | 0.61111 |
| 0.24007 | −0.03859 | 0.61111 |
| 0.24343 | 0.05555 | 0.61111 |
| 0.24829 | −0.03394 | 0.61111 |
| 0.24952 | 0.06271 | 0.61111 |
| 0.25579 | 0.06972 | 0.61111 |
| 0.25614 | −0.02870 | 0.61111 |
| 0.26223 | 0.07658 | 0.61111 |
| 0.26382 | −0.02315 | 0.61111 |
| 0.26882 | 0.08327 | 0.61111 |
| 0.27146 | −0.01759 | 0.61111 |
| 0.27556 | 0.08979 | 0.61111 |
| 0.27925 | −0.01221 | 0.61111 |
| 0.28249 | 0.09608 | 0.61111 |
| 0.28732 | −0.00727 | 0.61111 |
| 0.28970 | 0.10206 | 0.61111 |
| 0.29570 | −0.00287 | 0.61111 |
| 0.29724 | 0.10762 | 0.61111 |
| 0.30433 | 0.00092 | 0.61111 |
| 0.30521 | 0.11267 | 0.61111 |
| 0.31314 | 0.00411 | 0.61111 |
| 0.31356 | 0.11717 | 0.61111 |
| 0.32212 | 0.00678 | 0.61111 |
| 0.32215 | 0.12103 | 0.61111 |
| 0.33099 | 0.12428 | 0.61111 |
| 0.33124 | 0.00901 | 0.61111 |
| 0.34011 | 0.12684 | 0.61111 |
| 0.34051 | 0.01078 | 0.61111 |
| 0.34942 | 0.12857 | 0.61111 |
| 0.34985 | 0.01203 | 0.61111 |
| 0.35880 | 0.12941 | 0.61111 |
| 0.35919 | 0.01275 | 0.61111 |
| 0.36822 | 0.12929 | 0.61111 |
| 0.36853 | 0.01292 | 0.61111 |
| 0.37765 | 0.12819 | 0.61111 |
| 0.37787 | 0.01255 | 0.61111 |
| 0.38683 | 0.12611 | 0.61111 |
| 0.38720 | 0.01164 | 0.61111 |
| 0.39572 | 0.12305 | 0.61111 |

TABLE 1-continued

| X | Y | Z |
|---|---|---|
| 0.39653 | 0.01018 | 0.61111 |
| 0.40430 | 0.11903 | 0.61111 |
| 0.40572 | 0.00816 | 0.61111 |
| 0.41243 | 0.11417 | 0.61111 |
| 0.41470 | 0.00556 | 0.61111 |
| 0.42005 | 0.10860 | 0.61111 |
| 0.42348 | 0.00235 | 0.61111 |
| 0.42719 | 0.10238 | 0.61111 |
| 0.43203 | −0.00151 | 0.61111 |
| 0.43385 | 0.09563 | 0.61111 |
| 0.44004 | 0.08853 | 0.61111 |
| 0.44033 | −0.00604 | 0.61111 |
| 0.44585 | 0.08115 | 0.61111 |
| 0.44828 | −0.01110 | 0.61111 |
| 0.45137 | 0.07354 | 0.61111 |
| 0.45590 | −0.01654 | 0.61111 |
| 0.45661 | 0.06572 | 0.61111 |
| 0.46161 | 0.05773 | 0.61111 |
| 0.46326 | −0.02230 | 0.61111 |
| 0.46640 | 0.04958 | 0.61111 |
| 0.47036 | −0.02839 | 0.61111 |
| 0.47098 | 0.04132 | 0.61111 |
| 0.47538 | 0.03297 | 0.61111 |
| 0.47715 | −0.03486 | 0.61111 |
| 0.47963 | 0.02454 | 0.61111 |
| 0.48357 | −0.04177 | 0.61111 |
| 0.48375 | 0.01605 | 0.61111 |
| 0.48779 | 0.00752 | 0.61111 |
| 0.48950 | −0.04915 | 0.61111 |
| 0.49178 | −0.00103 | 0.61111 |
| 0.49497 | −0.05685 | 0.61111 |
| 0.49576 | −0.00959 | 0.61111 |
| 0.49973 | −0.01816 | 0.61111 |
| 0.50015 | −0.06474 | 0.61111 |
| 0.50363 | −0.02675 | 0.61111 |
| 0.50520 | −0.07270 | 0.61111 |
| 0.50744 | −0.03538 | 0.61111 |
| 0.51016 | −0.08073 | 0.61111 |
| 0.51112 | −0.04407 | 0.61111 |
| 0.51467 | −0.05280 | 0.61111 |
| 0.51504 | −0.08880 | 0.61111 |
| 0.51808 | −0.06159 | 0.61111 |
| 0.51979 | −0.09697 | 0.61111 |
| 0.52136 | −0.07043 | 0.61111 |
| 0.52455 | −0.07931 | 0.61111 |
| 0.52592 | −0.10348 | 0.61111 |
| 0.52767 | −0.08822 | 0.61111 |
| 0.53076 | −0.09713 | 0.61111 |
| 0.53076 | −0.09713 | 0.61111 |
| 0.21173 | −0.01717 | 0.63889 |
| 0.21227 | −0.02656 | 0.63889 |
| 0.21286 | −0.00785 | 0.63889 |
| 0.21491 | 0.00133 | 0.63889 |
| 0.21703 | −0.03447 | 0.63889 |
| 0.21765 | 0.01035 | 0.63889 |
| 0.22094 | 0.01912 | 0.63889 |
| 0.22476 | 0.02764 | 0.63889 |
| 0.22584 | −0.03742 | 0.63889 |
| 0.22913 | 0.03588 | 0.63889 |
| 0.23407 | 0.04385 | 0.63889 |
| 0.23522 | −0.03617 | 0.63889 |
| 0.23956 | 0.05153 | 0.63889 |
| 0.24400 | −0.03255 | 0.63889 |
| 0.24545 | 0.05891 | 0.63889 |
| 0.25161 | 0.06606 | 0.63889 |
| 0.25217 | −0.02783 | 0.63889 |
| 0.25797 | 0.07302 | 0.63889 |
| 0.26002 | −0.02251 | 0.63889 |
| 0.26451 | 0.07983 | 0.63889 |
| 0.26765 | −0.01687 | 0.63889 |
| 0.27122 | 0.08646 | 0.63889 |
| 0.27526 | −0.01119 | 0.63889 |
| 0.27808 | 0.09290 | 0.63889 |
| 0.28304 | −0.00574 | 0.63889 |
| 0.28514 | 0.09910 | 0.63889 |
| 0.29111 | −0.00083 | 0.63889 |
| 0.29246 | 0.10498 | 0.63889 |
| 0.29947 | 0.00345 | 0.63889 |

TABLE 1-continued

| X | Y | Z |
|---|---|---|
| 0.30012 | 0.11044 | 0.63889 |
| 0.30811 | 0.00709 | 0.63889 |
| 0.30820 | 0.11541 | 0.63889 |
| 0.31663 | 0.11977 | 0.63889 |
| 0.31702 | 0.01011 | 0.63889 |
| 0.32532 | 0.12347 | 0.63889 |
| 0.32614 | 0.01263 | 0.63889 |
| 0.33426 | 0.12649 | 0.63889 |
| 0.33534 | 0.01467 | 0.63889 |
| 0.34348 | 0.12877 | 0.63889 |
| 0.34458 | 0.01622 | 0.63889 |
| 0.35285 | 0.13017 | 0.63889 |
| 0.35388 | 0.01724 | 0.63889 |
| 0.36221 | 0.13063 | 0.63889 |
| 0.36324 | 0.01769 | 0.63889 |
| 0.37160 | 0.13012 | 0.63889 |
| 0.37265 | 0.01756 | 0.63889 |
| 0.38098 | 0.12860 | 0.63889 |
| 0.38210 | 0.01684 | 0.63889 |
| 0.39012 | 0.12611 | 0.63889 |
| 0.39144 | 0.01555 | 0.63889 |
| 0.39889 | 0.12267 | 0.63889 |
| 0.40062 | 0.01370 | 0.63889 |
| 0.40732 | 0.11832 | 0.63889 |
| 0.40965 | 0.01128 | 0.63889 |
| 0.41528 | 0.11315 | 0.63889 |
| 0.41850 | 0.00824 | 0.63889 |
| 0.42269 | 0.10732 | 0.63889 |
| 0.42716 | 0.00455 | 0.63889 |
| 0.42959 | 0.10089 | 0.63889 |
| 0.43560 | 0.00015 | 0.63889 |
| 0.43606 | 0.09396 | 0.63889 |
| 0.44209 | 0.08665 | 0.63889 |
| 0.44362 | −0.00485 | 0.63889 |
| 0.44775 | 0.07911 | 0.63889 |
| 0.45127 | −0.01036 | 0.63889 |
| 0.45310 | 0.07140 | 0.63889 |
| 0.45818 | 0.06353 | 0.63889 |
| 0.45863 | −0.01626 | 0.63889 |
| 0.46302 | 0.05551 | 0.63889 |
| 0.46575 | −0.02249 | 0.63889 |
| 0.46765 | 0.04736 | 0.63889 |
| 0.47209 | 0.03911 | 0.63889 |
| 0.47261 | −0.02903 | 0.63889 |
| 0.47637 | 0.03076 | 0.63889 |
| 0.47910 | −0.03586 | 0.63889 |
| 0.48051 | 0.02233 | 0.63889 |
| 0.48454 | 0.01384 | 0.63889 |
| 0.48515 | −0.04300 | 0.63889 |
| 0.48849 | 0.00530 | 0.63889 |
| 0.49071 | −0.05050 | 0.63889 |
| 0.49240 | −0.00327 | 0.63889 |
| 0.49589 | −0.05828 | 0.63889 |
| 0.49628 | −0.01184 | 0.63889 |
| 0.50015 | −0.02042 | 0.63889 |
| 0.50084 | −0.06623 | 0.63889 |
| 0.50395 | −0.02903 | 0.63889 |
| 0.50569 | −0.07426 | 0.63889 |
| 0.50766 | −0.03768 | 0.63889 |
| 0.51045 | −0.08234 | 0.63889 |
| 0.51124 | −0.04637 | 0.63889 |
| 0.51470 | −0.05511 | 0.63889 |
| 0.51515 | −0.09047 | 0.63889 |
| 0.51805 | −0.06390 | 0.63889 |
| 0.51970 | −0.09868 | 0.63889 |
| 0.52128 | −0.07275 | 0.63889 |
| 0.52441 | −0.08162 | 0.63889 |
| 0.52553 | −0.10552 | 0.63889 |
| 0.52749 | −0.09052 | 0.63889 |
| 0.53053 | −0.09943 | 0.63889 |
| 0.53053 | −0.09943 | 0.63889 |
| 0.21387 | −0.01888 | 0.66667 |
| 0.21400 | −0.00947 | 0.66667 |
| 0.21549 | −0.00024 | 0.66667 |
| 0.21737 | −0.02745 | 0.66667 |
| 0.21782 | 0.00886 | 0.66667 |
| 0.22079 | 0.01775 | 0.66667 |
| 0.22430 | 0.02639 | 0.66667 |

TABLE 1-continued

| X | Y | Z |
|---|---|---|
| 0.22567 | −0.03153 | 0.66667 |
| 0.22834 | 0.03477 | 0.66667 |
| 0.23292 | 0.04286 | 0.66667 |
| 0.23509 | −0.03120 | 0.66667 |
| 0.23807 | 0.05067 | 0.66667 |
| 0.24373 | 0.05820 | 0.66667 |
| 0.24408 | −0.02817 | 0.66667 |
| 0.24975 | 0.06541 | 0.66667 |
| 0.25242 | −0.02377 | 0.66667 |
| 0.25603 | 0.07239 | 0.66667 |
| 0.26038 | −0.01866 | 0.66667 |
| 0.26251 | 0.07919 | 0.66667 |
| 0.26805 | −0.01311 | 0.66667 |
| 0.26917 | 0.08582 | 0.66667 |
| 0.27561 | −0.00738 | 0.66667 |
| 0.27602 | 0.09226 | 0.66667 |
| 0.28304 | 0.09848 | 0.66667 |
| 0.28327 | −0.00179 | 0.66667 |
| 0.29025 | 0.10443 | 0.66667 |
| 0.29120 | 0.00331 | 0.66667 |
| 0.29775 | 0.11002 | 0.66667 |
| 0.29945 | 0.00775 | 0.66667 |
| 0.30558 | 0.11516 | 0.66667 |
| 0.30801 | 0.01151 | 0.66667 |
| 0.31382 | 0.11975 | 0.66667 |
| 0.31689 | 0.01462 | 0.66667 |
| 0.32240 | 0.12371 | 0.66667 |
| 0.32600 | 0.01715 | 0.66667 |
| 0.33122 | 0.12696 | 0.66667 |
| 0.33517 | 0.01919 | 0.66667 |
| 0.34029 | 0.12945 | 0.66667 |
| 0.34440 | 0.02074 | 0.66667 |
| 0.34961 | 0.13110 | 0.66667 |
| 0.35369 | 0.02176 | 0.66667 |
| 0.35899 | 0.13183 | 0.66667 |
| 0.36305 | 0.02218 | 0.66667 |
| 0.36833 | 0.13158 | 0.66667 |
| 0.37248 | 0.02200 | 0.66667 |
| 0.37764 | 0.13036 | 0.66667 |
| 0.38191 | 0.02120 | 0.66667 |
| 0.38686 | 0.12814 | 0.66667 |
| 0.39119 | 0.01980 | 0.66667 |
| 0.39572 | 0.12501 | 0.66667 |
| 0.40033 | 0.01781 | 0.66667 |
| 0.40423 | 0.12100 | 0.66667 |
| 0.40931 | 0.01525 | 0.66667 |
| 0.41235 | 0.11614 | 0.66667 |
| 0.41812 | 0.01206 | 0.66667 |
| 0.41995 | 0.11053 | 0.66667 |
| 0.42676 | 0.00818 | 0.66667 |
| 0.42700 | 0.10430 | 0.66667 |
| 0.43358 | 0.09750 | 0.66667 |
| 0.43507 | 0.00365 | 0.66667 |
| 0.43969 | 0.09029 | 0.66667 |
| 0.44294 | −0.00149 | 0.66667 |
| 0.44541 | 0.08278 | 0.66667 |
| 0.45040 | −0.00717 | 0.66667 |
| 0.45081 | 0.07506 | 0.66667 |
| 0.45596 | 0.06715 | 0.66667 |
| 0.45757 | −0.01327 | 0.66667 |
| 0.46088 | 0.05907 | 0.66667 |
| 0.46448 | −0.01970 | 0.66667 |
| 0.46557 | 0.05088 | 0.66667 |
| 0.47007 | 0.04258 | 0.66667 |
| 0.47112 | −0.02641 | 0.66667 |
| 0.47438 | 0.03420 | 0.66667 |
| 0.47744 | −0.03335 | 0.66667 |
| 0.47855 | 0.02574 | 0.66667 |
| 0.48258 | 0.01722 | 0.66667 |
| 0.48341 | −0.04056 | 0.66667 |
| 0.48651 | 0.00865 | 0.66667 |
| 0.48895 | −0.04808 | 0.66667 |
| 0.49036 | 0.00004 | 0.66667 |
| 0.49411 | −0.05590 | 0.66667 |
| 0.49418 | −0.00859 | 0.66667 |
| 0.49797 | −0.01723 | 0.66667 |
| 0.49900 | −0.06390 | 0.66667 |
| 0.50172 | −0.02589 | 0.66667 |

TABLE 1-continued

| X | Y | Z |
|---|---|---|
| 0.50376 | −0.07202 | 0.66667 |
| 0.50540 | −0.03457 | 0.66667 |
| 0.50844 | −0.08018 | 0.66667 |
| 0.50897 | −0.04329 | 0.66667 |
| 0.51244 | −0.05206 | 0.66667 |
| 0.51304 | −0.08839 | 0.66667 |
| 0.51579 | −0.06087 | 0.66667 |
| 0.51753 | −0.09666 | 0.66667 |
| 0.51904 | −0.06971 | 0.66667 |
| 0.52185 | −0.10502 | 0.66667 |
| 0.52185 | −0.10502 | 0.66667 |
| 0.52220 | −0.07860 | 0.66667 |
| 0.52528 | −0.08751 | 0.66667 |
| 0.52832 | −0.09643 | 0.66667 |
| 0.52960 | −0.10541 | 0.66667 |
| 0.21564 | −0.00552 | 0.69445 |
| 0.21582 | −0.01491 | 0.69445 |
| 0.21704 | 0.00375 | 0.69445 |
| 0.21933 | 0.01287 | 0.69445 |
| 0.22028 | −0.02300 | 0.69445 |
| 0.22229 | 0.02179 | 0.69445 |
| 0.22579 | 0.03046 | 0.69445 |
| 0.22887 | −0.02647 | 0.69445 |
| 0.22887 | −0.02647 | 0.69445 |
| 0.22982 | 0.03886 | 0.69445 |
| 0.23439 | 0.04699 | 0.69445 |
| 0.23825 | −0.02570 | 0.69445 |
| 0.23952 | 0.05484 | 0.69445 |
| 0.24516 | 0.06239 | 0.69445 |
| 0.24716 | −0.02255 | 0.69445 |
| 0.25118 | 0.06963 | 0.69445 |
| 0.25549 | −0.01818 | 0.69445 |
| 0.25750 | 0.07661 | 0.69445 |
| 0.26345 | −0.01314 | 0.69445 |
| 0.26403 | 0.08339 | 0.69445 |
| 0.27078 | 0.08996 | 0.69445 |
| 0.27115 | −0.00767 | 0.69445 |
| 0.27772 | 0.09631 | 0.69445 |
| 0.27874 | −0.00203 | 0.69445 |
| 0.28486 | 0.10241 | 0.69445 |
| 0.28644 | 0.00345 | 0.69445 |
| 0.29221 | 0.10823 | 0.69445 |
| 0.29444 | 0.00841 | 0.69445 |
| 0.29985 | 0.11366 | 0.69445 |
| 0.30273 | 0.01269 | 0.69445 |
| 0.30785 | 0.11862 | 0.69445 |
| 0.31134 | 0.01628 | 0.69445 |
| 0.31624 | 0.12301 | 0.69445 |
| 0.32025 | 0.01921 | 0.69445 |
| 0.32491 | 0.12670 | 0.69445 |
| 0.32938 | 0.02154 | 0.69445 |
| 0.33382 | 0.12966 | 0.69445 |
| 0.33856 | 0.02337 | 0.69445 |
| 0.34302 | 0.13183 | 0.69445 |
| 0.34780 | 0.02469 | 0.69445 |
| 0.35239 | 0.13313 | 0.69445 |
| 0.35708 | 0.02545 | 0.69445 |
| 0.36174 | 0.13345 | 0.69445 |
| 0.36643 | 0.02561 | 0.69445 |
| 0.37108 | 0.13280 | 0.69445 |
| 0.37583 | 0.02515 | 0.69445 |
| 0.38039 | 0.13116 | 0.69445 |
| 0.38519 | 0.02405 | 0.69445 |
| 0.38947 | 0.12854 | 0.69445 |
| 0.39437 | 0.02233 | 0.69445 |
| 0.39819 | 0.12503 | 0.69445 |
| 0.40338 | 0.02002 | 0.69445 |
| 0.40657 | 0.12066 | 0.69445 |
| 0.41222 | 0.01710 | 0.69445 |
| 0.41451 | 0.11551 | 0.69445 |
| 0.42087 | 0.01352 | 0.69445 |
| 0.42190 | 0.10968 | 0.69445 |
| 0.42878 | 0.10323 | 0.69445 |
| 0.42931 | 0.00926 | 0.69445 |
| 0.43519 | 0.09626 | 0.69445 |
| 0.43735 | 0.00439 | 0.69445 |
| 0.44112 | 0.08895 | 0.69445 |
| 0.44495 | −0.00107 | 0.69445 |

TABLE 1-continued

| X | Y | Z |
|---|---|---|
| 0.44664 | 0.08140 | 0.69445 |
| 0.45186 | 0.07366 | 0.69445 |
| 0.45214 | −0.00705 | 0.69445 |
| 0.45684 | 0.06577 | 0.69445 |
| 0.45903 | −0.01343 | 0.69445 |
| 0.46161 | 0.05774 | 0.69445 |
| 0.46567 | −0.02011 | 0.69445 |
| 0.46617 | 0.04958 | 0.69445 |
| 0.47055 | 0.04131 | 0.69445 |
| 0.47203 | −0.02705 | 0.69445 |
| 0.47475 | 0.03293 | 0.69445 |
| 0.47810 | −0.03421 | 0.69445 |
| 0.47882 | 0.02447 | 0.69445 |
| 0.48274 | 0.01594 | 0.69445 |
| 0.48387 | −0.04163 | 0.69445 |
| 0.48657 | 0.00736 | 0.69445 |
| 0.48927 | −0.04933 | 0.69445 |
| 0.49030 | −0.00126 | 0.69445 |
| 0.49399 | −0.00990 | 0.69445 |
| 0.49432 | −0.05731 | 0.69445 |
| 0.49765 | −0.01854 | 0.69445 |
| 0.49912 | −0.06542 | 0.69445 |
| 0.50129 | −0.02720 | 0.69445 |
| 0.50378 | −0.07361 | 0.69445 |
| 0.50485 | −0.03589 | 0.69445 |
| 0.50834 | −0.04461 | 0.69445 |
| 0.50835 | −0.08184 | 0.69445 |
| 0.51173 | −0.05337 | 0.69445 |
| 0.51284 | −0.09013 | 0.69445 |
| 0.51503 | −0.06216 | 0.69445 |
| 0.51722 | −0.09847 | 0.69445 |
| 0.51823 | −0.07098 | 0.69445 |
| 0.52135 | −0.07983 | 0.69445 |
| 0.52146 | −0.10690 | 0.69445 |
| 0.52440 | −0.08871 | 0.69445 |
| 0.52741 | −0.09761 | 0.69445 |
| 0.52913 | −0.10660 | 0.69445 |
| 0.21709 | −0.00038 | 0.72222 |
| 0.21731 | −0.00974 | 0.72222 |
| 0.21849 | 0.00885 | 0.72222 |
| 0.22079 | 0.01794 | 0.72222 |
| 0.22209 | −0.01765 | 0.72222 |
| 0.22376 | 0.02685 | 0.72222 |
| 0.22729 | 0.03555 | 0.72222 |
| 0.23046 | −0.02150 | 0.72222 |
| 0.23046 | −0.02150 | 0.72222 |
| 0.23136 | 0.04401 | 0.72222 |
| 0.23594 | 0.05214 | 0.72222 |
| 0.23982 | −0.02074 | 0.72222 |
| 0.24101 | 0.05993 | 0.72222 |
| 0.24655 | 0.06740 | 0.72222 |
| 0.24876 | −0.01770 | 0.72222 |
| 0.25248 | 0.07460 | 0.72222 |
| 0.25714 | −0.01351 | 0.72222 |
| 0.25874 | 0.08155 | 0.72222 |
| 0.26518 | −0.00867 | 0.72222 |
| 0.26526 | 0.08828 | 0.72222 |
| 0.27202 | 0.09475 | 0.72222 |
| 0.27299 | −0.00341 | 0.72222 |
| 0.27902 | 0.10097 | 0.72222 |
| 0.28070 | 0.00202 | 0.72222 |
| 0.28623 | 0.10689 | 0.72222 |
| 0.28851 | 0.00728 | 0.72222 |
| 0.29367 | 0.11248 | 0.72222 |
| 0.29662 | 0.01210 | 0.72222 |
| 0.30137 | 0.11763 | 0.72222 |
| 0.30502 | 0.01628 | 0.72222 |
| 0.30940 | 0.12227 | 0.72222 |
| 0.31368 | 0.01975 | 0.72222 |
| 0.31782 | 0.12632 | 0.72222 |
| 0.32258 | 0.02252 | 0.72222 |
| 0.32661 | 0.12971 | 0.72222 |
| 0.33169 | 0.02469 | 0.72222 |
| 0.33561 | 0.13235 | 0.72222 |
| 0.34095 | 0.02634 | 0.72222 |
| 0.34479 | 0.13419 | 0.72222 |
| 0.35023 | 0.02744 | 0.72222 |
| 0.35416 | 0.13515 | 0.72222 |

TABLE 1-continued

| X | Y | Z |
|---|---|---|
| 0.35956 | 0.02796 | 0.72222 |
| 0.36357 | 0.13516 | 0.72222 |
| 0.36890 | 0.02787 | 0.72222 |
| 0.37285 | 0.13417 | 0.72222 |
| 0.37828 | 0.02715 | 0.72222 |
| 0.38198 | 0.13220 | 0.72222 |
| 0.38755 | 0.02580 | 0.72222 |
| 0.39095 | 0.12925 | 0.72222 |
| 0.39663 | 0.02382 | 0.72222 |
| 0.39953 | 0.12543 | 0.72222 |
| 0.40552 | 0.02121 | 0.72222 |
| 0.40769 | 0.12081 | 0.72222 |
| 0.41423 | 0.01797 | 0.72222 |
| 0.41544 | 0.11543 | 0.72222 |
| 0.42267 | 0.10943 | 0.72222 |
| 0.42274 | 0.01406 | 0.72222 |
| 0.42937 | 0.10293 | 0.72222 |
| 0.43097 | 0.00950 | 0.72222 |
| 0.43561 | 0.09598 | 0.72222 |
| 0.43877 | 0.00436 | 0.72222 |
| 0.44144 | 0.08864 | 0.72222 |
| 0.44614 | −0.00134 | 0.72222 |
| 0.44693 | 0.08100 | 0.72222 |
| 0.45213 | 0.07317 | 0.72222 |
| 0.45311 | −0.00754 | 0.72222 |
| 0.45709 | 0.06522 | 0.72222 |
| 0.45979 | −0.01412 | 0.72222 |
| 0.46182 | 0.05713 | 0.72222 |
| 0.46620 | −0.02098 | 0.72222 |
| 0.46634 | 0.04892 | 0.72222 |
| 0.47067 | 0.04060 | 0.72222 |
| 0.47234 | −0.02806 | 0.72222 |
| 0.47483 | 0.03218 | 0.72222 |
| 0.47821 | −0.03535 | 0.72222 |
| 0.47882 | 0.02367 | 0.72222 |
| 0.48265 | 0.01509 | 0.72222 |
| 0.48379 | −0.04287 | 0.72222 |
| 0.48636 | 0.00645 | 0.72222 |
| 0.48905 | −0.05064 | 0.72222 |
| 0.48998 | −0.00222 | 0.72222 |
| 0.49354 | −0.01091 | 0.72222 |
| 0.49399 | −0.05864 | 0.72222 |
| 0.49710 | −0.01961 | 0.72222 |
| 0.49871 | −0.06676 | 0.72222 |
| 0.50063 | −0.02832 | 0.72222 |
| 0.50330 | −0.07496 | 0.72222 |
| 0.50412 | −0.03704 | 0.72222 |
| 0.50754 | −0.04579 | 0.72222 |
| 0.50777 | −0.08321 | 0.72222 |
| 0.51088 | −0.05457 | 0.72222 |
| 0.51216 | −0.09151 | 0.72222 |
| 0.51414 | −0.06338 | 0.72222 |
| 0.51645 | −0.09987 | 0.72222 |
| 0.51732 | −0.07223 | 0.72222 |
| 0.52043 | −0.08109 | 0.72222 |
| 0.52062 | −0.10829 | 0.72222 |
| 0.52348 | −0.08997 | 0.72222 |
| 0.52648 | −0.09887 | 0.72222 |
| 0.52826 | −0.10787 | 0.72222 |
| 0.21844 | −0.00330 | 0.75000 |
| 0.21857 | 0.00604 | 0.75000 |
| 0.22008 | 0.01522 | 0.75000 |
| 0.22246 | 0.02427 | 0.75000 |
| 0.22297 | −0.01127 | 0.75000 |
| 0.22549 | 0.03311 | 0.75000 |
| 0.22908 | 0.04175 | 0.75000 |
| 0.23078 | −0.01614 | 0.75000 |
| 0.23320 | 0.05013 | 0.75000 |
| 0.23779 | 0.05819 | 0.75000 |
| 0.24021 | −0.01578 | 0.75000 |
| 0.24287 | 0.06594 | 0.75000 |
| 0.24839 | 0.07340 | 0.75000 |
| 0.24929 | −0.01302 | 0.75000 |
| 0.25432 | 0.08059 | 0.75000 |
| 0.25783 | −0.00908 | 0.75000 |
| 0.26059 | 0.08752 | 0.75000 |
| 0.26604 | −0.00452 | 0.75000 |
| 0.26713 | 0.09416 | 0.75000 |

TABLE 1-continued

| X | Y | Z |
|---|---|---|
| 0.27398 | 0.10052 | 0.75000 |
| 0.27404 | 0.00043 | 0.75000 |
| 0.28108 | 0.10656 | 0.75000 |
| 0.28195 | 0.00555 | 0.75000 |
| 0.28841 | 0.11225 | 0.75000 |
| 0.28993 | 0.01055 | 0.75000 |
| 0.29599 | 0.11754 | 0.75000 |
| 0.29815 | 0.01514 | 0.75000 |
| 0.30388 | 0.12233 | 0.75000 |
| 0.30666 | 0.01917 | 0.75000 |
| 0.31212 | 0.12657 | 0.75000 |
| 0.31540 | 0.02250 | 0.75000 |
| 0.32076 | 0.13019 | 0.75000 |
| 0.32434 | 0.02513 | 0.75000 |
| 0.32968 | 0.13310 | 0.75000 |
| 0.33345 | 0.02712 | 0.75000 |
| 0.33875 | 0.13523 | 0.75000 |
| 0.34272 | 0.02856 | 0.75000 |
| 0.34799 | 0.13655 | 0.75000 |
| 0.35206 | 0.02943 | 0.75000 |
| 0.35739 | 0.13700 | 0.75000 |
| 0.36137 | 0.02969 | 0.75000 |
| 0.36669 | 0.13649 | 0.75000 |
| 0.37067 | 0.02935 | 0.75000 |
| 0.37586 | 0.13502 | 0.75000 |
| 0.37994 | 0.02836 | 0.75000 |
| 0.38487 | 0.13256 | 0.75000 |
| 0.38919 | 0.02672 | 0.75000 |
| 0.39363 | 0.12914 | 0.75000 |
| 0.39825 | 0.02443 | 0.75000 |
| 0.40195 | 0.12489 | 0.75000 |
| 0.40706 | 0.02151 | 0.75000 |
| 0.40984 | 0.11986 | 0.75000 |
| 0.41563 | 0.01797 | 0.75000 |
| 0.41731 | 0.11415 | 0.75000 |
| 0.42394 | 0.01379 | 0.75000 |
| 0.42426 | 0.10793 | 0.75000 |
| 0.43074 | 0.10125 | 0.75000 |
| 0.43198 | 0.00894 | 0.75000 |
| 0.43680 | 0.09418 | 0.75000 |
| 0.43962 | 0.00353 | 0.75000 |
| 0.44250 | 0.08679 | 0.75000 |
| 0.44680 | −0.00238 | 0.75000 |
| 0.44789 | 0.07912 | 0.75000 |
| 0.45301 | 0.07129 | 0.75000 |
| 0.45358 | −0.00871 | 0.75000 |
| 0.45788 | 0.06332 | 0.75000 |
| 0.46003 | −0.01540 | 0.75000 |
| 0.46254 | 0.05523 | 0.75000 |
| 0.46625 | −0.02236 | 0.75000 |
| 0.46698 | 0.04702 | 0.75000 |
| 0.47123 | 0.03870 | 0.75000 |
| 0.47221 | −0.02956 | 0.75000 |
| 0.47529 | 0.03027 | 0.75000 |
| 0.47791 | −0.03693 | 0.75000 |
| 0.47916 | 0.02176 | 0.75000 |
| 0.48287 | 0.01315 | 0.75000 |
| 0.48333 | −0.04447 | 0.75000 |
| 0.48644 | 0.00450 | 0.75000 |
| 0.48846 | −0.05219 | 0.75000 |
| 0.48991 | −0.00420 | 0.75000 |
| 0.49330 | −0.06009 | 0.75000 |
| 0.49334 | −0.01291 | 0.75000 |
| 0.49678 | −0.02162 | 0.75000 |
| 0.49792 | −0.06810 | 0.75000 |
| 0.50020 | −0.03033 | 0.75000 |
| 0.50242 | −0.07620 | 0.75000 |
| 0.50360 | −0.03906 | 0.75000 |
| 0.50680 | −0.08436 | 0.75000 |
| 0.50695 | −0.04780 | 0.75000 |
| 0.51023 | −0.05657 | 0.75000 |
| 0.51109 | −0.09259 | 0.75000 |
| 0.51345 | −0.06536 | 0.75000 |
| 0.51528 | −0.10087 | 0.75000 |
| 0.51660 | −0.07417 | 0.75000 |
| 0.51935 | −0.10922 | 0.75000 |
| 0.51935 | −0.10922 | 0.75000 |
| 0.51969 | −0.08301 | 0.75000 |

TABLE 1-continued

| X | Y | Z |
|---|---|---|
| 0.52271 | −0.09187 | 0.75000 |
| 0.52571 | −0.10074 | 0.75000 |
| 0.52701 | −0.10966 | 0.75000 |
| 0.21983 | 0.00330 | 0.77778 |
| 0.22013 | 0.01258 | 0.77778 |
| 0.22173 | 0.02171 | 0.77778 |
| 0.22390 | −0.00479 | 0.77778 |
| 0.22417 | 0.03070 | 0.77778 |
| 0.22725 | 0.03948 | 0.77778 |
| 0.23089 | 0.04804 | 0.77778 |
| 0.23135 | −0.01020 | 0.77778 |
| 0.23505 | 0.05633 | 0.77778 |
| 0.23967 | 0.06432 | 0.77778 |
| 0.24066 | −0.01026 | 0.77778 |
| 0.24475 | 0.07203 | 0.77778 |
| 0.24974 | −0.00781 | 0.77778 |
| 0.25027 | 0.07947 | 0.77778 |
| 0.25620 | 0.08663 | 0.77778 |
| 0.25837 | −0.00420 | 0.77778 |
| 0.26248 | 0.09348 | 0.77778 |
| 0.26671 | 0.00001 | 0.77778 |
| 0.26908 | 0.10003 | 0.77778 |
| 0.27486 | 0.00458 | 0.77778 |
| 0.27599 | 0.10625 | 0.77778 |
| 0.28295 | 0.00930 | 0.77778 |
| 0.28318 | 0.11206 | 0.77778 |
| 0.29062 | 0.11746 | 0.77778 |
| 0.29109 | 0.01391 | 0.77778 |
| 0.29836 | 0.12240 | 0.77778 |
| 0.29940 | 0.01819 | 0.77778 |
| 0.30645 | 0.12680 | 0.77778 |
| 0.30797 | 0.02195 | 0.77778 |
| 0.31490 | 0.13061 | 0.77778 |
| 0.31677 | 0.02508 | 0.77778 |
| 0.32371 | 0.13373 | 0.77778 |
| 0.32572 | 0.02750 | 0.77778 |
| 0.33269 | 0.13608 | 0.77778 |
| 0.33480 | 0.02928 | 0.77778 |
| 0.34182 | 0.13764 | 0.77778 |
| 0.34401 | 0.03048 | 0.77778 |
| 0.35112 | 0.13839 | 0.77778 |
| 0.35333 | 0.03109 | 0.77778 |
| 0.36044 | 0.13827 | 0.77778 |
| 0.36262 | 0.03107 | 0.77778 |
| 0.36962 | 0.13724 | 0.77778 |
| 0.37185 | 0.03042 | 0.77778 |
| 0.37865 | 0.13526 | 0.77778 |
| 0.38100 | 0.02912 | 0.77778 |
| 0.38751 | 0.13231 | 0.77778 |
| 0.39007 | 0.02717 | 0.77778 |
| 0.39601 | 0.12846 | 0.77778 |
| 0.39904 | 0.02455 | 0.77778 |
| 0.40404 | 0.12381 | 0.77778 |
| 0.40773 | 0.02132 | 0.77778 |
| 0.41165 | 0.11843 | 0.77778 |
| 0.41614 | 0.01747 | 0.77778 |
| 0.41883 | 0.11245 | 0.77778 |
| 0.42424 | 0.01303 | 0.77778 |
| 0.42551 | 0.10602 | 0.77778 |
| 0.43177 | 0.09921 | 0.77778 |
| 0.43205 | 0.00800 | 0.77778 |
| 0.43766 | 0.09206 | 0.77778 |
| 0.43953 | 0.00240 | 0.77778 |
| 0.44324 | 0.08463 | 0.77778 |
| 0.44656 | −0.00364 | 0.77778 |
| 0.44854 | 0.07695 | 0.77778 |
| 0.45318 | −0.01008 | 0.77778 |
| 0.45358 | 0.06913 | 0.77778 |
| 0.45839 | 0.06118 | 0.77778 |
| 0.45948 | −0.01682 | 0.77778 |
| 0.46300 | 0.05310 | 0.77778 |
| 0.46552 | −0.02381 | 0.77778 |
| 0.46739 | 0.04489 | 0.77778 |
| 0.47133 | −0.03103 | 0.77778 |
| 0.47156 | 0.03657 | 0.77778 |
| 0.47554 | 0.02814 | 0.77778 |
| 0.47691 | −0.03845 | 0.77778 |
| 0.47932 | 0.01963 | 0.77778 |

TABLE 1-continued

| X | Y | Z |
|---|---|---|
| 0.48226 | −0.04603 | 0.77778 |
| 0.48290 | 0.01104 | 0.77778 |
| 0.48633 | 0.00239 | 0.77778 |
| 0.48735 | −0.05376 | 0.77778 |
| 0.48967 | −0.00630 | 0.77778 |
| 0.49220 | −0.06163 | 0.77778 |
| 0.49297 | −0.01501 | 0.77778 |
| 0.49630 | −0.02370 | 0.77778 |
| 0.49685 | −0.06962 | 0.77778 |
| 0.49963 | −0.03239 | 0.77778 |
| 0.50135 | −0.07769 | 0.77778 |
| 0.50295 | −0.04108 | 0.77778 |
| 0.50572 | −0.08583 | 0.77778 |
| 0.50624 | −0.04979 | 0.77778 |
| 0.50947 | −0.05852 | 0.77778 |
| 0.50999 | −0.09404 | 0.77778 |
| 0.51266 | −0.06726 | 0.77778 |
| 0.51414 | −0.10230 | 0.77778 |
| 0.51578 | −0.07603 | 0.77778 |
| 0.51819 | −0.11063 | 0.77778 |
| 0.51819 | −0.11063 | 0.77778 |
| 0.51884 | −0.08482 | 0.77778 |
| 0.52185 | −0.09362 | 0.77778 |
| 0.52483 | −0.10244 | 0.77778 |
| 0.52586 | −0.11127 | 0.77778 |
| 0.22152 | 0.01008 | 0.80556 |
| 0.22191 | 0.01932 | 0.80556 |
| 0.22358 | 0.02843 | 0.80556 |
| 0.22491 | 0.00174 | 0.80556 |
| 0.22606 | 0.03735 | 0.80556 |
| 0.22917 | 0.04602 | 0.80556 |
| 0.23218 | −0.00383 | 0.80556 |
| 0.23283 | 0.05445 | 0.80556 |
| 0.23701 | 0.06267 | 0.80556 |
| 0.24136 | −0.00420 | 0.80556 |
| 0.24170 | 0.07066 | 0.80556 |
| 0.24681 | 0.07834 | 0.80556 |
| 0.25036 | −0.00199 | 0.80556 |
| 0.25231 | 0.08568 | 0.80556 |
| 0.25819 | 0.09269 | 0.80556 |
| 0.25902 | 0.00133 | 0.80556 |
| 0.26443 | 0.09940 | 0.80556 |
| 0.26746 | 0.00519 | 0.80556 |
| 0.27105 | 0.10578 | 0.80556 |
| 0.27576 | 0.00938 | 0.80556 |
| 0.27807 | 0.11182 | 0.80556 |
| 0.28401 | 0.01367 | 0.80556 |
| 0.28541 | 0.11742 | 0.80556 |
| 0.29229 | 0.01787 | 0.80556 |
| 0.29306 | 0.12253 | 0.80556 |
| 0.30073 | 0.02176 | 0.80556 |
| 0.30104 | 0.12710 | 0.80556 |
| 0.30932 | 0.02516 | 0.80556 |
| 0.30937 | 0.13108 | 0.80556 |
| 0.31804 | 0.13438 | 0.80556 |
| 0.31807 | 0.02797 | 0.80556 |
| 0.32691 | 0.13688 | 0.80556 |
| 0.32700 | 0.03011 | 0.80556 |
| 0.33594 | 0.13861 | 0.80556 |
| 0.33610 | 0.03162 | 0.80556 |
| 0.34514 | 0.13952 | 0.80556 |
| 0.34534 | 0.03253 | 0.80556 |
| 0.35441 | 0.13959 | 0.80556 |
| 0.35457 | 0.03282 | 0.80556 |
| 0.36356 | 0.13880 | 0.80556 |
| 0.36374 | 0.03248 | 0.80556 |
| 0.37259 | 0.13713 | 0.80556 |
| 0.37286 | 0.03147 | 0.80556 |
| 0.38149 | 0.13456 | 0.80556 |
| 0.38192 | 0.02978 | 0.80556 |
| 0.39008 | 0.13109 | 0.80556 |
| 0.39089 | 0.02740 | 0.80556 |
| 0.39823 | 0.12681 | 0.80556 |
| 0.39964 | 0.02437 | 0.80556 |
| 0.40597 | 0.12178 | 0.80556 |
| 0.40810 | 0.02076 | 0.80556 |
| 0.41330 | 0.11609 | 0.80556 |
| 0.41631 | 0.01658 | 0.80556 |

TABLE 1-continued

| X | Y | Z |
|---|---|---|
| 0.42015 | 0.10991 | 0.80556 |
| 0.42424 | 0.01183 | 0.80556 |
| 0.42656 | 0.10334 | 0.80556 |
| 0.43187 | 0.00654 | 0.80556 |
| 0.43261 | 0.09642 | 0.80556 |
| 0.43834 | 0.08920 | 0.80556 |
| 0.43910 | 0.00081 | 0.80556 |
| 0.44379 | 0.08174 | 0.80556 |
| 0.44593 | −0.00533 | 0.80556 |
| 0.44897 | 0.07408 | 0.80556 |
| 0.45241 | −0.01183 | 0.80556 |
| 0.45392 | 0.06630 | 0.80556 |
| 0.45858 | −0.01864 | 0.80556 |
| 0.45866 | 0.05837 | 0.80556 |
| 0.46318 | 0.05034 | 0.80556 |
| 0.46451 | −0.02571 | 0.80556 |
| 0.46750 | 0.04217 | 0.80556 |
| 0.47020 | −0.03300 | 0.80556 |
| 0.47161 | 0.03389 | 0.80556 |
| 0.47551 | 0.02551 | 0.80556 |
| 0.47566 | −0.04043 | 0.80556 |
| 0.47920 | 0.01704 | 0.80556 |
| 0.48091 | −0.04800 | 0.80556 |
| 0.48268 | 0.00848 | 0.80556 |
| 0.48596 | −0.05569 | 0.80556 |
| 0.48600 | −0.00014 | 0.80556 |
| 0.48924 | −0.00880 | 0.80556 |
| 0.49082 | −0.06349 | 0.80556 |
| 0.49245 | −0.01746 | 0.80556 |
| 0.49552 | −0.07139 | 0.80556 |
| 0.49570 | −0.02611 | 0.80556 |
| 0.49896 | −0.03476 | 0.80556 |
| 0.50005 | −0.07938 | 0.80556 |
| 0.50223 | −0.04340 | 0.80556 |
| 0.50442 | −0.08746 | 0.80556 |
| 0.50546 | −0.05206 | 0.80556 |
| 0.50867 | −0.06072 | 0.80556 |
| 0.50868 | −0.09563 | 0.80556 |
| 0.51182 | −0.06941 | 0.80556 |
| 0.51282 | −0.10386 | 0.80556 |
| 0.51492 | −0.07811 | 0.80556 |
| 0.51686 | −0.11215 | 0.80556 |
| 0.51686 | −0.11215 | 0.80556 |
| 0.51796 | −0.08684 | 0.80556 |
| 0.52095 | −0.09558 | 0.80556 |
| 0.52391 | −0.10434 | 0.80556 |
| 0.52456 | −0.11307 | 0.80556 |
| 0.22367 | 0.02352 | 0.83333 |
| 0.22369 | 0.01431 | 0.83333 |
| 0.22369 | 0.01431 | 0.83333 |
| 0.22507 | 0.03261 | 0.83333 |
| 0.22735 | 0.04154 | 0.83333 |
| 0.22795 | 0.00644 | 0.83333 |
| 0.23029 | 0.05019 | 0.83333 |
| 0.23381 | 0.05863 | 0.83333 |
| 0.23585 | 0.00209 | 0.83333 |
| 0.23788 | 0.06685 | 0.83333 |
| 0.24244 | 0.07484 | 0.83333 |
| 0.24500 | 0.00278 | 0.83333 |
| 0.24743 | 0.08254 | 0.83333 |
| 0.25284 | 0.08990 | 0.83333 |
| 0.25386 | 0.00527 | 0.83333 |
| 0.25868 | 0.09695 | 0.83333 |
| 0.26248 | 0.00854 | 0.83333 |
| 0.26493 | 0.10368 | 0.83333 |
| 0.27093 | 0.01219 | 0.83333 |
| 0.27158 | 0.11003 | 0.83333 |
| 0.27858 | 0.11592 | 0.83333 |
| 0.27930 | 0.01604 | 0.83333 |
| 0.28593 | 0.12133 | 0.83333 |
| 0.28766 | 0.01990 | 0.83333 |
| 0.29365 | 0.12621 | 0.83333 |
| 0.29610 | 0.02361 | 0.83333 |
| 0.30178 | 0.13054 | 0.83333 |
| 0.30468 | 0.02697 | 0.83333 |
| 0.31022 | 0.13418 | 0.83333 |
| 0.31339 | 0.02984 | 0.83333 |
| 0.31889 | 0.13705 | 0.83333 |

TABLE 1-continued

| X | Y | Z |
|---|---|---|
| 0.32223 | 0.03209 | 0.83333 |
| 0.32780 | 0.13912 | 0.83333 |
| 0.33119 | 0.03367 | 0.83333 |
| 0.33694 | 0.14037 | 0.83333 |
| 0.34027 | 0.03465 | 0.83333 |
| 0.34610 | 0.14077 | 0.83333 |
| 0.34947 | 0.03501 | 0.83333 |
| 0.35520 | 0.14029 | 0.83333 |
| 0.35862 | 0.03474 | 0.83333 |
| 0.36426 | 0.13895 | 0.83333 |
| 0.36766 | 0.03381 | 0.83333 |
| 0.37322 | 0.13675 | 0.83333 |
| 0.37658 | 0.03218 | 0.83333 |
| 0.38186 | 0.13374 | 0.83333 |
| 0.38538 | 0.02983 | 0.83333 |
| 0.39018 | 0.12994 | 0.83333 |
| 0.39407 | 0.02676 | 0.83333 |
| 0.39817 | 0.12538 | 0.83333 |
| 0.40248 | 0.02307 | 0.83333 |
| 0.40574 | 0.12016 | 0.83333 |
| 0.41061 | 0.01885 | 0.83333 |
| 0.41284 | 0.11441 | 0.83333 |
| 0.41847 | 0.01414 | 0.83333 |
| 0.41952 | 0.10821 | 0.83333 |
| 0.42584 | 0.10159 | 0.83333 |
| 0.42606 | 0.00895 | 0.83333 |
| 0.43182 | 0.09462 | 0.83333 |
| 0.43333 | 0.00333 | 0.83333 |
| 0.43748 | 0.08740 | 0.83333 |
| 0.44024 | −0.00266 | 0.83333 |
| 0.44282 | 0.08000 | 0.83333 |
| 0.44678 | −0.00899 | 0.83333 |
| 0.44790 | 0.07244 | 0.83333 |
| 0.45276 | 0.06475 | 0.83333 |
| 0.45300 | −0.01563 | 0.83333 |
| 0.45742 | 0.05694 | 0.83333 |
| 0.45894 | −0.02254 | 0.83333 |
| 0.46187 | 0.04903 | 0.83333 |
| 0.46462 | −0.02968 | 0.83333 |
| 0.46614 | 0.04098 | 0.83333 |
| 0.47010 | −0.03702 | 0.83333 |
| 0.47022 | 0.03283 | 0.83333 |
| 0.47410 | 0.02456 | 0.83333 |
| 0.47538 | −0.04452 | 0.83333 |
| 0.47778 | 0.01618 | 0.83333 |
| 0.48049 | −0.05210 | 0.83333 |
| 0.48125 | 0.00771 | 0.83333 |
| 0.48456 | −0.00084 | 0.83333 |
| 0.48548 | −0.05977 | 0.83333 |
| 0.48776 | −0.00943 | 0.83333 |
| 0.49035 | −0.06751 | 0.83333 |
| 0.49092 | −0.01803 | 0.83333 |
| 0.49412 | −0.02662 | 0.83333 |
| 0.49508 | −0.07533 | 0.83333 |
| 0.49734 | −0.03520 | 0.83333 |
| 0.49962 | −0.08326 | 0.83333 |
| 0.50057 | −0.04377 | 0.83333 |
| 0.50379 | −0.05235 | 0.83333 |
| 0.50400 | −0.09128 | 0.83333 |
| 0.50697 | −0.06094 | 0.83333 |
| 0.50823 | −0.09940 | 0.83333 |
| 0.51011 | −0.06955 | 0.83333 |
| 0.51234 | −0.10758 | 0.83333 |
| 0.51321 | −0.07817 | 0.83333 |
| 0.51625 | −0.08681 | 0.83333 |
| 0.51686 | −0.11548 | 0.83333 |
| 0.51923 | −0.09547 | 0.83333 |
| 0.52218 | −0.10415 | 0.83333 |
| 0.52425 | −0.11294 | 0.83333 |
| 0.22552 | 0.02640 | 0.86112 |
| 0.22641 | 0.03544 | 0.86112 |
| 0.22666 | 0.01741 | 0.86112 |
| 0.22834 | 0.04439 | 0.86112 |
| 0.23101 | 0.05312 | 0.86112 |
| 0.23253 | 0.01068 | 0.86112 |
| 0.23431 | 0.06164 | 0.86112 |
| 0.23816 | 0.06987 | 0.86112 |
| 0.24129 | 0.00891 | 0.86112 |

TABLE 1-continued

| X | Y | Z |
|---|---|---|
| 0.24248 | 0.07781 | 0.86112 |
| 0.24727 | 0.08546 | 0.86112 |
| 0.25020 | 0.01061 | 0.86112 |
| 0.25251 | 0.09285 | 0.86112 |
| 0.25821 | 0.09995 | 0.86112 |
| 0.25888 | 0.01338 | 0.86112 |
| 0.26436 | 0.10670 | 0.86112 |
| 0.26741 | 0.01659 | 0.86112 |
| 0.27093 | 0.11304 | 0.86112 |
| 0.27586 | 0.02000 | 0.86112 |
| 0.27791 | 0.11891 | 0.86112 |
| 0.28430 | 0.02347 | 0.86112 |
| 0.28530 | 0.12427 | 0.86112 |
| 0.29277 | 0.02685 | 0.86112 |
| 0.29308 | 0.12906 | 0.86112 |
| 0.30123 | 0.13319 | 0.86112 |
| 0.30133 | 0.02997 | 0.86112 |
| 0.30970 | 0.13661 | 0.86112 |
| 0.30998 | 0.03267 | 0.86112 |
| 0.31840 | 0.13922 | 0.86112 |
| 0.31873 | 0.03483 | 0.86112 |
| 0.32726 | 0.14098 | 0.86112 |
| 0.32759 | 0.03639 | 0.86112 |
| 0.33628 | 0.14187 | 0.86112 |
| 0.33658 | 0.03730 | 0.86112 |
| 0.34541 | 0.14189 | 0.86112 |
| 0.34567 | 0.03760 | 0.86112 |
| 0.35441 | 0.14101 | 0.86112 |
| 0.35479 | 0.03729 | 0.86112 |
| 0.36328 | 0.13928 | 0.86112 |
| 0.36379 | 0.03631 | 0.86112 |
| 0.37202 | 0.13671 | 0.86112 |
| 0.37267 | 0.03462 | 0.86112 |
| 0.38049 | 0.13338 | 0.86112 |
| 0.38144 | 0.03220 | 0.86112 |
| 0.38859 | 0.12935 | 0.86112 |
| 0.39001 | 0.02903 | 0.86112 |
| 0.39636 | 0.12467 | 0.86112 |
| 0.39825 | 0.02520 | 0.86112 |
| 0.40380 | 0.11939 | 0.86112 |
| 0.40619 | 0.02082 | 0.86112 |
| 0.41080 | 0.11366 | 0.86112 |
| 0.41389 | 0.01598 | 0.86112 |
| 0.41740 | 0.10752 | 0.86112 |
| 0.42133 | 0.01072 | 0.86112 |
| 0.42363 | 0.10102 | 0.86112 |
| 0.42847 | 0.00510 | 0.86112 |
| 0.42955 | 0.09418 | 0.86112 |
| 0.43516 | 0.08707 | 0.86112 |
| 0.43530 | −0.00082 | 0.86112 |
| 0.44051 | 0.07971 | 0.86112 |
| 0.44182 | −0.00705 | 0.86112 |
| 0.44559 | 0.07220 | 0.86112 |
| 0.44803 | −0.01358 | 0.86112 |
| 0.45044 | 0.06455 | 0.86112 |
| 0.45397 | −0.02039 | 0.86112 |
| 0.45510 | 0.05678 | 0.86112 |
| 0.45957 | 0.04889 | 0.86112 |
| 0.45966 | −0.02745 | 0.86112 |
| 0.46387 | 0.04089 | 0.86112 |
| 0.46512 | −0.03473 | 0.86112 |
| 0.46798 | 0.03280 | 0.86112 |
| 0.47037 | −0.04216 | 0.86112 |
| 0.47189 | 0.02462 | 0.86112 |
| 0.47548 | −0.04970 | 0.86112 |
| 0.47562 | 0.01635 | 0.86112 |
| 0.47913 | 0.00800 | 0.86112 |
| 0.48049 | −0.05730 | 0.86112 |
| 0.48247 | −0.00044 | 0.86112 |
| 0.48547 | −0.06493 | 0.86112 |
| 0.48566 | −0.00893 | 0.86112 |
| 0.48882 | −0.01745 | 0.86112 |
| 0.49037 | −0.07259 | 0.86112 |
| 0.49198 | −0.02596 | 0.86112 |
| 0.49512 | −0.08034 | 0.86112 |
| 0.49517 | −0.03447 | 0.86112 |
| 0.49837 | −0.04296 | 0.86112 |
| 0.49967 | −0.08820 | 0.86112 |

TABLE 1-continued

| X | Y | Z |
|---|---|---|
| 0.50157 | −0.05146 | 0.86112 |
| 0.50403 | −0.09618 | 0.86112 |
| 0.50476 | −0.05996 | 0.86112 |
| 0.50790 | −0.06848 | 0.86112 |
| 0.50822 | −0.10425 | 0.86112 |
| 0.51100 | −0.07701 | 0.86112 |
| 0.51231 | −0.11238 | 0.86112 |
| 0.51404 | −0.08557 | 0.86112 |
| 0.51703 | −0.09415 | 0.86112 |
| 0.51859 | −0.11793 | 0.86112 |
| 0.51999 | −0.10273 | 0.86112 |
| 0.52291 | −0.11133 | 0.86112 |
| 0.52291 | −0.11133 | 0.86112 |
| 0.22741 | 0.03045 | 0.88889 |
| 0.22776 | 0.03947 | 0.88889 |
| 0.22941 | 0.04838 | 0.88889 |
| 0.23010 | 0.02197 | 0.88889 |
| 0.23188 | 0.05711 | 0.88889 |
| 0.23503 | 0.06562 | 0.88889 |
| 0.23737 | 0.01700 | 0.88889 |
| 0.23876 | 0.07384 | 0.88889 |
| 0.24299 | 0.08176 | 0.88889 |
| 0.24634 | 0.01719 | 0.88889 |
| 0.24772 | 0.08938 | 0.88889 |
| 0.25290 | 0.09671 | 0.88889 |
| 0.25509 | 0.01930 | 0.88889 |
| 0.25858 | 0.10374 | 0.88889 |
| 0.26370 | 0.02203 | 0.88889 |
| 0.26472 | 0.11041 | 0.88889 |
| 0.27130 | 0.11664 | 0.88889 |
| 0.27223 | 0.02499 | 0.88889 |
| 0.27832 | 0.12238 | 0.88889 |
| 0.28074 | 0.02802 | 0.88889 |
| 0.28575 | 0.12757 | 0.88889 |
| 0.28927 | 0.03097 | 0.88889 |
| 0.29359 | 0.13214 | 0.88889 |
| 0.29788 | 0.03371 | 0.88889 |
| 0.30180 | 0.13602 | 0.88889 |
| 0.30658 | 0.03613 | 0.88889 |
| 0.31031 | 0.13913 | 0.88889 |
| 0.31535 | 0.03808 | 0.88889 |
| 0.31908 | 0.14141 | 0.88889 |
| 0.32417 | 0.03948 | 0.88889 |
| 0.32796 | 0.14279 | 0.88889 |
| 0.33305 | 0.04025 | 0.88889 |
| 0.33692 | 0.14326 | 0.88889 |
| 0.34201 | 0.04041 | 0.88889 |
| 0.34596 | 0.14283 | 0.88889 |
| 0.35102 | 0.03995 | 0.88889 |
| 0.35487 | 0.14151 | 0.88889 |
| 0.35997 | 0.03885 | 0.88889 |
| 0.36358 | 0.13934 | 0.88889 |
| 0.36875 | 0.03710 | 0.88889 |
| 0.37209 | 0.13636 | 0.88889 |
| 0.37737 | 0.03464 | 0.88889 |
| 0.38033 | 0.13266 | 0.88889 |
| 0.38581 | 0.03146 | 0.88889 |
| 0.38818 | 0.12835 | 0.88889 |
| 0.39397 | 0.02759 | 0.88889 |
| 0.39569 | 0.12347 | 0.88889 |
| 0.40176 | 0.02315 | 0.88889 |
| 0.40287 | 0.11808 | 0.88889 |
| 0.40924 | 0.01825 | 0.88889 |
| 0.40973 | 0.11222 | 0.88889 |
| 0.41622 | 0.10601 | 0.88889 |
| 0.41646 | 0.01296 | 0.88889 |
| 0.42236 | 0.09950 | 0.88889 |
| 0.42344 | 0.00731 | 0.88889 |
| 0.42815 | 0.09272 | 0.88889 |
| 0.43020 | 0.00135 | 0.88889 |
| 0.43365 | 0.08569 | 0.88889 |
| 0.43669 | −0.00489 | 0.88889 |
| 0.43890 | 0.07844 | 0.88889 |
| 0.44291 | −0.01139 | 0.88889 |
| 0.44390 | 0.07100 | 0.88889 |
| 0.44870 | 0.06341 | 0.88889 |
| 0.44887 | −0.01812 | 0.88889 |
| 0.45332 | 0.05569 | 0.88889 |

TABLE 1-continued

| X | Y | Z |
|---|---|---|
| 0.45457 | −0.02510 | 0.88889 |
| 0.45776 | 0.04788 | 0.88889 |
| 0.46003 | −0.03228 | 0.88889 |
| 0.46203 | 0.03997 | 0.88889 |
| 0.46526 | −0.03961 | 0.88889 |
| 0.46612 | 0.03196 | 0.88889 |
| 0.47004 | 0.02388 | 0.88889 |
| 0.47031 | −0.04707 | 0.88889 |
| 0.47377 | 0.01571 | 0.88889 |
| 0.47527 | −0.05459 | 0.88889 |
| 0.47730 | 0.00746 | 0.88889 |
| 0.48023 | −0.06213 | 0.88889 |
| 0.48065 | −0.00086 | 0.88889 |
| 0.48386 | −0.00924 | 0.88889 |
| 0.48522 | −0.06963 | 0.88889 |
| 0.48700 | −0.01765 | 0.88889 |
| 0.49012 | −0.02607 | 0.88889 |
| 0.49016 | −0.07717 | 0.88889 |
| 0.49328 | −0.03447 | 0.88889 |
| 0.49491 | −0.08482 | 0.88889 |
| 0.49646 | −0.04286 | 0.88889 |
| 0.49947 | −0.09258 | 0.88889 |
| 0.49963 | −0.05126 | 0.88889 |
| 0.50280 | −0.05966 | 0.88889 |
| 0.50380 | −0.10048 | 0.88889 |
| 0.50594 | −0.06806 | 0.88889 |
| 0.50796 | −0.10848 | 0.88889 |
| 0.50904 | −0.07649 | 0.88889 |
| 0.51203 | −0.11653 | 0.88889 |
| 0.51203 | −0.11653 | 0.88889 |
| 0.51209 | −0.08494 | 0.88889 |
| 0.51507 | −0.09339 | 0.88889 |
| 0.51802 | −0.10188 | 0.88889 |
| 0.51973 | −0.11848 | 0.88889 |
| 0.52095 | −0.11036 | 0.88889 |
| 0.22880 | 0.04002 | 0.91667 |
| 0.22934 | 0.04891 | 0.91667 |
| 0.23121 | 0.05767 | 0.91667 |
| 0.23128 | 0.03158 | 0.91667 |
| 0.23392 | 0.06621 | 0.91667 |
| 0.23731 | 0.07450 | 0.91667 |
| 0.23846 | 0.02665 | 0.91667 |
| 0.24126 | 0.08248 | 0.91667 |
| 0.24574 | 0.09011 | 0.91667 |
| 0.24734 | 0.02659 | 0.91667 |
| 0.25071 | 0.09744 | 0.91667 |
| 0.25608 | 0.02829 | 0.91667 |
| 0.25618 | 0.10446 | 0.91667 |
| 0.26213 | 0.11113 | 0.91667 |
| 0.26472 | 0.03055 | 0.91667 |
| 0.26849 | 0.11733 | 0.91667 |
| 0.27331 | 0.03298 | 0.91667 |
| 0.27525 | 0.12302 | 0.91667 |
| 0.28189 | 0.03542 | 0.91667 |
| 0.28240 | 0.12818 | 0.91667 |
| 0.29000 | 0.13277 | 0.91667 |
| 0.29052 | 0.03772 | 0.91667 |
| 0.29806 | 0.13674 | 0.91667 |
| 0.29919 | 0.03978 | 0.91667 |
| 0.30645 | 0.13995 | 0.91667 |
| 0.30796 | 0.04148 | 0.91667 |
| 0.31509 | 0.14235 | 0.91667 |
| 0.31675 | 0.04274 | 0.91667 |
| 0.32394 | 0.14387 | 0.91667 |
| 0.32555 | 0.04347 | 0.91667 |
| 0.33284 | 0.14446 | 0.91667 |
| 0.33436 | 0.04361 | 0.91667 |
| 0.34172 | 0.14413 | 0.91667 |
| 0.34320 | 0.04316 | 0.91667 |
| 0.35057 | 0.14291 | 0.91667 |
| 0.35204 | 0.04210 | 0.91667 |
| 0.35927 | 0.14084 | 0.91667 |
| 0.36080 | 0.04044 | 0.91667 |
| 0.36769 | 0.13797 | 0.91667 |
| 0.36933 | 0.03816 | 0.91667 |
| 0.37584 | 0.13438 | 0.91667 |
| 0.37764 | 0.03527 | 0.91667 |
| 0.38373 | 0.13012 | 0.91667 |

TABLE 1-continued

| X | Y | Z |
|---|---|---|
| 0.38571 | 0.03176 | 0.91667 |
| 0.39127 | 0.12530 | 0.91667 |
| 0.39355 | 0.02762 | 0.91667 |
| 0.39847 | 0.11998 | 0.91667 |
| 0.40114 | 0.02290 | 0.91667 |
| 0.40531 | 0.11425 | 0.91667 |
| 0.40844 | 0.01774 | 0.91667 |
| 0.41178 | 0.10817 | 0.91667 |
| 0.41546 | 0.01223 | 0.91667 |
| 0.41792 | 0.10181 | 0.91667 |
| 0.42223 | 0.00639 | 0.91667 |
| 0.42376 | 0.09517 | 0.91667 |
| 0.42875 | 0.00028 | 0.91667 |
| 0.42932 | 0.08828 | 0.91667 |
| 0.43463 | 0.08115 | 0.91667 |
| 0.43503 | −0.00607 | 0.91667 |
| 0.43970 | 0.07382 | 0.91667 |
| 0.44107 | −0.01262 | 0.91667 |
| 0.44455 | 0.06634 | 0.91667 |
| 0.44690 | −0.01939 | 0.91667 |
| 0.44920 | 0.05875 | 0.91667 |
| 0.45249 | −0.02636 | 0.91667 |
| 0.45368 | 0.05106 | 0.91667 |
| 0.45784 | −0.03352 | 0.91667 |
| 0.45799 | 0.04328 | 0.91667 |
| 0.46215 | 0.03541 | 0.91667 |
| 0.46299 | −0.04083 | 0.91667 |
| 0.46615 | 0.02745 | 0.91667 |
| 0.46797 | −0.04825 | 0.91667 |
| 0.47000 | 0.01941 | 0.91667 |
| 0.47286 | −0.05573 | 0.91667 |
| 0.47366 | 0.01129 | 0.91667 |
| 0.47715 | 0.00309 | 0.91667 |
| 0.47779 | −0.06319 | 0.91667 |
| 0.48045 | −0.00518 | 0.91667 |
| 0.48280 | −0.07059 | 0.91667 |
| 0.48362 | −0.01351 | 0.91667 |
| 0.48673 | −0.02186 | 0.91667 |
| 0.48779 | −0.07801 | 0.91667 |
| 0.48985 | −0.03021 | 0.91667 |
| 0.49263 | −0.08552 | 0.91667 |
| 0.49300 | −0.03854 | 0.91667 |
| 0.49616 | −0.04686 | 0.91667 |
| 0.49726 | −0.09315 | 0.91667 |
| 0.49934 | −0.05519 | 0.91667 |
| 0.50166 | −0.10092 | 0.91667 |
| 0.50250 | −0.06351 | 0.91667 |
| 0.50564 | −0.07185 | 0.91667 |
| 0.50585 | −0.10881 | 0.91667 |
| 0.50873 | −0.08020 | 0.91667 |
| 0.50994 | −0.11677 | 0.91667 |
| 0.51177 | −0.08857 | 0.91667 |
| 0.51476 | −0.09697 | 0.91667 |
| 0.51692 | −0.12084 | 0.91667 |
| 0.51770 | −0.10537 | 0.91667 |
| 0.52062 | −0.11380 | 0.91667 |
| 0.52062 | −0.11380 | 0.91667 |
| 0.23010 | 0.04814 | 0.94445 |
| 0.23028 | 0.05697 | 0.94445 |
| 0.23213 | 0.06562 | 0.94445 |
| 0.23396 | 0.04041 | 0.94445 |
| 0.23494 | 0.07402 | 0.94445 |
| 0.23851 | 0.08216 | 0.94445 |
| 0.24202 | 0.03717 | 0.94445 |
| 0.24269 | 0.08999 | 0.94445 |
| 0.24743 | 0.09744 | 0.94445 |
| 0.25084 | 0.03738 | 0.94445 |
| 0.25266 | 0.10453 | 0.94445 |
| 0.25841 | 0.11127 | 0.94445 |
| 0.25958 | 0.03872 | 0.94445 |
| 0.26461 | 0.11757 | 0.94445 |
| 0.26827 | 0.04043 | 0.94445 |
| 0.27121 | 0.12336 | 0.94445 |
| 0.27694 | 0.04221 | 0.94445 |
| 0.27823 | 0.12862 | 0.94445 |
| 0.28563 | 0.04389 | 0.94445 |
| 0.28567 | 0.13332 | 0.94445 |
| 0.29355 | 0.13742 | 0.94445 |

TABLE 1-continued

| X | Y | Z |
|---|---|---|
| 0.29435 | 0.04535 | 0.94445 |
| 0.30177 | 0.14077 | 0.94445 |
| 0.30312 | 0.04651 | 0.94445 |
| 0.31028 | 0.14334 | 0.94445 |
| 0.31194 | 0.04727 | 0.94445 |
| 0.31900 | 0.14505 | 0.94445 |
| 0.32077 | 0.04757 | 0.94445 |
| 0.32779 | 0.14587 | 0.94445 |
| 0.32953 | 0.04736 | 0.94445 |
| 0.33658 | 0.14578 | 0.94445 |
| 0.33825 | 0.04660 | 0.94445 |
| 0.34535 | 0.14477 | 0.94445 |
| 0.34690 | 0.04529 | 0.94445 |
| 0.35401 | 0.14290 | 0.94445 |
| 0.35549 | 0.04340 | 0.94445 |
| 0.36241 | 0.14026 | 0.94445 |
| 0.36399 | 0.04094 | 0.94445 |
| 0.37056 | 0.13687 | 0.94445 |
| 0.37226 | 0.03792 | 0.94445 |
| 0.37844 | 0.13282 | 0.94445 |
| 0.38026 | 0.03437 | 0.94445 |
| 0.38594 | 0.12821 | 0.94445 |
| 0.38800 | 0.03030 | 0.94445 |
| 0.39308 | 0.12313 | 0.94445 |
| 0.39548 | 0.02573 | 0.94445 |
| 0.39990 | 0.11762 | 0.94445 |
| 0.40274 | 0.02069 | 0.94445 |
| 0.40642 | 0.11170 | 0.94445 |
| 0.40973 | 0.01528 | 0.94445 |
| 0.41266 | 0.10543 | 0.94445 |
| 0.41645 | 0.00955 | 0.94445 |
| 0.41859 | 0.09890 | 0.94445 |
| 0.42291 | 0.00354 | 0.94445 |
| 0.42424 | 0.09212 | 0.94445 |
| 0.42917 | −0.00271 | 0.94445 |
| 0.42962 | 0.08512 | 0.94445 |
| 0.43476 | 0.07793 | 0.94445 |
| 0.43520 | −0.00917 | 0.94445 |
| 0.43967 | 0.07059 | 0.94445 |
| 0.44103 | −0.01582 | 0.94445 |
| 0.44437 | 0.06312 | 0.94445 |
| 0.44665 | −0.02263 | 0.94445 |
| 0.44889 | 0.05555 | 0.94445 |
| 0.45208 | −0.02962 | 0.94445 |
| 0.45325 | 0.04790 | 0.94445 |
| 0.45729 | −0.03677 | 0.94445 |
| 0.45748 | 0.04016 | 0.94445 |
| 0.46156 | 0.03234 | 0.94445 |
| 0.46231 | −0.04405 | 0.94445 |
| 0.46550 | 0.02445 | 0.94445 |
| 0.46720 | −0.05143 | 0.94445 |
| 0.46930 | 0.01648 | 0.94445 |
| 0.47203 | −0.05884 | 0.94445 |
| 0.47294 | 0.00844 | 0.94445 |
| 0.47639 | 0.00032 | 0.94445 |
| 0.47694 | −0.06620 | 0.94445 |
| 0.47967 | −0.00787 | 0.94445 |
| 0.48195 | −0.07350 | 0.94445 |
| 0.48283 | −0.01611 | 0.94445 |
| 0.48591 | −0.02437 | 0.94445 |
| 0.48694 | −0.08080 | 0.94445 |
| 0.48901 | −0.03264 | 0.94445 |
| 0.49178 | −0.08822 | 0.94445 |
| 0.49213 | −0.04088 | 0.94445 |
| 0.49527 | −0.04912 | 0.94445 |
| 0.49638 | −0.09576 | 0.94445 |
| 0.49843 | −0.05736 | 0.94445 |
| 0.50077 | −0.10344 | 0.94445 |
| 0.50160 | −0.06560 | 0.94445 |
| 0.50474 | −0.07384 | 0.94445 |
| 0.50495 | −0.11124 | 0.94445 |
| 0.50784 | −0.08210 | 0.94445 |
| 0.50904 | −0.11911 | 0.94445 |
| 0.51089 | −0.09038 | 0.94445 |
| 0.51388 | −0.09868 | 0.94445 |
| 0.51628 | −0.12247 | 0.94445 |
| 0.51682 | −0.10699 | 0.94445 |
| 0.51973 | −0.11531 | 0.94445 |

TABLE 1-continued

| X | Y | Z |
|---|---|---|
| 0.51973 | −0.11531 | 0.94445 |
| 0.23104 | 0.06535 | 0.97222 |
| 0.23170 | 0.05667 | 0.97222 |
| 0.23274 | 0.07391 | 0.97222 |
| 0.23564 | 0.08220 | 0.97222 |
| 0.23730 | 0.05022 | 0.97222 |
| 0.23937 | 0.09015 | 0.97222 |
| 0.24375 | 0.09777 | 0.97222 |
| 0.24579 | 0.04823 | 0.97222 |
| 0.24874 | 0.10501 | 0.97222 |
| 0.25426 | 0.11185 | 0.97222 |
| 0.25452 | 0.04834 | 0.97222 |
| 0.26026 | 0.11825 | 0.97222 |
| 0.26326 | 0.04916 | 0.97222 |
| 0.26673 | 0.12419 | 0.97222 |
| 0.27197 | 0.05019 | 0.97222 |
| 0.27363 | 0.12961 | 0.97222 |
| 0.28070 | 0.05122 | 0.97222 |
| 0.28095 | 0.13445 | 0.97222 |
| 0.28866 | 0.13867 | 0.97222 |
| 0.28942 | 0.05204 | 0.97222 |
| 0.29670 | 0.14218 | 0.97222 |
| 0.29818 | 0.05258 | 0.97222 |
| 0.30505 | 0.14493 | 0.97222 |
| 0.30695 | 0.05276 | 0.97222 |
| 0.31361 | 0.14685 | 0.97222 |
| 0.31572 | 0.05254 | 0.97222 |
| 0.32233 | 0.14789 | 0.97222 |
| 0.32445 | 0.05187 | 0.97222 |
| 0.33111 | 0.14806 | 0.97222 |
| 0.33312 | 0.05071 | 0.97222 |
| 0.33977 | 0.14732 | 0.97222 |
| 0.34173 | 0.04905 | 0.97222 |
| 0.34832 | 0.14571 | 0.97222 |
| 0.35021 | 0.04687 | 0.97222 |
| 0.35673 | 0.14327 | 0.97222 |
| 0.35855 | 0.04417 | 0.97222 |
| 0.36490 | 0.14009 | 0.97222 |
| 0.36671 | 0.04096 | 0.97222 |
| 0.37278 | 0.13624 | 0.97222 |
| 0.37465 | 0.03726 | 0.97222 |
| 0.38035 | 0.13180 | 0.97222 |
| 0.38236 | 0.03311 | 0.97222 |
| 0.38760 | 0.12684 | 0.97222 |
| 0.38984 | 0.02854 | 0.97222 |
| 0.39451 | 0.12144 | 0.97222 |
| 0.39706 | 0.02358 | 0.97222 |
| 0.40110 | 0.11565 | 0.97222 |
| 0.40403 | 0.01826 | 0.97222 |
| 0.40738 | 0.10951 | 0.97222 |
| 0.41075 | 0.01263 | 0.97222 |
| 0.41336 | 0.10307 | 0.97222 |
| 0.41722 | 0.00672 | 0.97222 |
| 0.41906 | 0.09640 | 0.97222 |
| 0.42345 | 0.00056 | 0.97222 |
| 0.42449 | 0.08953 | 0.97222 |
| 0.42947 | −0.00582 | 0.97222 |
| 0.42967 | 0.08246 | 0.97222 |
| 0.43463 | 0.07522 | 0.97222 |
| 0.43530 | −0.01237 | 0.97222 |
| 0.43939 | 0.06785 | 0.97222 |
| 0.44095 | −0.01908 | 0.97222 |
| 0.44395 | 0.06037 | 0.97222 |
| 0.44643 | −0.02593 | 0.97222 |
| 0.44836 | 0.05281 | 0.97222 |
| 0.45170 | −0.03293 | 0.97222 |
| 0.45262 | 0.04517 | 0.97222 |
| 0.45676 | 0.03746 | 0.97222 |
| 0.45679 | −0.04007 | 0.97222 |
| 0.46078 | 0.02969 | 0.97222 |
| 0.46173 | −0.04733 | 0.97222 |
| 0.46468 | 0.02185 | 0.97222 |
| 0.46654 | −0.05466 | 0.97222 |
| 0.46845 | 0.01393 | 0.97222 |
| 0.47135 | −0.06199 | 0.97222 |
| 0.47207 | 0.00594 | 0.97222 |
| 0.47552 | −0.00211 | 0.97222 |
| 0.47626 | −0.06926 | 0.97222 |

TABLE 1-continued

| X | Y | Z |
|---|---|---|
| 0.47879 | −0.01023 | 0.97222 |
| 0.48127 | −0.07646 | 0.97222 |
| 0.48193 | −0.01841 | 0.97222 |
| 0.48501 | −0.02662 | 0.97222 |
| 0.48624 | −0.08368 | 0.97222 |
| 0.48808 | −0.03482 | 0.97222 |
| 0.49104 | −0.09102 | 0.97222 |
| 0.49119 | −0.04301 | 0.97222 |
| 0.49433 | −0.05119 | 0.97222 |
| 0.49563 | −0.09849 | 0.97222 |
| 0.49749 | −0.05936 | 0.97222 |
| 0.49998 | −0.10610 | 0.97222 |
| 0.50065 | −0.06752 | 0.97222 |
| 0.50382 | −0.07569 | 0.97222 |
| 0.50415 | −0.11380 | 0.97222 |
| 0.50694 | −0.08388 | 0.97222 |
| 0.50825 | −0.12156 | 0.97222 |
| 0.50825 | −0.12156 | 0.97222 |
| 0.51000 | −0.09208 | 0.97222 |
| 0.51300 | −0.10031 | 0.97222 |
| 0.51578 | −0.12416 | 0.97222 |
| 0.51595 | −0.10856 | 0.97222 |
| 0.51888 | −0.11681 | 0.97222 |
| 0.23191 | 0.07168 | 1.00000 |
| 0.23245 | 0.08034 | 1.00000 |
| 0.23499 | 0.08870 | 1.00000 |
| 0.23597 | 0.06417 | 1.00000 |
| 0.23860 | 0.09659 | 1.00000 |
| 0.24299 | 0.10408 | 1.00000 |
| 0.24388 | 0.06071 | 1.00000 |
| 0.24807 | 0.11118 | 1.00000 |
| 0.25257 | 0.05972 | 1.00000 |
| 0.25372 | 0.11787 | 1.00000 |
| 0.25994 | 0.12416 | 1.00000 |
| 0.26127 | 0.05961 | 1.00000 |
| 0.26663 | 0.12991 | 1.00000 |
| 0.26998 | 0.05989 | 1.00000 |
| 0.27374 | 0.13511 | 1.00000 |
| 0.27871 | 0.06024 | 1.00000 |
| 0.28124 | 0.13967 | 1.00000 |
| 0.28748 | 0.06028 | 1.00000 |
| 0.28911 | 0.14356 | 1.00000 |
| 0.29623 | 0.06007 | 1.00000 |
| 0.29734 | 0.14673 | 1.00000 |
| 0.30496 | 0.05953 | 1.00000 |
| 0.30580 | 0.14910 | 1.00000 |
| 0.31360 | 0.05861 | 1.00000 |
| 0.31442 | 0.15062 | 1.00000 |
| 0.32217 | 0.05729 | 1.00000 |
| 0.32320 | 0.15124 | 1.00000 |
| 0.33063 | 0.05554 | 1.00000 |
| 0.33199 | 0.15094 | 1.00000 |
| 0.33901 | 0.05335 | 1.00000 |
| 0.34062 | 0.14975 | 1.00000 |
| 0.34728 | 0.05070 | 1.00000 |
| 0.34911 | 0.14770 | 1.00000 |
| 0.35544 | 0.04757 | 1.00000 |
| 0.35743 | 0.14483 | 1.00000 |
| 0.36343 | 0.04402 | 1.00000 |
| 0.36546 | 0.14123 | 1.00000 |
| 0.37121 | 0.04006 | 1.00000 |
| 0.37314 | 0.13701 | 1.00000 |
| 0.37873 | 0.03574 | 1.00000 |
| 0.38051 | 0.13225 | 1.00000 |
| 0.38602 | 0.03105 | 1.00000 |
| 0.38756 | 0.12699 | 1.00000 |
| 0.39311 | 0.02603 | 1.00000 |
| 0.39426 | 0.12136 | 1.00000 |
| 0.39998 | 0.02068 | 1.00000 |
| 0.40058 | 0.11544 | 1.00000 |
| 0.40658 | 0.10925 | 1.00000 |
| 0.40665 | 0.01504 | 1.00000 |
| 0.41229 | 0.10282 | 1.00000 |
| 0.41310 | 0.00913 | 1.00000 |
| 0.41774 | 0.09617 | 1.00000 |
| 0.41934 | 0.00300 | 1.00000 |
| 0.42295 | 0.08932 | 1.00000 |
| 0.42536 | −0.00333 | 1.00000 |

TABLE 1-continued

| X | Y | Z |
|---|---|---|
| 0.42795 | 0.08229 | 1.00000 |
| 0.43118 | −0.00984 | 1.00000 |
| 0.43275 | 0.07510 | 1.00000 |
| 0.43683 | −0.01652 | 1.00000 |
| 0.43738 | 0.06778 | 1.00000 |
| 0.44186 | 0.06033 | 1.00000 |
| 0.44232 | −0.02333 | 1.00000 |
| 0.44619 | 0.05278 | 1.00000 |
| 0.44764 | −0.03027 | 1.00000 |
| 0.45039 | 0.04515 | 1.00000 |
| 0.45281 | −0.03731 | 1.00000 |
| 0.45447 | 0.03745 | 1.00000 |
| 0.45784 | −0.04445 | 1.00000 |
| 0.45847 | 0.02972 | 1.00000 |
| 0.46237 | 0.02194 | 1.00000 |
| 0.46274 | −0.05168 | 1.00000 |
| 0.46616 | 0.01411 | 1.00000 |
| 0.46754 | −0.05897 | 1.00000 |
| 0.46982 | 0.00621 | 1.00000 |
| 0.47225 | −0.06633 | 1.00000 |
| 0.47331 | −0.00177 | 1.00000 |
| 0.47666 | −0.00981 | 1.00000 |
| 0.47696 | −0.07369 | 1.00000 |
| 0.47987 | −0.01789 | 1.00000 |
| 0.48174 | −0.08100 | 1.00000 |
| 0.48297 | −0.02603 | 1.00000 |
| 0.48602 | −0.03419 | 1.00000 |
| 0.48658 | −0.08827 | 1.00000 |
| 0.48658 | −0.08827 | 1.00000 |
| 0.48907 | −0.04234 | 1.00000 |
| 0.49132 | −0.09558 | 1.00000 |
| 0.49219 | −0.05046 | 1.00000 |
| 0.49536 | −0.05858 | 1.00000 |
| 0.49583 | −0.10305 | 1.00000 |
| 0.49856 | −0.06667 | 1.00000 |
| 0.50014 | −0.11063 | 1.00000 |
| 0.50174 | −0.07477 | 1.00000 |
| 0.50428 | −0.11831 | 1.00000 |
| 0.50491 | −0.08288 | 1.00000 |
| 0.50801 | −0.09101 | 1.00000 |
| 0.50921 | −0.12539 | 1.00000 |
| 0.51106 | −0.09917 | 1.00000 |
| 0.51406 | −0.10734 | 1.00000 |
| 0.51701 | −0.11553 | 1.00000 |
| 0.51707 | −0.12380 | 1.00000 |

It will also be appreciated that the bucket disclosed in the above Table may be scaled up or down geometrically for use in other similar turbine designs. Consequently, the coordinate values set forth in Table 1 may be scaled upwardly or downwardly such that the internal profile shape of the bucket remains unchanged. A scaled version of the coordinates in Table 1 would be represented by X, Y and Z coordinate values of Table 1, with the non-dimensional X, Y and Z coordinate values for example converted to inches, multiplied and/or divided by a constant number.

The present disclosure is further directed to core inserts 200 for use in forming buckets 22. For example, FIG. 10 illustrates various components of one embodiment of a mold 202 for forming a bucket 22. The mold 202 may include, for example, a shell. The shell may include a lower shell 204 and an upper shell 206, as shown, or may be a unitary shell, or may have any variety and configuration of shell parts. The shell 204, 206 may, for example, be configured to accept a bucket 22 substrate for forming the bucket 22 in the shell 204, 206. In exemplary embodiments, the bucket 22 may be cast. Alternatively, however, the bucket 22 may be formed through any suitable manufacturing process.

The mold 202 may further include the core insert 200. The core insert 200 may generally include portions that define the various cooling passages, cooling circuits, and other portions of the internal core of the bucket 22. The core insert 200 may be a unitary core, defining all of the various cooling passages and cooling circuits, or may include various core parts configured to define any variety of the various cooling passages and cooling circuits. Further, the core insert 200 may have an exterior core insert profile that corresponds to the internal bucket core profile 40, 56 such that the internal bucket core profile 40, 56 is formed through use of the core insert 200 in the mold 202. Accordingly, the coordinate values given in Table 1 above additionally provide the preferred nominal exterior core insert profile envelope, and the above disclosure with respect to the internal bucket core profile similarly applies to the exterior core insert profile.

The presently disclosed bucket 22 having an internal bucket core profile 40, 56 as discussed herein, as well as the presently disclosure core insert 200 having an exterior core insert profile as discussed herein, provide a variety of advantages. For example, the geometry of the bucket 22 core may provide more evenly distributed cooling flow therethrough at increased Mach numbers. Additionally, the present geometry may provide for even heat transfer in the bucket 22 walls, etc., surrounding the core. Further, the present geometry may provide for improved manufacturing of buckets 22, and may decrease bucket 22 balance and stress concerns and minimize the weight of the buckets 22 while maximizing durability and aeromechanical requirements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine bucket including an airfoil, platform, shank and dovetail, said bucket having a nominal internal core profile substantially in accordance with Cartesian coordinate values of X, Y and Z set forth in Table 1 wherein the Z values are non-dimensional values from 0 to 1 convertible to Z distances in inches by multiplying the Z values by a height of the bucket in inches, and wherein X and Y are non-dimensional values which, when connected by smooth continuing arcs, define internal core profile sections at each distance Z along the bucket, the profile sections at the Z distances being joined smoothly with one another to form said bucket internal core profile, wherein said internal core profile lies in an envelope within +/−0.005 non-dimensional in a direction normal to any internal core surface location.

2. A turbine bucket according to claim 1 wherein said bucket has side walls and ribs extending therebetween, said ribs being spaced from one another between leading and trailing edges of the bucket and defining with internal wall surfaces of said side walls internal cooling passages along the length of the bucket, said smooth continuing arcs extending along the internal wall surfaces of the cooling passages and between adjacent passages along said side walls.

3. A turbine bucket according to claim 2 wherein said smooth continuing arcs pass through junctures between the ribs and each of the side walls.

4. A turbine bucket according to claim 1 wherein said bucket airfoil has an external airfoil shape, said internal core profile sections including generally airfoil-shaped portions within the bucket airfoil and generally conform to profile sections of said external airfoil shape of the bucket airfoil less a wall thickness therebetween.

5. A turbine bucket according to claim 1 forming part of a first stage of a turbine.

6. A turbine bucket according to claim 1 wherein the X, Y and Z distances are scalable as a function of the same constant or number to provide a scaled-up or scaled-down internal core profile.

7. A turbine system comprising:

a compressor section;

a combustor section; and a turbine section, the turbine section comprising a plurality of buckets, each of said plurality of buckets including an airfoil, platform, shank and dovetail, each of said plurality of buckets having a nominal internal core profile substantially in accordance with Cartesian coordinate values of X, Y and Z set forth in Table 1 wherein the Z values are non-dimensional values from 0 to 1 convertible to Z distances in inches by multiplying the Z values by a height of the bucket in inches, and wherein X and Y are non-dimensional values which, when connected by smooth continuing arcs, define internal core profile sections at each distance Z along the bucket, the profile sections at the Z distances being joined smoothly with one another to form said bucket internal core profile, wherein said internal core profile lies in an envelope within +/−0.005 non-dimensional in a direction normal to any internal core surface location.

8. A turbine system according to claim 7 wherein each said bucket has side walls and ribs extending therebetween, said ribs being spaced from one another between leading and trailing edges of the bucket and defining with internal wall surfaces of said side walls internal cooling passages along the length of the bucket, said smooth continuing arcs extending along the internal wall surfaces of the cooling passages and between adjacent passages along said side walls.

9. A turbine system according to claim 8 wherein said smooth continuing arcs pass through junctures between the ribs and each of the side walls.

10. A turbine system according to claim 7 wherein each said bucket airfoil has an external airfoil shape, said internal core profile sections including generally airfoil-shaped portions within the bucket airfoil and generally conforming to profile sections of said external airfoil shape of the bucket airfoil less a wall thickness therebetween.

11. A turbine system according to claim 7 wherein the turbine section comprises a first stage of the turbine.

12. A turbine system according to claim 7 wherein the turbine section has 70 buckets and X represents a distance parallel to the turbine axis of rotation.

13. A turbine system according to claim 7 wherein the X, Y and Z distances are scalable as a function of the same constant or number to provide scaled-up or scaled-down internal core profiles.

14. A core insert having a nominal external core insert profile substantially in accordance with Cartesian coordinate values of X, Y and Z set forth in Table 1 wherein the Z values are non-dimensional values from 0 to 1 convertible to Z distances in inches by multiplying the Z values by a height in inches, and wherein X and Y are non-dimensional values which, when connected by smooth continuing arcs, define external core insert profile sections at each distance Z along the core insert, the profile sections at the Z distances being joined smoothly with one another to form said external core insert profile, wherein said external core insert profile lies in an envelope with +/−0.005 non-dimensional in a direction normal to any external core insert surface location.

15. A core insert according to claim 14 wherein the X, Y and Z distances are scalable as a function of the same constant or number to provide a scaled-up or scaled-down external core insert profile.

* * * * *